235-382
10/1/85 XR 4,544,832 SR

United States Patent [19]
Young et al.

[11] Patent Number: 4,544,832
[45] Date of Patent: Oct. 1, 1985

[54] CARD READER WITH BUFFER FOR DEGRADED MODE

[75] Inventors: Jorge A. Young; Bhupendra J. Khandwala, both of Claremont, Calif.

[73] Assignee: Figgie International, Inc., Richmond, Va.

[21] Appl. No.: 704,898

[22] Filed: Feb. 22, 1985

Related U.S. Application Data

[63] Continuation of Ser. No. 412,269, Aug. 27, 1982, abandoned.

[51] Int. Cl.[4] ..... G06C 15/00
[52] U.S. Cl. ..... 235/377; 235/419; 235/380; 235/382; 340/825.31
[58] Field of Search ..... 235/377, 378, 379, 380, 235/381, 432, 419; 194/DIG. 26; 364/401; 340/825.31, 825.32, 825.33, 825.34, 825.36

[56] References Cited

U.S. PATENT DOCUMENTS

| | | | |
|---|---|---|---|
| 3,701,100 | 10/1972 | Yarbrough . | |
| 3,833,885 | 9/1974 | Gentile et al. | 340/152 R |
| 3,838,395 | 9/1974 | Suttill, Jr. et al. . | |
| 3,842,629 | 10/1974 | Pazer et al. . | |
| 3,982,103 | 9/1976 | Goldman | 235/380 |
| 3,988,570 | 10/1976 | Murphy et al. . | |
| 4,004,134 | 1/1977 | Hwang . | |
| 4,017,835 | 4/1977 | Randolph | 340/152 R |
| 4,091,448 | 5/1978 | Clausing | 235/379 |
| 4,114,027 | 9/1978 | Slater et al. | 235/419 |
| 4,187,498 | 2/1980 | Creekmore | 340/149 A |
| 4,197,986 | 4/1980 | Nagata | 235/379 |
| 4,256,955 | 3/1981 | Giraud et al. | 235/380 |
| 4,270,043 | 5/1981 | Baxter et al. | 235/419 |
| 4,323,771 | 4/1982 | Chalker, Jr. et al. | 235/377 |
| 4,355,369 | 10/1982 | Garvin | 364/900 |
| 4,358,672 | 11/1982 | Hyatt et al. . | |
| 4,375,032 | 2/1983 | Uchida . | |
| 4,409,657 | 10/1983 | van der Lely . | |
| 4,415,893 | 11/1983 | Roland et al. . | |

FOREIGN PATENT DOCUMENTS

| | | | |
|---|---|---|---|
| 115966 | 3/1982 | Japan | 235/379 |
| 108951 | 7/1982 | Japan | 235/379 |
| 108952 | 7/1982 | Japan | 235/379 |

OTHER PUBLICATIONS

"CTR-Computerized Time Recording", E. Fabo & E. Hoglund, Ericsson Review, No. 2, 1980.

*Primary Examiner*—Gene Z. Rubinson
*Assistant Examiner*—Robert Lev
*Attorney, Agent, or Firm*—Knobbe, Martens, Olson & Bear

[57] ABSTRACT

There is disclosed herein an improved card reader for a security system utilizing a central controller and a plurality of card readers for controlling traffic through critical doors in a facility. The improved reader includes means for improving the system throughput by buffer storing large numbers of transactions all occurring within a short time for time clock functions in time and attendance applications for hourly employees. Also disclosed are means for conditioned emergency responses to sensed changes in status of alarm contacts coupled to the reader and located in the vicinity of the reader within 2 miles. There is also disclosed means for temporarily storing transaction information for transactions made during periods when communications with the controller are lost. During such degraded mode operation, access is granted to cardholders with the proper system code and their ID code and the time of the transaction are stored in a buffer. When communications are restored, the transactions saved in the buffer are sent to the controller.

38 Claims, 22 Drawing Figures

CARD READER WITH BUFFER FOR DEGRADED MODE

This application is a continuation of application Ser. No. 412,269, filed Aug. 27, 1982, abandoned.

BACKGROUND OF THE INVENTION

This application relates to the field of door access security systems and, particularly, to the field of card readers for door access security systems.

Door access security systems, utilizing magnetic card readers at doors to be controlled, are known in the prior art. Such systems include central controllers coupled to a plurality of readers, each of which is located at a specific door to be controlled. Authorized persons wishing to gain access through a door, insert magnetic cards into slots in the reader. Magnetic codings on the cards are then read and data is sent to the controller which authorizes or refuses entry and tells the reader either to keep the door locked or unlock the door.

Such a system can advantageously be used as a time clock to keep a record of the hours worked by hourly employees. However, a problem with system throughput arises when a large number of employees all try to clock in or out at the same time. The delays caused by reading of a card, waiting for a poll signal to come to the reader from the controller, sending the card data to the controller and waiting for the controller to process the information and send back a "Go" or "No Go" signal can create impatience in the workers at the end of the line.

Such card reader systems can also be used to monitor alarm contacts located at strategic locations throughout a facility. In the prior art, a centrally located alarm contact monitoring device was located near the controller with individual wires coupling the contact monitoring device to the alarm contacts located throughout the plant. Such systems were effective but required an individual polling protocol and the associated hardware for the alarm contact monitoring device. Further, individual wires had to be strung between all the contacts to be monitored and the central monitoring device. This could result in large expenditures for wire. Further, such central contact monitoring devices were generally not well suited to applications where only a single alarm contact needed to be monitored since the function rarely justified the expense.

The prior art systems also had room for improvement in the area of operation during times when the communication lines between the reader and the central controller were down. In such a situation, if all access was denied, people would be inconvenienced or, worse, trapped in an undesirable emergency situation. The alternative would be to allow free access through all doors. However, with record-keeping functions done at the central controller, there would be no record of the individuals who entered and left specific areas during specific times while the lines were down. As a result, if theft occurred during the down time, there would be no record to use in the investigation.

SUMMARY OF THE DISCLOSURE

There is disclosed herein a card reader for use in a security system for controlling access through key doors, said security system having a central controller. The card reader reads magnetic data stored on cards held by employees, etc. The cards have a system code and an I.D. code on them. The card readers can do time and attendance functions to serve as a time clock by reading data stored permanently on the card and sending it to the central controller for processing. The central controller then grants or denies access based on the card data. Optionally the improved card reader can also make the decision whether to grant or deny access locally without dialogue with the controller by reading some of the data on the card and storing the rest for later transmission to the central controller. Typically, this is done by reading the system code and granting authorization if the system code on the card matches the system code on user programmable switches. The I.D. code is then stored in the buffer with the time of day of the transaction for later transmission to the central controller. This feature increases the throughput of the system by eliminating the need for each employee to wait for authorization from a controller which may be delayed while processing other messages from other readers.

The improved card reader can also sense when communications with the central controller are lost and grant or deny access without consulting the controller, based upon data on the card. During times when communications with the central controller are lost, the card reader stores the I.D. data from the card, for each employee who was granted authorization, in a buffer for later transmission to the central controller.

The improved card reader can also monitor alarm contacts for changes in status and signal these changes to the central controller. The central controller can be programmed to make a conditioned response to the reader coupled to the changed contact or to any other reader in the system. The response message can cause a relay or relays in the reader to change states, thereby signalling any devices coupled to the relay or relays that an action in response to the changed alarm contact is desired.

DETAILED DESCRIPTION OF THE PREFERRED EMBODIMENT

Figure 1:
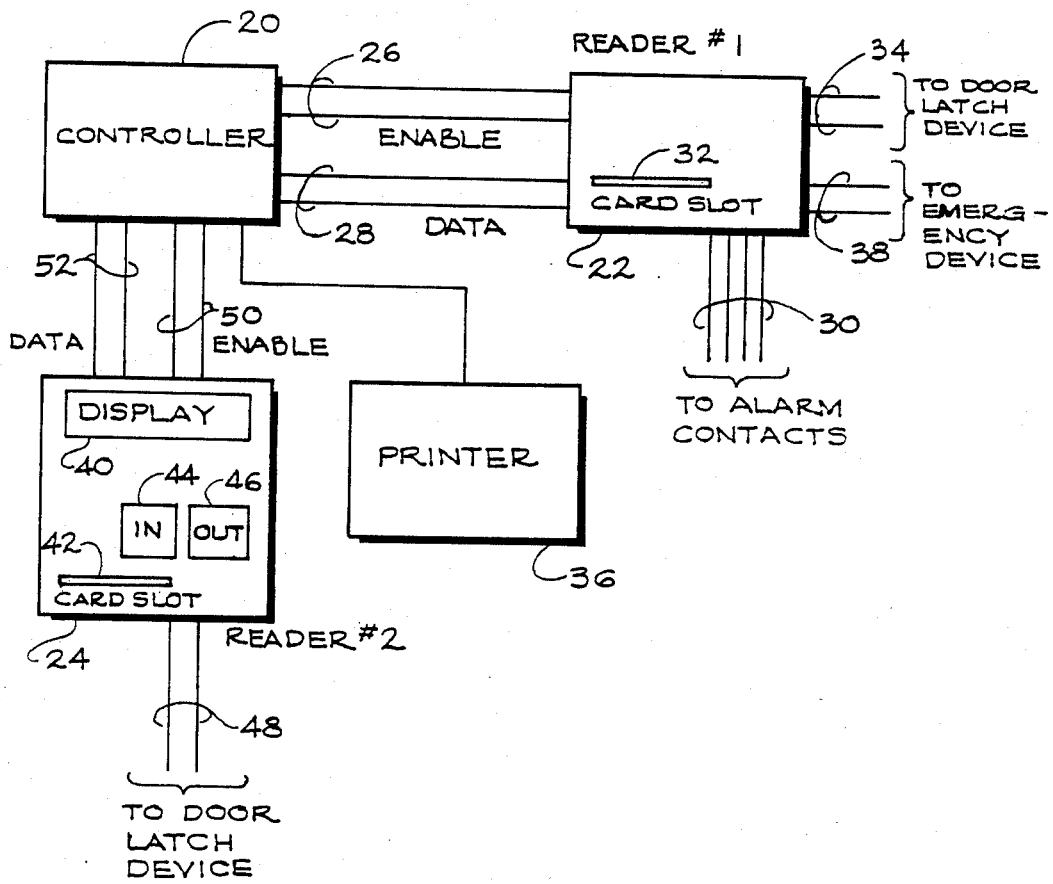
FIG. 1 is a block diagram of a security sytem in which the improved reader of the invention could be used.

Referring to FIG. 1 there is disclosed a system diagram of a typical magnetic card reading security system. A controller 20 is coupled to a plurality of card readers of which readers 22 and 24 are typical. The controller 20 is coupled to each reader by an enable pair and a data pair by which the controller can communicate with any card reader in the system.

For example, the controller 20 communicates with the reader 22 by an enable pair 26 and a data pair 28. The controller 20 polls the reader 22 for messages and sends commands to it by the enable pair 26. Data is sent to the controller 20 from the reader 22 via the data pair 28. Serial format is used on both lines.

The reader 22 is typically located at a door that needs to be access-controlled while the controller 20 can be located at some distance from the door. The structural details of the controller 20 are well known in the art, and it can be purchased under the model designation MAC 530/40 from Rusco Electronic Systems in Glendale, Calif. The object code software for the controller is also well known and can be purchased from the same source.

In operation, the reader 22 receives a magnetic card in a card slot 32. The details of a typical magnetic card structure will be found in U.S. Pat. Nos. 3,717,749 or 3,811,977. Other structures could also be used; the details of the structure of the magnetic card are not critical to the invention. Any structure capable of holding data encoded in a card and converting it to electrical signals capable of being transmitted over a line will be satisfactory.

When the card is read, the data on the card is stored in a temporary RAM location until a polling signal from the controller 20 arrives on the enable lines 26. Upon receipt of the polling signal on the line 26, the data from the card is transferred on the data lines 28 to the controller 20 unless certain options are present which cause the reader to independently make the authorization decision. The controller 20 processes the data and sends back a "Go" or "No Go" command which causes the reader 22 to take the appropriate action. If the command is "Go", the reader 22 unlocks the door latch via the lines 34 and lights a green LED. If the command is "No Go", the reader 22 lights a red LED and, optionally, energizes a No Go relay.

The reader 22 can also incorporate circuitry to monitor a plurality of alarm contacts connected to the lines 30. When one of the contacts changes state, the reader 22 senses the change and signals the controller 20 on the next poll. The controller 20 can then print out a pre-programmed message on a printer 36. More importantly, the controller 20 can automatically send back a command to cause a switch closure by energizing a relay in the reader 22 or in any other reader in the system. This automatic response can also be any other command that the reader receives normally from the controller. The relay can be connected to an emergency device via the lines 38. The emergency device can be any device such as an automatic phone dialer, a sprinkler system, an alarm or whatever other device that is desired.

The reader 24 is a different type of improved reader which can be used to keep time records for the attendance of hourly employees' on their jobs. The reader 24 has a display 40, a card slot 42, and "in" and "out" buttons, 44 and 46. In operation, an employee would place his card in the card slot 42 and press either the "in" button 44 or the "out" button 46. The data on his card plus the time of day displayed in the display 40 would then be stored in a buffer in the reader 24. Based upon the system code data on the card, the reader 24 would authorize or deny entry to the employee. If entry is authorized by the reader 24 and a green LED will be lit, the door will be unlocked via the lines 48. If entry is denied, the reader 24 will so indicate by lighting a red LED on the face plate. All authorization or denial decisions are made locally by the reader 24, and the data regarding each transaction is stored in the local buffer in the reader 24.

The controller 20 is coupled to the reader 24 by an enable pair 50 and a data pair 52. The controller 20 polls the reader 24 by sending a poll signal on the line 50. Upon receipt of the poll signal, the reader 24 transfers the data for one transaction out of its buffer to the controller 20 via the data lines 52. The controller then can process the data in any fashion including printing it out on the printer 36. The details of the structure and operation of the controller 20 are exemplified by U.S. Pat. Nos. 4,216,375 and 4,218,690.

The reader 24 can also include means to offset the time displayed in the display 40 from the time kept by the controller 20 in the case that the controller is in a different time zone from the reader. Normally the controller 20 keeps the master time for the system and the reader 24 keep its own time. Every 15 minutes, the reader 24 inquires the time of the controller 20 and synchronizes the reader's local time with the master time kept by the controller. When the reader 24 is in a different time zone from the controller 20, a group of offset switches in the reader 24 are set to indicate the number of minutes of offset between the local reader time and the controller time.

The reader 22 can also include a local buffer for keeping a record of all transactions which occur during times when communications with the controller 20 are lost due to cutting of the wire pairs, power failure or for other reasons. When the reader 22 has not received a poll from the controller for a predetermined time, the reader will start storing the data for transactions during the downtime in its local buffer. Each magnetic card has a system code and an ID code. The system code is used by the reader to determine whether or not to grant authorization for entry to the individual. If the individual is permitted to enter, his ID code and the local time will be stored in the local buffer. When communications with the controller 20 are restored, the data in the buffer will be sent to the controller via the data lines for processing there.

Figure 2:
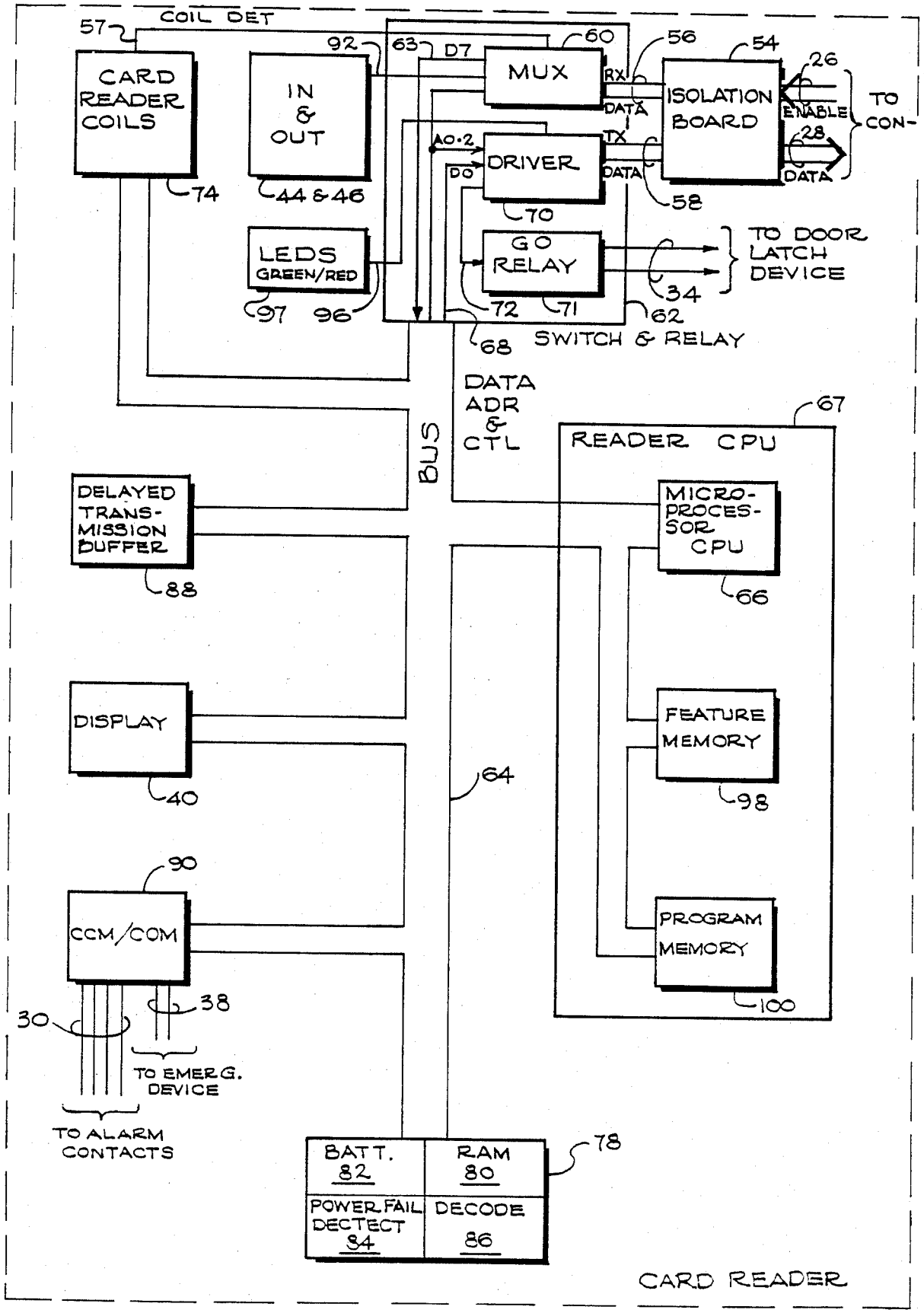
FIG. 2 is a block diagram of the improved reader.

Referring to FIG. 2, there is shown a block diagram of a card reader for use in a security system such as is shown in FIG. 1. Although in reality two different types of readers exist, the core circuits of each type of reader are the same with one type of reader having certain additional optional circuits which the other does not have. FIG. 2 represents a combined functional block diagram of a reader with the common core circuits and with all the optional circuit elements of both types of readers also present.

The card reader of FIG. 2 communicates with the controller 20 of FIG. 1 through an isolation board 54. The isolation board 54 serves to isolate the data on the enable pair 26 and data pair 28 from the logic circuitry of the rest of the card reader. The isolation board 54 passes the signals from the enable line 26 through to the RX data lines 56 and passes the data from the Tx data lines 58 through to the data lines 28.

The RX data lines 56 are coupled to a multiplexer 60 in a switch and relay board 62. The purpose of the multiplexer 60 is to select various data channels for connection to a data line D7, 63, of a bus 64. The bus 64 is coupled between the switch and relay board 62 and the data, address and control terminals of a microprocessor CPU 66 on a reader CPU board 67. Address lines A0–A2 from the bus 64 are also coupled to the multiplexer 60. Through these address lines, the CPU 66 causes the multiplexer 60 to select one of the data channels connected to it for connection to its data output coupled to the line D7. The microprocessor 66 can then read the data on the selected data channel through the D7 line 63. In FIG. 2 the only data channels which are shown are the Rx data line 56 through which commands and polling signals are received and the coil detect line 57 which carries data read from the card. Other data channels are used for other features of the reader not relevant to the present discussion.

Data to be transmitted from the card reader to the central controller 20 are input from the DØ line 68 of the data bus 64 to a driver 70. The driver 70 is also coupled to the AØ–A2 address lines of the data bus 64 which supply an address from the microprocessor 66. The driver 70 has several addressable outputs, one of which is the Tx data lines 58. The address supplied to the driver 70 causes it to apply the signal on the DØ line 68 to the selected output. To transmit data, the microprocessor 66 places the data to be sent on the DØ bus line and writes the proper address on the address lines AØ–A2 of the bus 64. The serial data on the DØ line is then applied to the Tx data lines 58.

The central controller 20 receives the data on the data line 28 and acts upon the data message in some fashion depending upon what the message is and may or may not send a command back to the card reader via the enable line 26.

A go relay 71 is coupled to a door latch device by the lines 34. The lines 34 can be coupled to relay contacts or other switching devices to provide an interruptible current flow path to control whether the door latch is in a locked or unlocked state. The go relay is also coupled to the driver 70 by a switching line 72. The switching line controls the state of the go relay and thereby controls the state of the door latch device. The switching line is addressable by the microprocessor 66 through the driver 70 such that the microprocessor 66 controls the state of the go relay 70.

The microprocessor 66 is also coupled to a card reader coil circuit 74 by the bus 64. The card reader coils 74 consist, in the preferred embodiment, of a plurality of coils coupled to the address and data line of the bus 64 and physically arranged so as to individually magnetically interact with a plurality of magnetized spots on a card inserted in the card slots 42 or 32. The microprocessor 66 can individually address and read each coil in the card reader coil circuit 74 to determine the data in the magnetic spots on the card. The details of the card reading coil circuit are known to those skilled in the art and are not critical to the invention.

The microprocessor 66 is also coupled to an optional display 40 by the bus 64. In readers which are being used for time and attendance functions, i.e., as time clocks, it is desirable that the time of day be displayed externally for the benefit of workers who are lined up and waiting to put their cards into the reader 24 to start or end their work shifts. The display 40 can be any conventional display, and the details of its construction are not critical to the invention.

The microprocessor 66 is also coupled to a random access memory (RAM) board 78. The RAM board 78 contains a RAM buffer memory 80, a battery backup system comprised of a battery 82 and a power fail detect circuit 84. The power fail detect circuit 84 monitors the 12 volt unregulated D.C. voltage derived from the A.C. power line and connects the battery 82 to the power terminals of the RAM buffer 80 when the A.C. line power fails so as to preserve the data stored in the RAM 80. The RAM 80 is selected by the microprocessor 66 through connection of a decoder 86 to the address and control lines of the bus 64. When the microprocessor 66 wishes to write a word in the RAM 80, the microprocessor generates the proper address to select the RAM 80 and places it on the bus 64 thereby enabling the RAM 80 through the decoder 86. The data to be written into the RAM 80 is then placed on the data lines of the bus 64.

A delayed transmission buffer 88 is also coupled to the microprocessor 66 through the bus 64. The purpose of the delayed transmission buffer 88 is to store data read from the magnetic cards during times when communication with the central controller 20 is lost. A CCM/COM board 90 is also coupled to the microprocessor 66 by the bus 64. The purpose of the CCM/COM board 90 is to monitor the condition of an alarm device or devices external to the card reader and to generate data indicating the condition of the alarm devices for transmission to the center controller. The CCM/COM board 90 also can receive data from the central controller which causes a switch closure on the CCM/COM board. This switch is coupled to an emergency device by the lines 38. The alarm contacts are coupled to the CCM/COM board 90 by the lines 30.

When the card reader is being used for a time and attendance function, the In and Out buttons 44 and 46 are used to tell the card reader whether the cardholder wishes to enter or leave an area. The In and Out buttons 44 and 46 are coupled to the MUX 60 in the switch and relay board 62 by the line 92.

A red and a green indicator LED, represented by block 97 are each coupled to the MUX 60 by the bus 96. The LED's are used by the microprocessor 66 to signal whether authorization has been granted or denied.

The microprocessor 66 is coupled to a feature memory 98 and to a program memory 100 by the bus 64. The program memory 100 stores the instructions for the microprocessor 66 and the feature memory 98 stores data indicating which options are in effect for the microprocessor 66.

Figure 3:
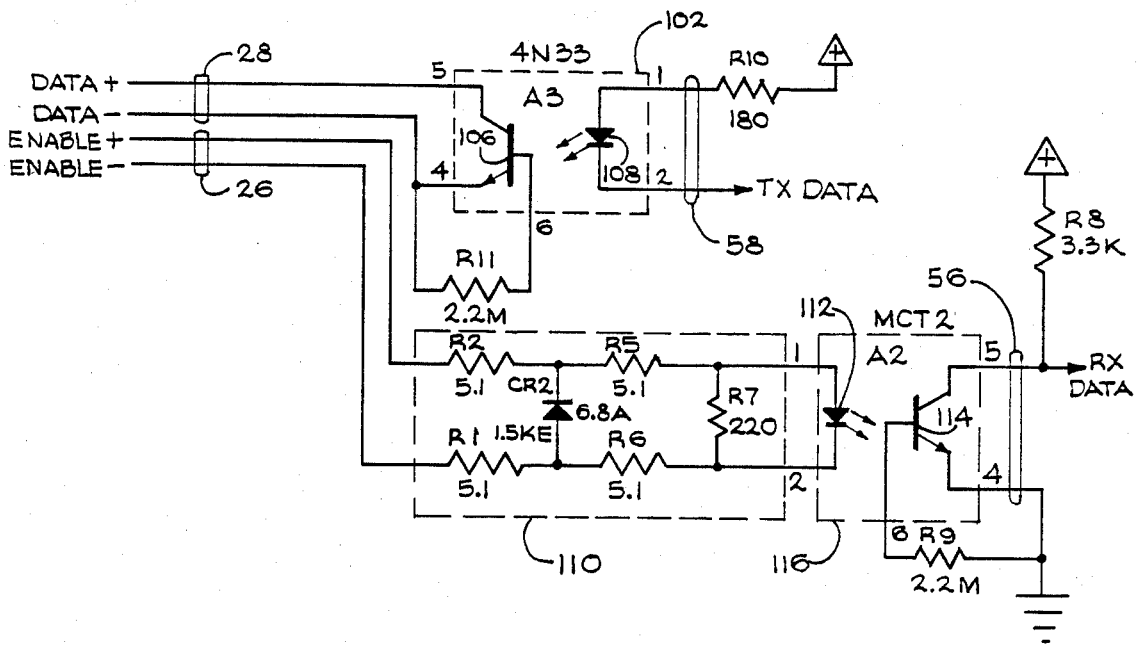
FIG. 3 is a logic diagram of the optical isolator board.

Referring to FIG. 3, there is shown a circuit diagram for the isolation board 54 in FIG. 2. The data lines 28 are coupled to the collector and emitter of a transistor 106 in the optical isolator 102. The light emitting diode 108 of the optical isolator 102 is coupled across the TX data lines 58. When the current is flowing in the TX data lines 58, the LED 108 is energized and emits light causing the transistor 106 to assume one of its two switching states. The opposite state is assumed when the LED 108 is de-energized.

The enable lines 26 are coupled through a noise suppression circuit 110 to the LED 112 of an optical isolator 116. The transistor 114 of the optical isolator has its collector and emitter coupled to the RX data lines 56. In the preferred embodiment, the optical isolator 116 is a Monsanto MCT2. The optical isolator 102 is a Monsanto 4N33.

Figure 4A:
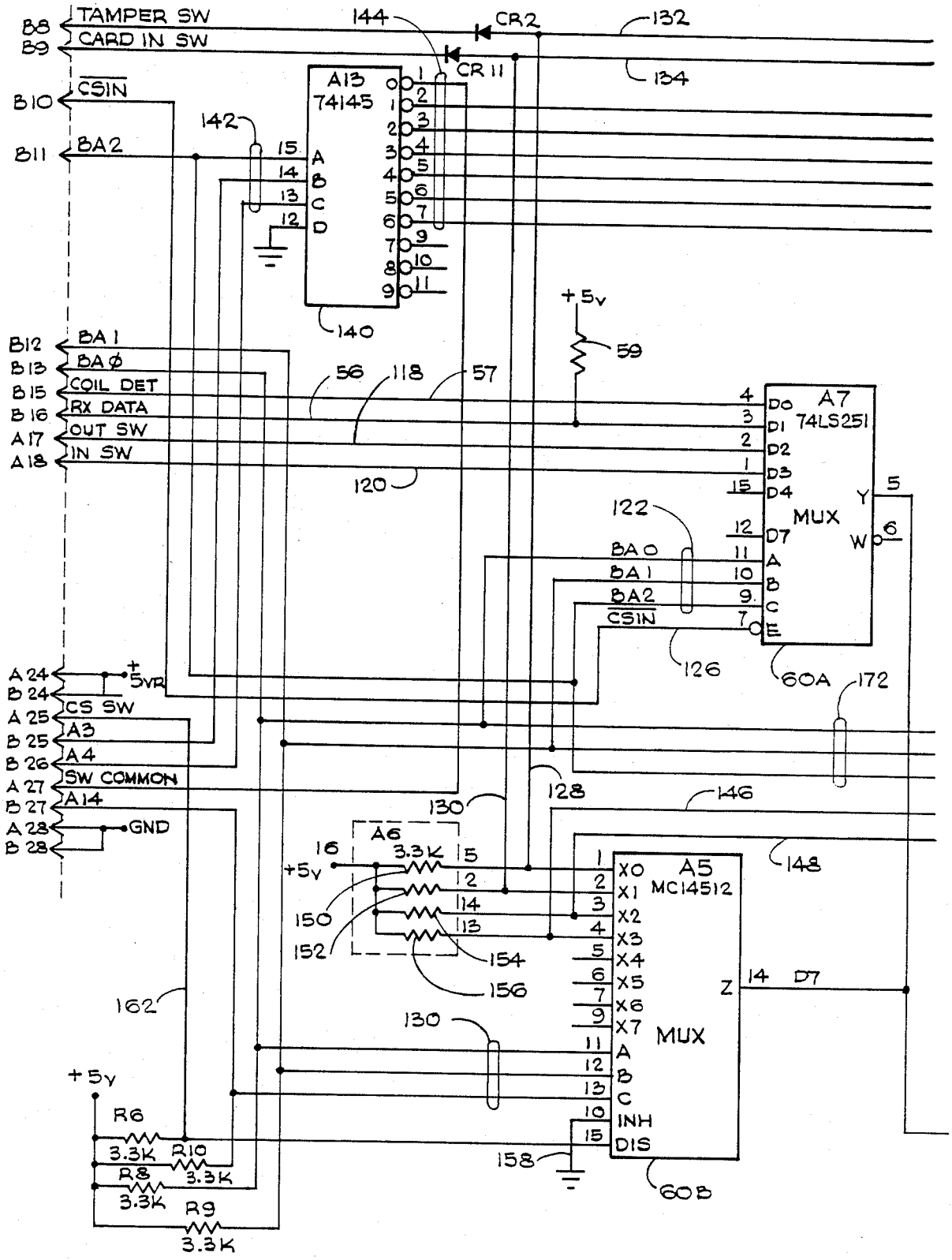
FIGS. 4 A and B are a logic diagram of the switch and relay board.
Figure 4B:
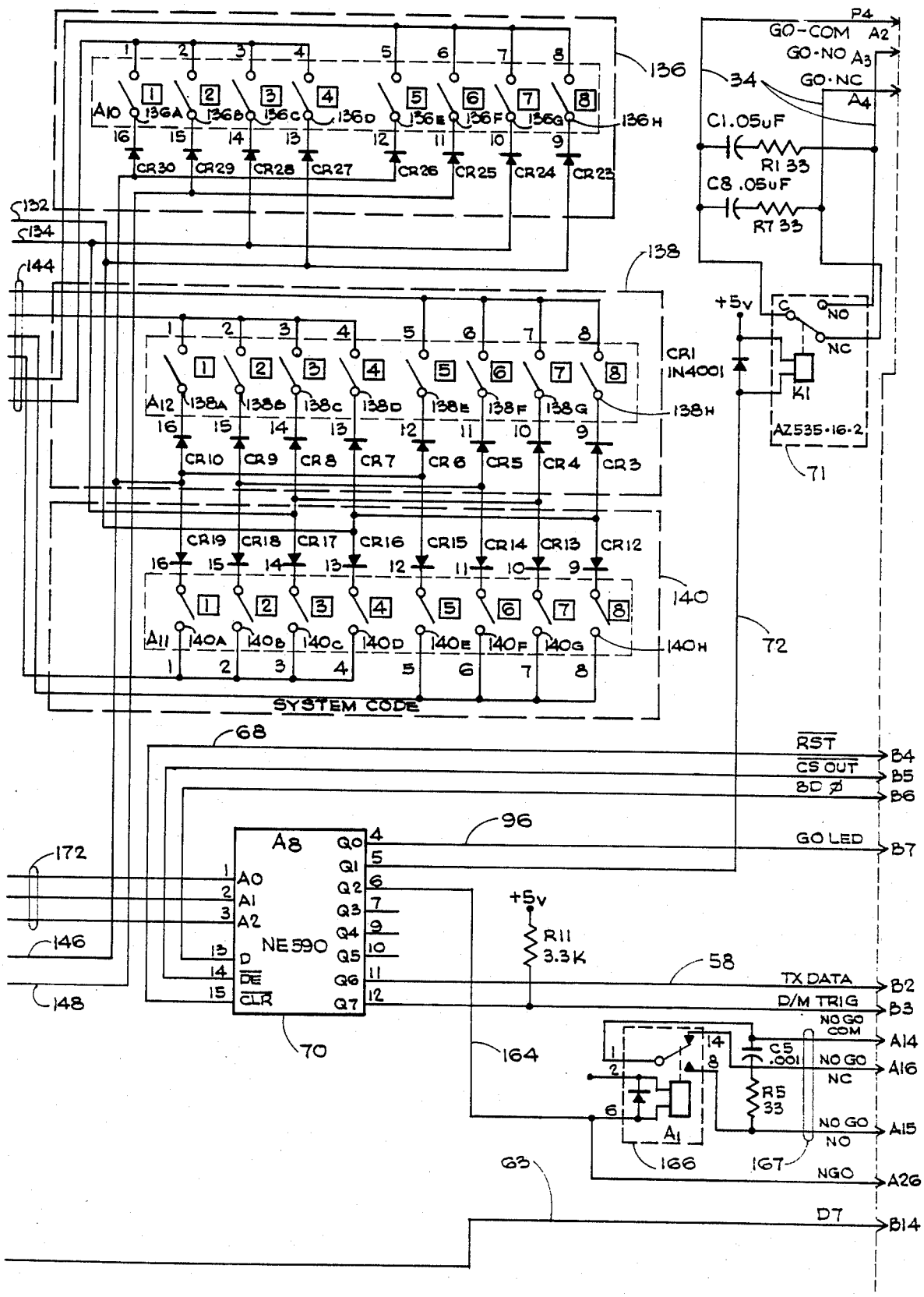

The details of the circuit of the switch and relay board 62 are given in FIGS. 4 A and B which are a logic diagram of that board. The RX data line 56 is coupled to the data input D1 of the multiplexer 60A. A resistor 59 couples a +5 volt supply to the line 56 to positively clamp it at a logic 1 level except where the transistor 114 on the isolation board clamps the line 56 to ground potential. The other data inputs of the multiplexer 60A are coupled to other data channels. For example the card reader coil circuit 74 is coupled to the DØ input of the multiplexer 60A by a line 57. The coil detect signal line 57 carries the data from each coil in the card reader coil circuit 74 as it is addressed by the microprocessor 66. The out switch 46 and the in switch 44 are coupled to the D2 and D3 inputs respectively by the lines 118 and 120.

The address inputs 122 of the multiplexer 60A are couples to the AØ-2 address lines of the bus 64. The output 63 of the multiplexer 60A is coupled to the D7 data line of the bus 64. The microprocessor 66 controls which of the data inputs are coupled to the data output 63 by the address it supplies on the address lines 122. The chip select input 126 is coupled to the address lines in the bus 64 of the microprocessor 66 through a decoder on the reader CPU board to be discussed more fully below. The microprocessor 66 can enable the multiplexer 60A by writing the proper address on the address lines driving the decoder coupled to the line 126 (not shown).

A multiplexer 60B has its data output coupled to the D7 data line 63. The data inputs of the multiplexer 60B are coupled to various data channels. The XO data input is coupled by the line 128 to a "tamper" switch (not shown). The tamper switch is physically situated so as to change states when the faceplate of the card reader is removed causing an alarm message to be transmitted to the controller 20. The X1 data input is coupled to a "card in" (not shown). The "card in" switch is situated so as to change states when a card is inserted in the card slot. By periodically checking the condition of these two switches, the microprocessor 66 can tell whether tampering is occurring or whether there is a card to be read in the card slot.

There are three groups of eight switches on the switch and relay board 62. A time offset group of switches 136 is comprised of 8 switches 136A-H which are used to set a binary number representing the number of minutes of time offset at the local card reader. In those cases where the local card reader is in a different time zone than the central controller 20, the switches 136 are set for the number of minutes by which the local time at the card reader differs from the time at the central controller.

A second group of switches 138 has several purposes. The switches 138A-D are used to set the amount of time that the unlock signal on the lines 34 to the door latch device causes the door latch to remain unlocked. The switches 138A–D also determine the time of energization of a No Go relay 166 and the time the red and green LEDs (not shown) in the block 97 in FIG. 2 are energized during certain times in the operation. The switch 138E is used to signal whether a 12 hour or 24 hour time display format is desired. The switch 138F is used to enable and disable the buffer RAM 80 as an option. The switches 138G and H are not used.

The switches 140 are used by the customer to set the system code. The system code is one of the items of data which is magnetically stored on each cardholder's card. When the card reader makes the authorization decision locally without consulting the central controller 20, it is the system code stored on the switches 140A–H which is compared to the system code on the cardholder's card to determine if authorization will be granted.

The switches 136, 138 and 140 are individually addressable by the microprocessor 66 through the multiplexers 60A and 60B and a decoder 140. The decoder 140 has address inputs 142 coupled to the address lines in the bus 64. The address supplied on the lines 142 is converted in the BCD to decimal decoder 140 to a logic zero signal on one of the output lines 0–6 which comprise a bus 144. Each of lines in the bus 144 is coupled to one terminal of a plurality of switches in the switch groups 136, 138 and 140. When the group address appears on the address lines 142, one of the outputs in the bus 144 goes low thereby activating that group. The other terminal of each switch is coupled to the cathode of a diode which has its anode coupled to one of the X0–X3 inputs of the multiplexer 60B via the lines 132, 134, 130, 128, 146 or 148. All of the X0–X3 inputs are also coupled to a +5 volt supply through the resistors 150, 152, 154 and 156. The X0–X3 inputs will be held in a logic one condition except if the line coupling that input is also coupled to a group of switches of which one has been enabled by a logic zero from the decoder 140 and the switch is closed.

The groups of switches coupled to the X0–X3 inputs of the multiplexer 60B intersect with the groups connected to the bus 144 such that for any particular output of the decoder 140 which has been enabled, and for any particular input of the multiplexer 60B which has been enabled, only one switch is coupled to both enabled lines. Thus the microprocessor 66 can individually read each switch in the groups 136, 138 and 140 by changing the address signals on the address lines of the bus 64.

The multiplexer 60B has its inhibit line grounded by the line 158 and its disable input held high by connection through a resistor 160 to a +5 volt supply. The disable input is pulled low to take the D7 output out of the high impedance state when the signal $\overline{CSSW}$ is true on the line 162. The line 162 is coupled to a decoder on the reader CPU board 67 which is coupled to address and control lines of the microprocessor 66 in the bus 64.

Data to be transmitted to the microprocesser 66 is placed on the Tx data line 58 by a driver 70. The driver 70 also has several other outputs. For example, the output line 164 can be connected to an optional No Go relay 166. When the line 164 is grounded by the driver 70, a +5 volt supply coupled to the other terminal of the coil of the No Go relay 166 causes current to flow through the relay coil, thereby energizing it and causing the electrical conditions on the lines 168 coupled to the relay contacts to change.

In the preferred embodiment, the decoder 140 is a 74145 type TTL decoder such as made by Signetics, the MUX 60A is a 74LS 251 type multiplexer such as is made by Texas Instruments, the MUX 60B is a MC14512, (CMOS type decoder such as is made by Motorola, and the driver 70 is an NE590 type amp driver such as made by Signetics.

An output line 96 from the driver 70 is coupled to the GO LED (not shown) to energize it when authorization to access has been granted. An output line 72 from the driver 70 is coupled to a terminal of the coil of a GO Relay 71. When the driver 70 grounds the line 72, a +5 volt supply coupled to the other terminal of the relay coil energizes the coil, causing the relay contacts to change the condition on the lines 34 coupled to the door locking device.

The driver 70 has a data input, the DØ data bit on the line 68, and it has address inputs on the lines 172. The address inputs 172 are coupled to the microprocessor 66 by the bus 64. The address at these inputs determines which of the outputs of the driver 70 will be coupled to the data onput 68. The microprocessor 66 can thus write a logic 0 or 1 to any of the outputs of the driver 70 by controlling the address on the lines 172 and the data on the data input line 68 which is coupled to data bit zero of the bus 64. The chip enable and clear inputs are coupled to decoder 250 of FIG. 6C and a gate 282 in FIG. 6B by the signal lines $\overline{CS}\overline{OUT}$ and $\overline{RST}$.

Figure 5A:
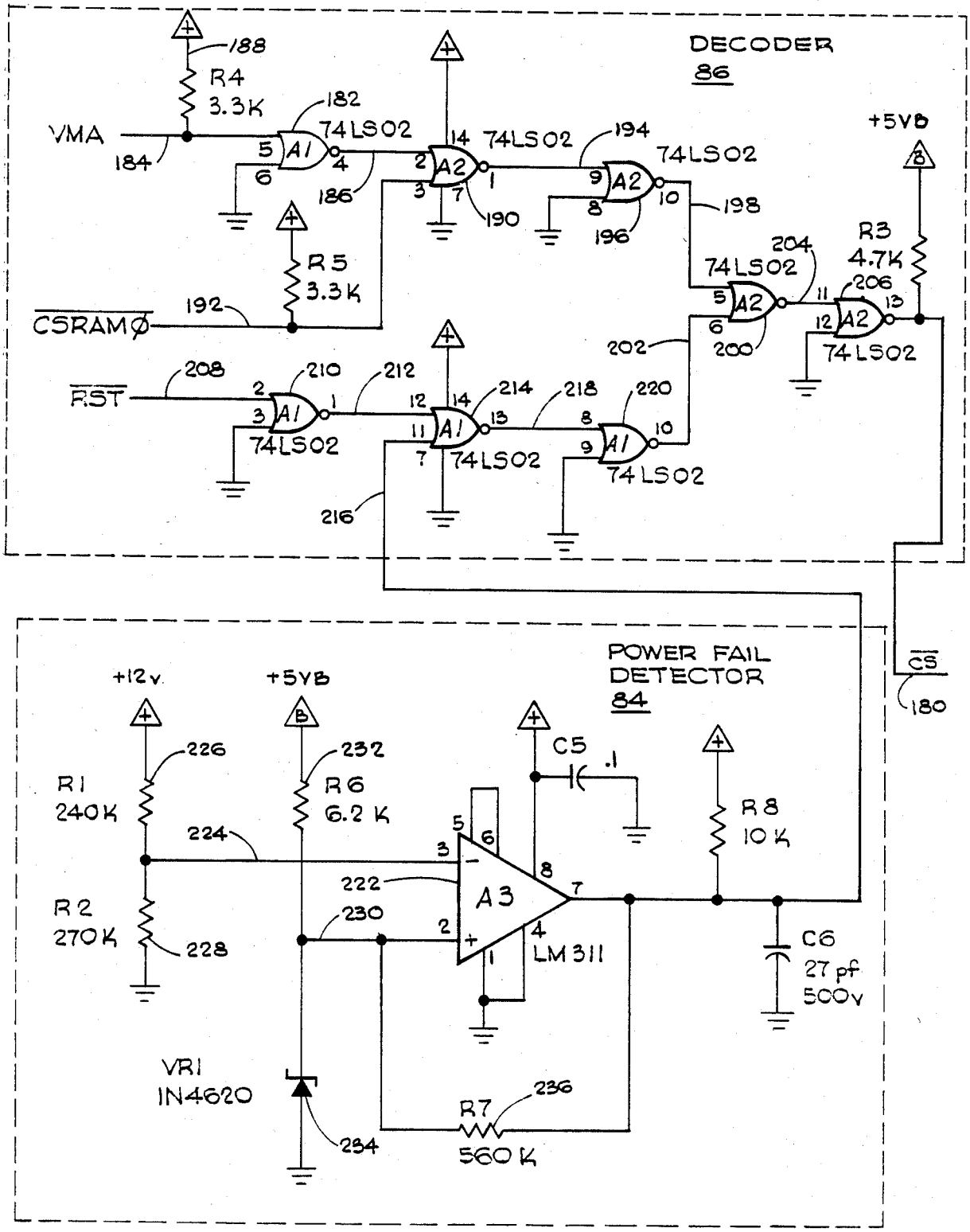
FIGS. 5 A and B are a circuit diagram of the RAM buffer board and power fail detect circuit.
Figure 5B:
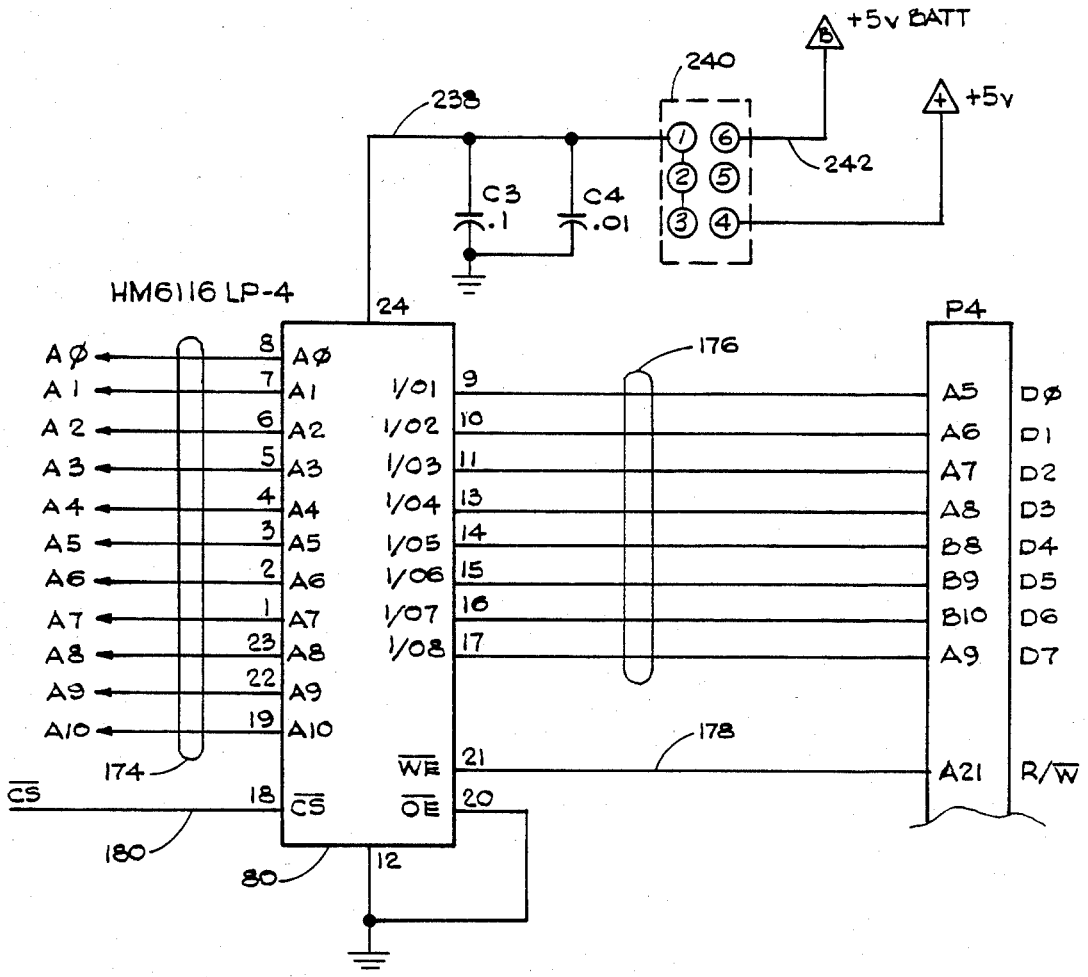

Referring to FIG. 5, there is shown a circuit diagram of the RAM buffer and power fail detect board. The RAM buffer 80 has address lines 174 which are coupled to the address lines of the microprocessor 66 in the bus 64. Data inputs and outputs 176 are also coupled to the microprocessor 66 data lines in the bus 64. A write enable line 178 is coupled to a control line in the bus 64 from the microprocessor 66 to control whether the RAM buffer 80 is reading or writing data through the data lines 176 to the address specified on the lines 174.

A chip select line 180 is coupled to a decoder 86. The decoder 86 has a VMA signal input line 184 coupling one input of a NOR gate 182 to a VMA control line of the microprocessor 66 in FIG. 6B. The VMA signal is true when there is a valid memory address on the address lines 174. Because the other input to the NOR gate 182 is grounded, the NOR gate 182 serves as an inverter with the output on the line 186 false when a valid memory address is present on the address lines 174. The resistor 188 couples a positive voltage supply to the VMA input of the gate 182 to hold it at logic one except when VMA is false. The VMA signal on the line 184 is a control signal from the CPU 66 which indicates when a valid memory address exists on the address lines of the CPU. A NOR gate 190 has one input coupled to the output of the NOR gate 182 and the other input coupled to a $\overline{CS}\overline{RAM}\overline{Ø}$ signal from a decoder 248 in FIG. 6C. The CPU 66 can cause $\overline{CS}\overline{RM}\overline{Ø}$ to be true, i.e., logic zero, and can assert VMA on the line 184. This causes two logic 0's at the inputs of the NOR gate 190 and a logic 1 appears on the line 194. This logic 1 is inverted in a NOR gate 196 and appears as a logic 0 on the line 198.

A NOR gate 200 serves to gate a power fail detect signal on a line 202 from a power fail detector 84 through to the chip select input at pin 18 of the RAM buffer 80 if power fails. When power has not failed, however, the signal on the line 198 controls whether the RAM 80 is selected or deselected. Normally, the signal from the power fail detector 84 on a line 20 is a logic 0 indicating no power failure. When the signal on the line 198 is a logic 0, the RAM 80 is selected because the signal on the line 204 is a logic 1 which is inverted by a NOR gate to assert the $\overline{CS}$ signal on the line 180 at logic zero thereby enabling the RAM buffer 80 to read and write data.

A $\overline{RST}$ signal on a line 208 comes from a reset circuit on the reader CPU board which will be described below. The $\overline{RST}$ signal is a logic 0 at power up but becomes logic 1 1.2 seconds later as will be explained in connection with FIG. 6B. A NOR gate 210 inverts this signal such that its output line 212 which is coupled to one input of a NOR gate 214 is normally low after power has been on for 1.2 seconds.

The NOR gate 214 has its other input coupled to the output of a comparator 222 in the power fail detect circuit 84. The comparator 222 has its inverting input 224 coupled to a voltage reference of approximately 5.3 volts when the power has not failed. The line 224 is held at this reference level by the voltage divider effect of the resistors 228 and 226 which couple a +12 volt D.C. supply of line power to ground.

The non-inverting input 230 of the comparator 222 is coupled to a 3.6 volt reference source derived from battery power. This reference voltage is generated by a resistor 232 which couples a battery 82 (not shown) to ground through a zener diode 234. The zener has a 3.6 volt breakdown voltage, and has its cathode coupled to the line 230. The comparator 222 has a resistor 236 coupled between the output and its non-inverting input to provide positive feedback. The output on the line 216 will be a logic 0 as long as the power has not failed. When the power fails, the battery reference on the line 230 exceeds the voltage on the line 224, and the output of the line 216 rises to a logic 1 level indicating power has failed.

The logic 1 on the line 216 with the logic zero on the line 212 causes the NOR gate 214 to lower its output on the line 218 to a logic zero. This 0 on the line 218 is inverted to a 1 on the line 202 by the NOR gate 220 which causes the output of the gate 200 to change to a 0, thereby deselecting the buffer 80 if it was in a selected condition. When the RAM buffer 80 is deselected, no data may be written into or read out of the buffer. The power input 238 of the RAM buffer 80 will be coupled through any known switching mechanism 240 to the battery 82 (not shown) via a line 242 upon power failure.

Figure 6A:
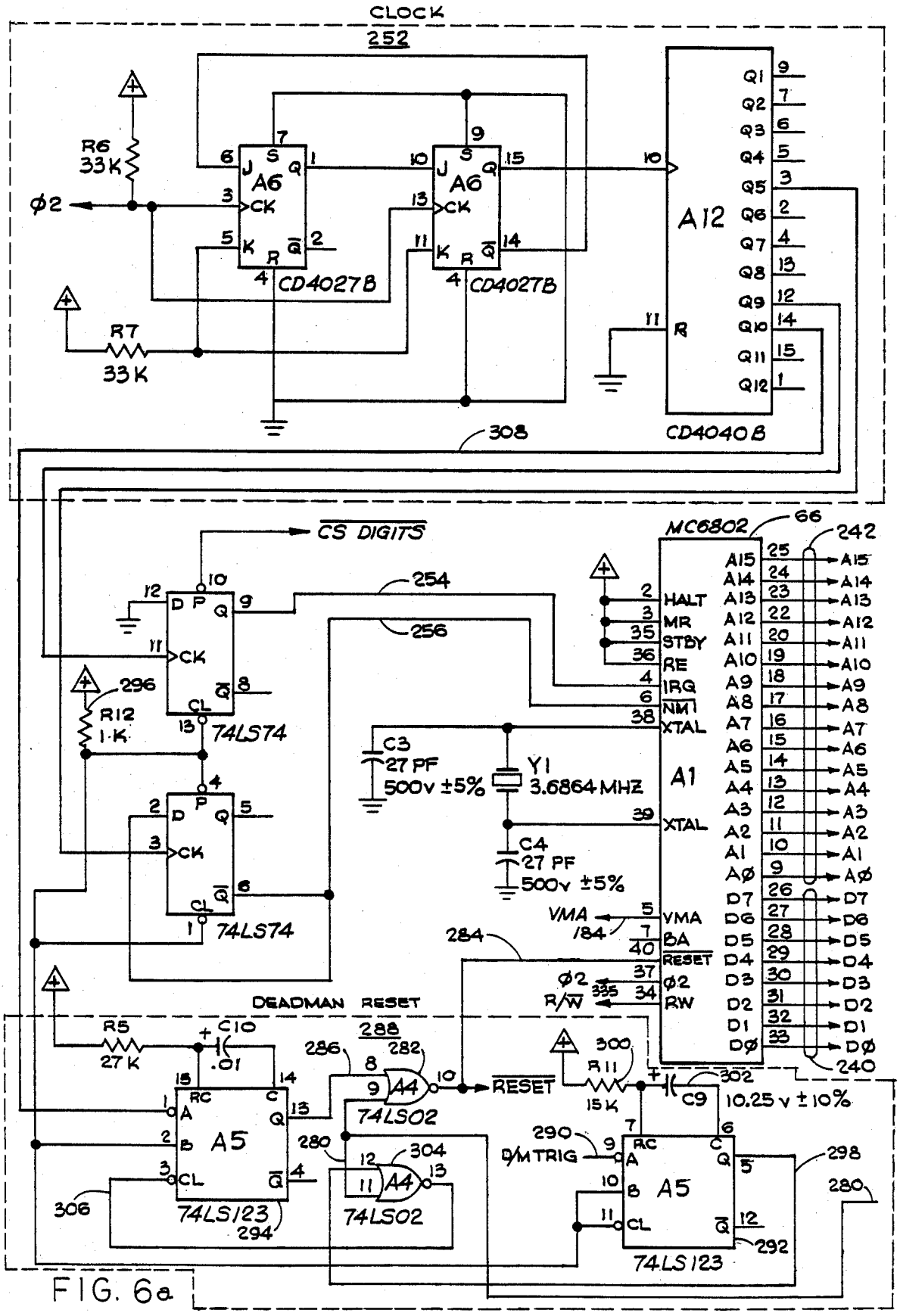
FIGS. 6A, 6B and 6C are circuit diagrams of the CPU reader board.
Figure 6B:
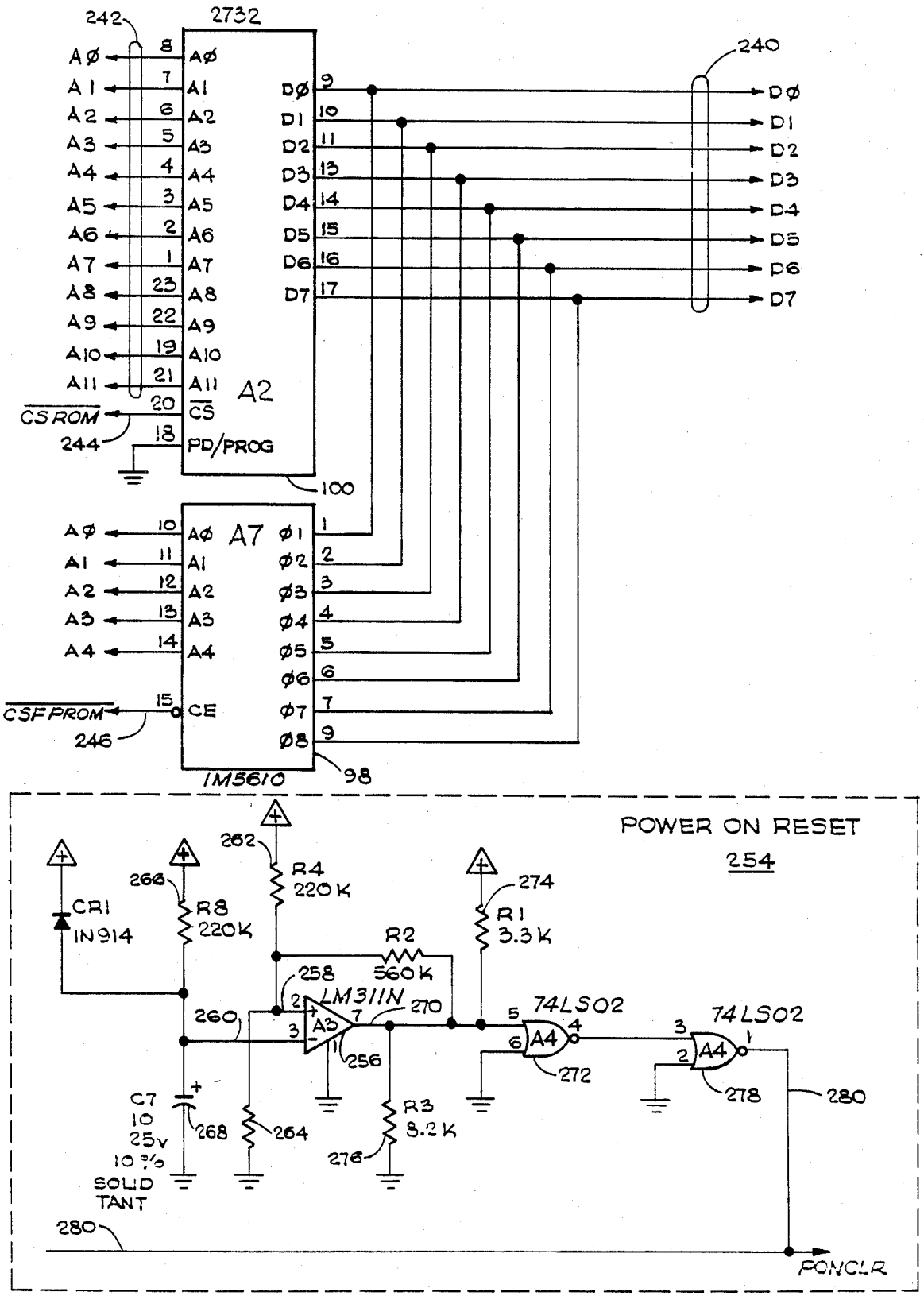
Figure 6C:
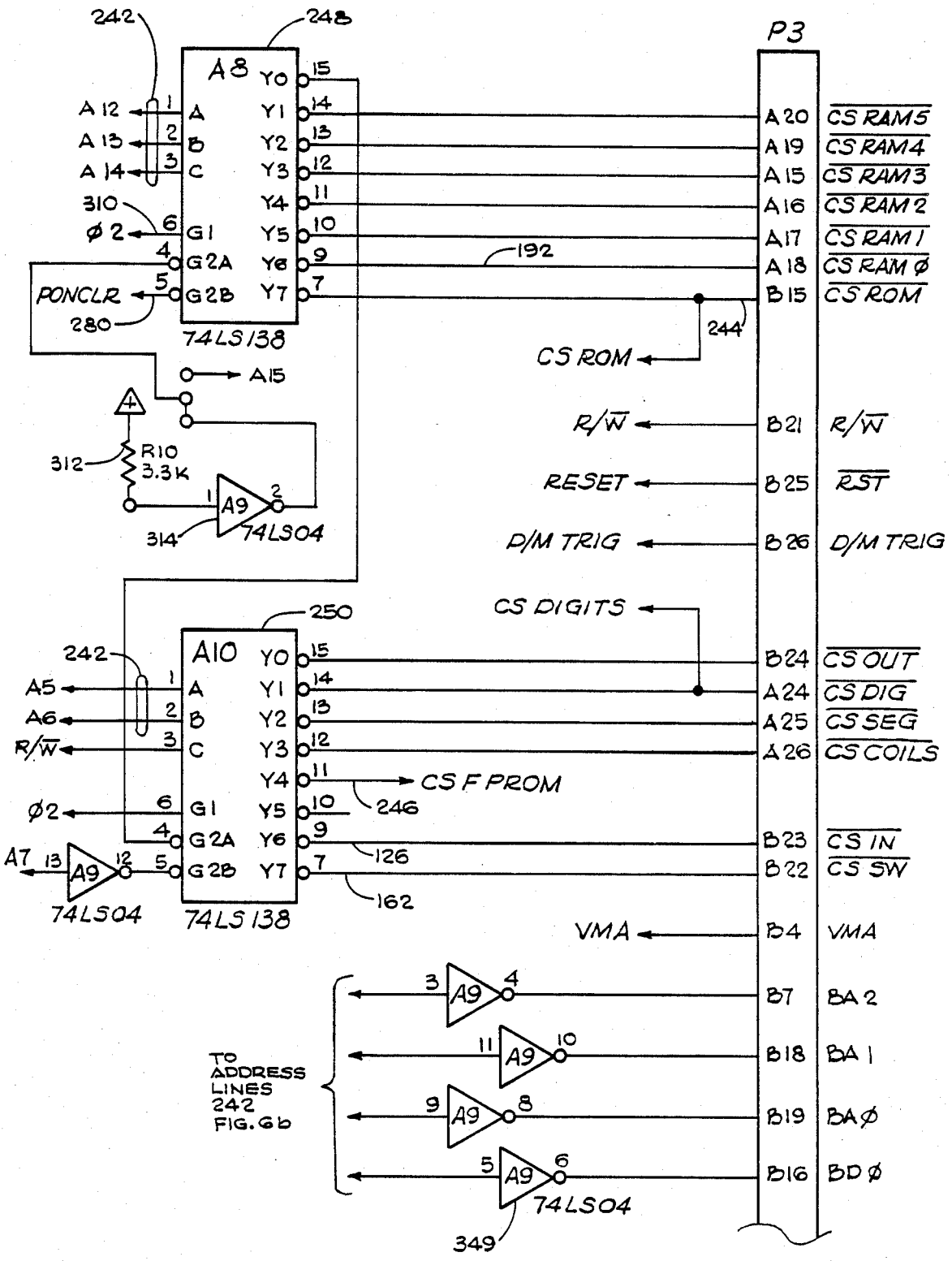

Referring to FIGS. 6A, 6B, and 6C, there is shown a circuit diagram of the reader CPU board. The microprocessor 66 is coupled to a feature memory 98 by data lines 240 and address lines 242. The feature memory contains data regarding which options are incorporated into the card reader. The microprocessor 66 is also coupled to a program memory 100 by the data lines 240 and the AØ–A4 address lines 242. The enable inputs of the memories 100 and 98 are coupled via the lines 244 and 246 to the microprocessor's address lines 242 through decoders 248 and 250, respectively, in FIG. 6C. A clock 252 generates timing signals for the IRQ and NMI inputs on the lines 254 and 256, respectively. The details of the construction and operation of the clock and of the feature and program memories will be appreciated by those skilled in the art. Any mechanism which generates signals periodically on the lines 254 and 256t will suffice for purposes of the invention.

The microprocessor 66 executes the instructions which are stored in the program memory 100. Within the program, which will be described below, there are certain subroutines which accomplish various housekeeping routines. The IRQ and NMI inputs on the lines 254 and 256 cause vectoring to certain of these subroutines. For example, the IRQ line 254, when asserted true, will cause the program control of the microprocessor 66 to be vectored to a routine which reads all the switches described herein.

When the NMI line 256 is asserted true, the microprocessor 66 is vectored to a transmit routine which transmits data to the central controller 20 via the Tx data lines 58 and data lines 28.

The microprocessor 66 must be reset to the beginning of the program upon the initial application of power to the circuit. A power on reset circuit 254 accomplishes this purpose. A comparator 256 has its non-inverting input 258 coupled to a reference voltage defined by a resistive voltage divider comprised of the resistors 262 and 264 coupling the power supply to ground. The inverting input 260 is coupled to one terminal of a capacitor in an RC circuit comprised of a resistor 266 and a capacitor 268. When the power is first turned on, the capacitor 268 acts as an initial short to ground and the voltage on the line 258 will exceed the voltage on the line 260, and the output of the comparator 256 on the line 270 will be a logic 1. The line 270 is coupled to the input of a NOR gate 272 which acts as an inverter. The resistors 274 and 276 serve a a voltage divider to hold the line 270 in a logic 1 condition except when the comparator 256 asserts the line 270 low.

The logic 1 at power up on the line 270 is inverted once in the NOR gate 272 and again in a NOR gate 278 to become the PONCLR signal on the line 280.

As the voltage on the capacitor 268 rises, it exceeds the voltage on the line 258 at a time determined by the values of the resistor 266 and the capacitor 268. When this happens, the 1 on the output line 270 changes to a 0 and line 280 follows suit. The initial 1 on the line 280 is communicated to the reset line 284 of the CPU 66 as a 0 by passage through a NOR gate 282. The other input to the NOR gate 282 is a line 286 from a deadman reset circuit 288. The line 286 is normally a logic 0 except when there is a problem, as will be described below. With the line 286 normally logic 0, the initial logic 1 on the line 280 is inverted by the NOR gate 282 and resets the microprocessor 66 to the beginning address of the program. Thereafter, the line 280 does to a logic 0 and stays there.

The deadman reset circuit 288 serves to reset the microprocessor 66 in case there is a software problem. Normally, the deadman reset circuit 288 will attempt to reset the microprocessor 66 periodically unless the software gives a trigger signal "D/M trigger" on the line 290. Thus if for some reason the signal D/M trigger does not occur, program control is lost, and the deadman reset circuit will cause the program counter to be reset to the beginning program location.

The manner in which the deadman reset function is accomplished is through the use of two retriggerable monostable multi-vibrators 292 and 294. The one shot 292 has its B and clear ($R_{D2}$) inputs coupled to a +5 volt source through a resistor 296 and are therefore always in a logic 1 state. The 0 output on the line 298 is normally low until a negative transition occurs on the D/M trigger line 290, at which time the 0 output line 298 goes to a logic 1 state for a time determined by the values of the resistor 300 and the capacitor 302 coupled to the external RC circuit terminals. However, the pulse time established by the resistors 300 and 302 is longer than the period of the D/M trigger signal. Thus, the output line 298 will not return to zero after the initial trigger pulse because the D/M trigger signal on the line 90 continues to retrigger the one shot 292.

The signals on the lines 298 and 280 are coupled to the inputs of a NOR gate 304. The output line 306 of the NOR gate 304 is coupled to the clear input of the one shot 294. The B input of the one shot 294 is held in a logic 1 condition by connection to a +5 volt supply through the resistor 296. The A input of the one shot 294 is coupled by a line 308 to the clock 252 and carries a 600 hertz clock signal.

After the initial power up period, the NOR gate 304 will have a logic 0 at the input coupled to the line 280 and a logic 1 at the line 298 input unless the D/M trigger signal on the line 290 does not occur. The output line 306 will remain in a logic 0 state at all times which causes the one shot 294 to ignore all signals at the $\overline{A}$ and B inputs. However, if the D/M trigger signal on the line 290 fails to occur on schedule, indicating some problem with the program execution, the one shot 292 will time out and enable the one shot 294. The clock signal on the line 308 will then trigger the one shot 294 causing a logic 0 to 1 transition on the line 286. This causes the line 284 to drop from logic 1 to 0 and resets the microprocessor 66.

Referring to FIG. 6C, there is shown a logic diagram of the decoder circuitry which forms part of the decoder 86 in FIG. 2. The decoder chip 248 has its select inputs coupled to the AI2–AI4 lines of the address bus 242 of the microprocessor 66. The G1 enable input 310 is coupled to the Ø2 output from the microprocessor 66 which is the clock signal for the rest of the system. The G2A enable input low by virtue of being coupled to a logic 1 through a resistor 312 and an inverter 314. The G2B input is coupled to the power on clear signal PONCLR on the line 280.

The decoder 250 has its A and B select inputs coupled to the address bus 242 and its C select input coupled to the R/$\overline{W}$ signal from the microprocessor 66. The G1 enable input is coupled to the $\phi 2$ clock signal from the microprocessor 66, and the G2A enable signal is connected to the YØ output from the decoder 248. The G2B enable input is coupled to the A7 line of the address bus 242 from the microprocessor 66.

Both the decoders 248 and 250 are 74L5138 one of eight decoders such as are manufactured by Texas Instruments. The outputs of the two decoders 248 and 250 are coupled to the various chip select inputs in the system as labelled in FIG. 6C. By writing the proper addresses on the address lines 242, the microprocessor 66 can enable any chip in the system needed for a particular operation.

Figure 7:
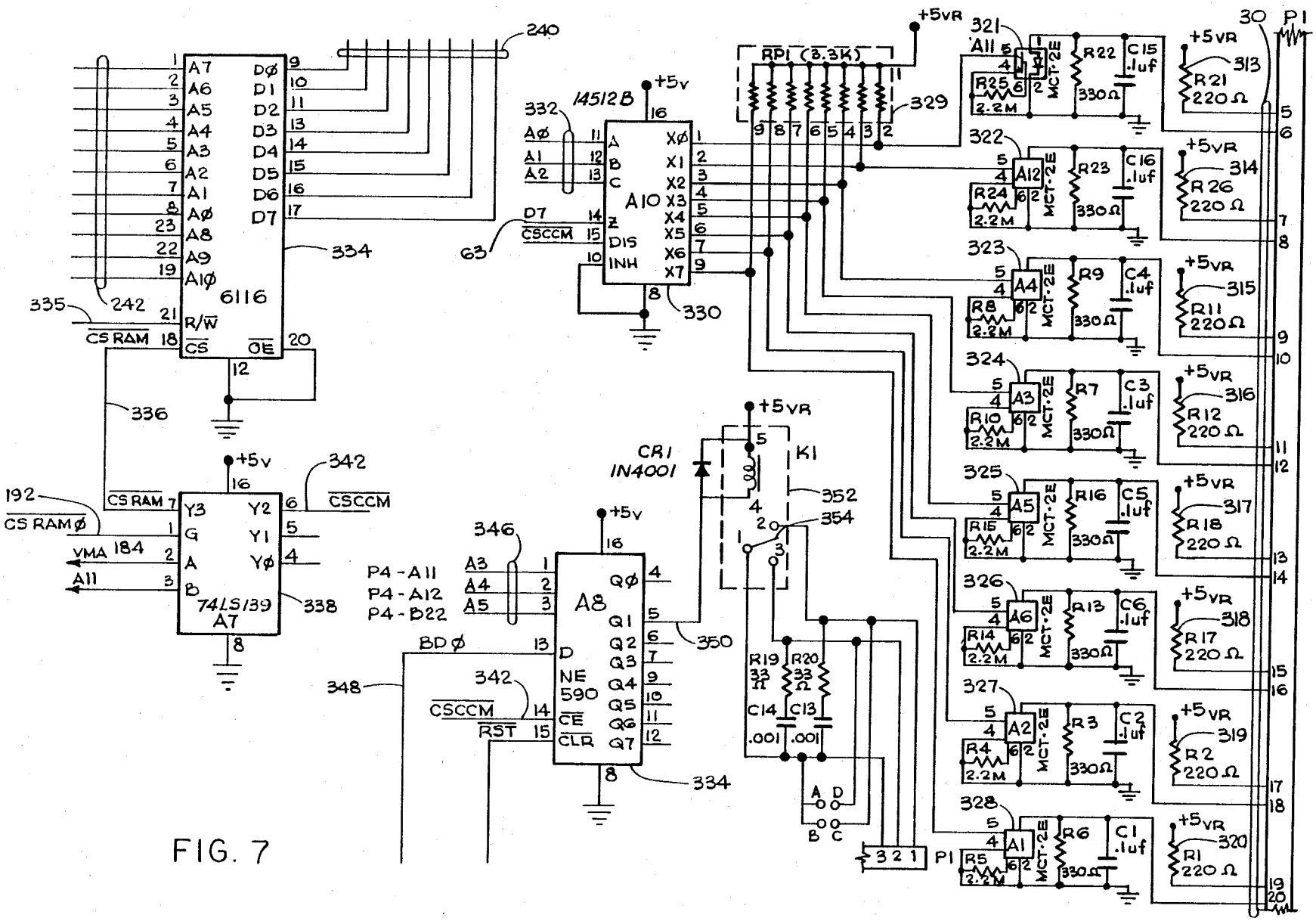
FIG. 7 is a logic diagram of the CCM/COM logic.

Turning to FIG. 7 there is shown a logic diagram of the CCM/COM board 90 in FIG. 2. A plurality of alarm contacts are connected to the board by a plurality of wire pairs together comprising the bus 30. Each pair in the bus 30 is energized by connection of one of the lines through one of the resistors 313–320 to a 5-volt power supply. The other line from the pair is coupled through a parallel RC noise suppression circuit to the anode of the diode in one of the optical isolators 321–328. The diodes are energized as long as the external contacts coupled to the wire pairs are closed.

The transistors in the optical isolators have their collectors coupled to a +5-volt regulated power supply through one of the resistors in the resistor block 329. The collectors are also coupled to the data channels of a multiplexer 330 which is typically a 14512B type multiplexer such as is made by Motorola. The data input of the multiplexer is coupled to the D7 data line 63 of the microprocessor 66. The select inputs 332 are coupled to the A0–A2 address lines of the microprocessor 66 such that the microprocessor can individually read each external contact condition through the D7 data line 63.

The microprocessor 66 is programmed to periodically check the condition of each of the external contacts coupled to the bus 30. After the contact is read, the microprocessor 66 operates on a flag to indicate the status of the alarm contact corresponding to that flag. The flags are address positions in a RAM memory 334 which can be a 6116 type CMOS static RAM such as is made by Hitachi. The address inputs of the RAM 334 are coupled to the address lines 242 of the microprocessor 66, and the data I/O ports of the RAM 334 are coupled to the data lines 240 of the microprocessor 66. The R/$\overline{W}$ input line 335 of the RAM 334 is coupled to the R/$\overline{W}$ control signal from the microprocessor 66 to control the direction of the data flow on the data lines 240.

The chip select input line 336 of the RAM 334 is coupled to the Y3 output of a decoder 338 which has its A and B select inputs coupled to the VMA control signal line 184 and A11 address line respectively of the microprocessor 66. The enable input signal $\overline{CS}\overline{RAM}\overline{O}$ on the line 192 for the decoder 338 is coupled to a chip select output from the decoder 248 in FIG. 6C such that the microprocessor 66 can enable the RAM 334 by enabling the decoder 338 and writing the proper bit on the A11 line of the address bus.

Only two outputs from the decoder 338 are used so only one address bit is needed to specify which output is active. The other output on the line 342 is coupled to the chip select input 342 of a relay driver 344. This driver 344 has three address inputs 346 which are coupled to the address lines of the microprocessor 66. The relay driver also has a data line 348 coupled to the buffered DØ data line of the microprocessor 66 through a 74L504 buffer 349 on FIG. 6C. The relay driver 344 has an output 350 which is coupled to the coil of a COM relay 352. When the microprocessor 66 selects the relay driver 344, and writes the proper address on the lines 346, the line 348 will control the state of the line 350, thereby controlling the state of the relay contacts 354.

Figure 8A:
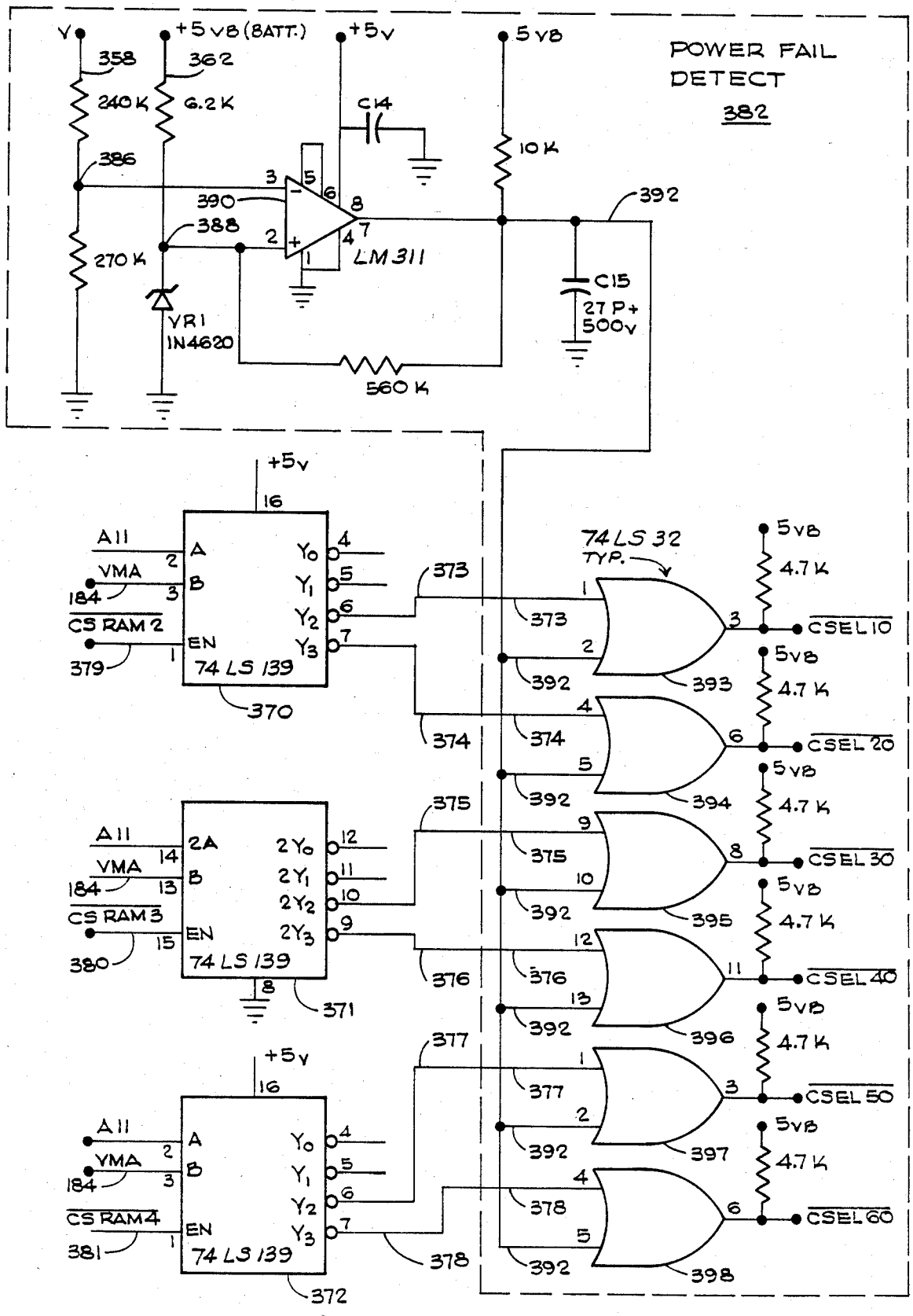
FIGS. 8A and 8B are a logic diagram of the circuitry of the delayed transmission buffer.
Figures 1, 8B:
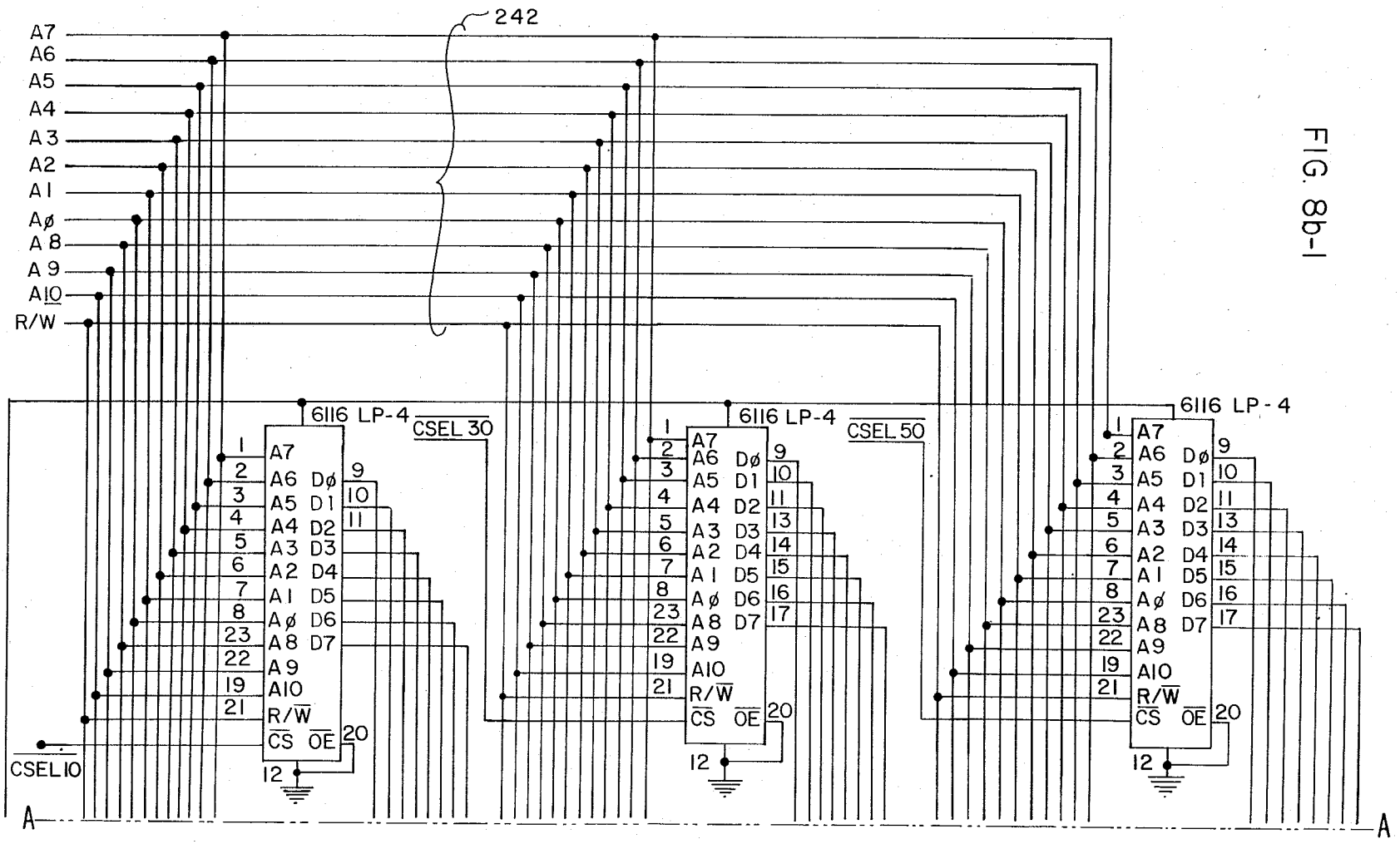
Figures 2, 8B:
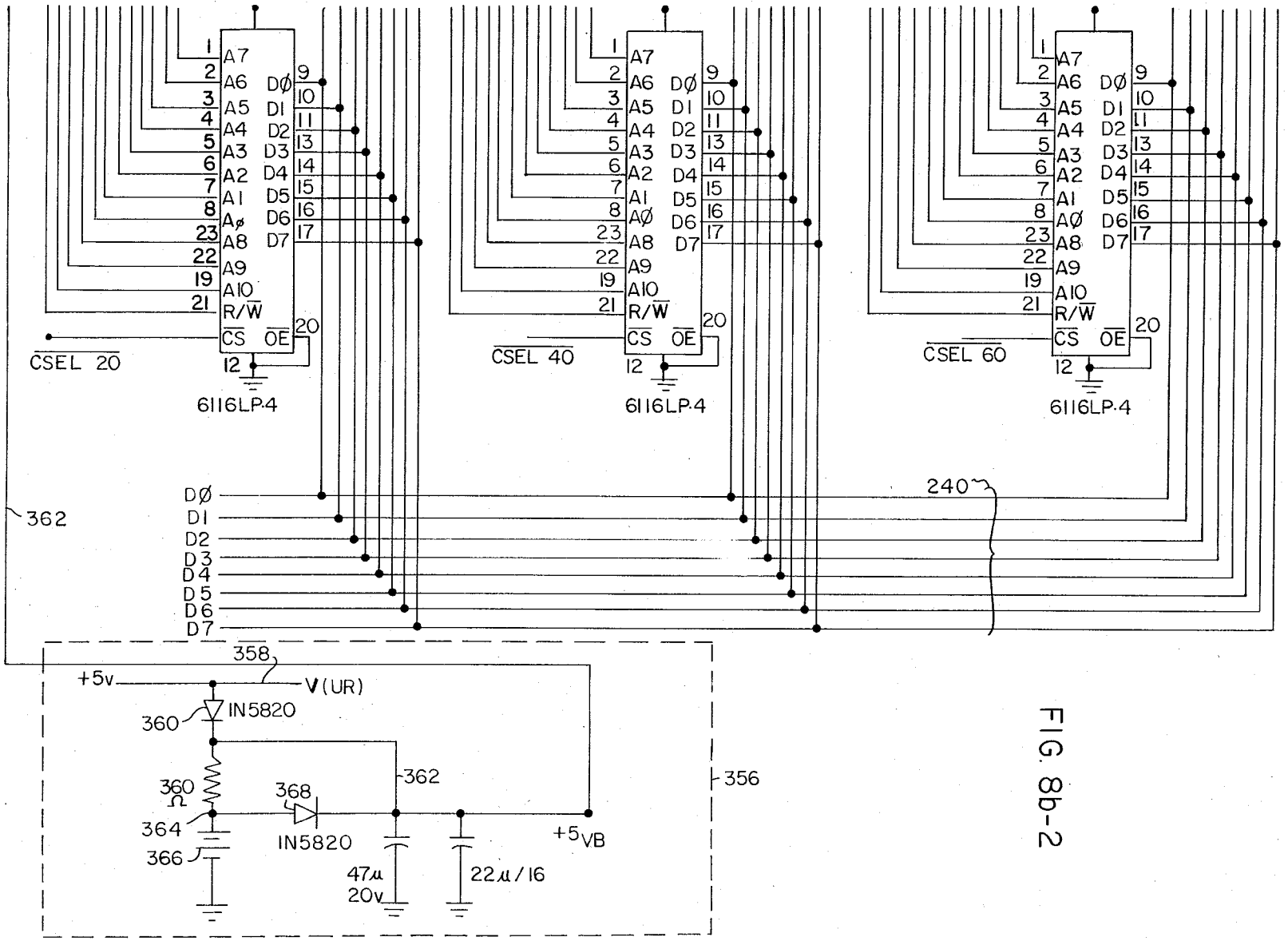

Turning to FIGS. 8A and 8B there is shown a logic diagram of the circuitry of the delayed transmission buffer 88 of FIG. 2. A battery backup circuit 356 in FIG. 8B serves to protect the information in the RAM chips shown in FIG. 8B. Each of the RAM chips is a 6116LP-4 CMOS static RAM such as is manufactured by Hitachi. The +5-volt line supply voltage on the line 358 normally causes a forward bias on the diode 360 and the +5 volt signal is thus coupled to the output line 362. However, when the power fails, the positive voltage on the line 364 from the battery 366 exceeds the voltage on the line 358 which causes a reverse bias on the diode 360. The diode 368, however, will be forward biased such that the battery power will be coupled to the line 362 to keep the information in the RAM intact.

A series of decoders 370–372 are coupled to the A11 line of the address bus 242. These decoders are 74L5139 one of four decoders in the preferred emboiment. The decoders have outputs 373–378 which are coupled to the chip select inputs of the 6 RAM chips of FIG. 8B through a power fail detect circuit 382. Each decoder has its B enable input coupled to the VMA output 184 from the microprocessor 66 to enable the decoder to read the A11 bit when the decoder has been enabled. The decoders 370–372 are enabled by enable signals on the lines 379–381 coupled to the decoder 248 in FIG. 6C. A power fail circuit 382 senses when the line power represented by the voltage on the line 358 has failed by comparing the voltage at node 386 maintained by the line to the voltage at a node 388 maintained by the battery 366. A comparator 390 changes the state of its output 392 when the battery voltage at the node 388 exceeds the line voltage at the node 386. The comparator is a National LM311 in the preferred embodiment.

The chip select signals on the lines 373–378 are individually coupled through 74L532 OR gates 393–398 to the chip select inputs of the RAM chips in FIG. 8B. Each chip select input is also coupled through the OR gates 393–398 to the output 392 from the comparator 390 such that when the comparator finds a failure of line power, all the RAM chips in FIG. 8B will be deselected so as to maintain the integrity of the data.

The connections and functioning of the RAM chips of FIG. 8B will be apparent to those skilled in the art. Data from the microprocessor 66 is input and output on the lines 240 to and from the addresses on the lines 242.

Figure 9:
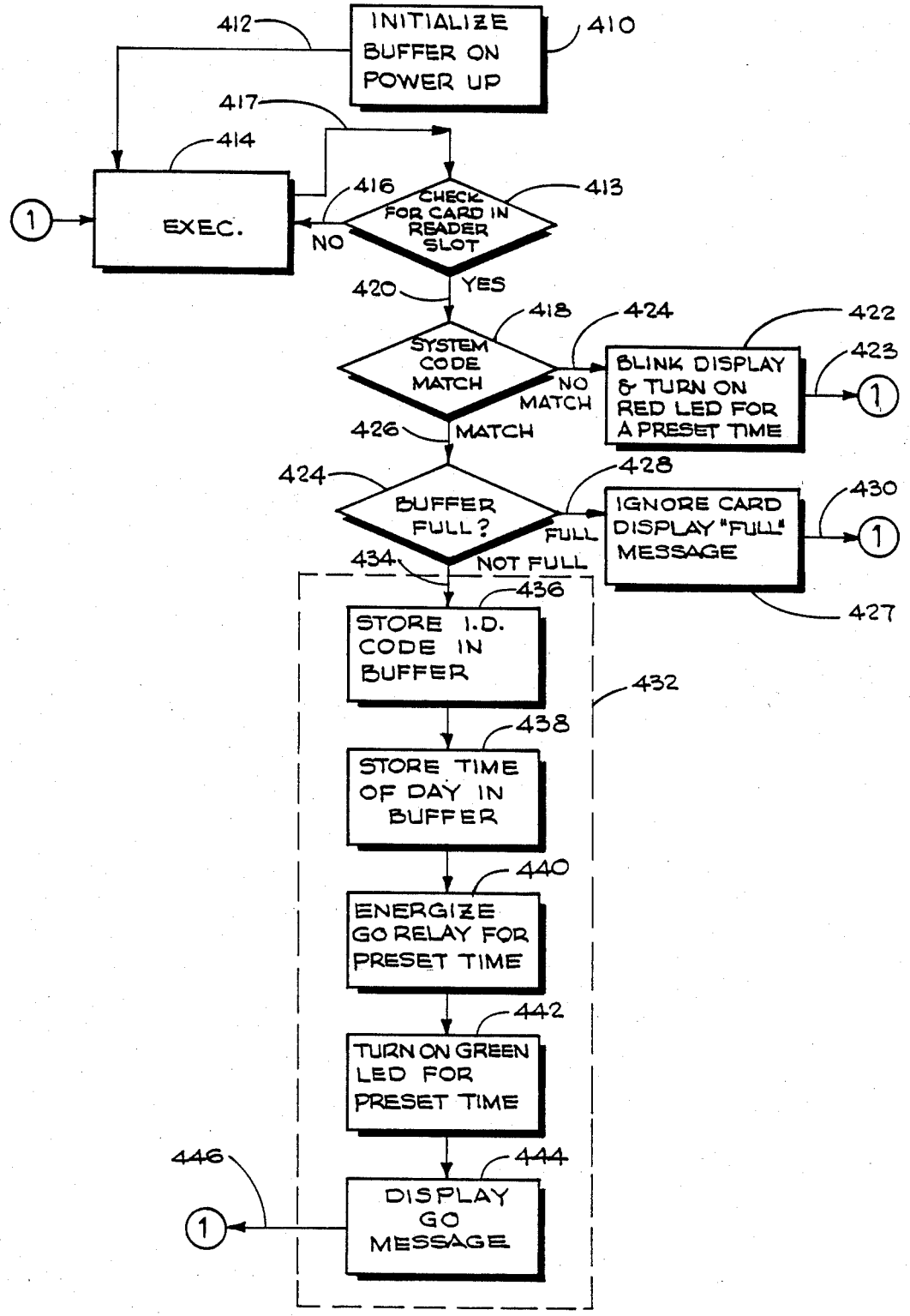
FIG. 9 is a flow diagram of the sequence of steps performed by the card reader in performing a time and attendance function.

Turning now to FIG. 9 there is shown a flow diagram of the steps taken by the card reader in performing a time and attendance function. In this function, the card reader reads cards and locally authorizes entry or departure based upon the system code on the card without consulting the central controller and stores the data for each transaction with the local time for later reporting to the central controller.

In an initiatization step 410, the microprocessor CPU 66 clears the RAM 80 on powerup. Thereafter, the CPU 66 transfers on the path 412 to the executive routine 414 where several housekeeping functions are performed. One of these functions is to check for the presence of a card in the card slot. This function is represented by the transfer on the path 417 to the state 413 where the card switch is checked via the line 130 and the MUX 60B in FIG. 4 to determine if there is a card in the card slot. If no card is in the slot, the CPU returns to the executive routine 414 by the path 416. In the executive routine, certain basic tasks are performed. For example, the CPU checks whether a command from the central controller 20 has been received, whether a poll from the central controller needs to be acknowledged or whether there is a request for time from the local controller. Periodically, the CPU returns to the state 413.

If a card was found in the card slot, the CPU transfers to a decision state 418 along the path 420 to determine if the system code on the card in the slot matches the system code set on the switches 140 in FIG. 4. To do this, the CPU 66 individually addresses the reading coils in the card reader 74 in FIG. 2 via the bus 64. The data from each coil is transferred to the CPU 66 via the coil detect line 57, MUX 60A, D7 line 63 and the bus 64 in FIG. 2.

If there is no match, the CPU 66 transfers to a no authorization state 422 via the path 424. In this state, the CPU causes the display 40 in FIG. 2 for a preset time to blink in a manner known to those skilled in the art and turns on the red LED in the LED block 97 in FIG. 2 for a preset time via the line 96, the driver 70, the DØ line 68 and the bus 64. The CPU 66 then returns the executive state 414 via the path 423.

If the system code matches, the CPU 66 transfers to a buffer full decision state 424 via a path 426 to determine if there is room in the RAM buffer 80 in FIG. 2 to store the present transaction. If the buffer is full, the CPU transfers to a state 427 via a path 428 to ignore the card and display a message on the display 40 in FIG. 2 indicating that the buffer is full. The CPU then transfers back to the executive state 414 by the path 430.

If the buffer is not full, the CPU transfers to an authorization state 432 by a path 434. In the authorization state the CPU performs 5 tasks. First the ID code from the magnetic card is stored in the buffer 80 along with the time of day in states 436 and 438. Then the Go relay 71 in FIG. 2 is energized for a preset time via the bus 64, the DØ data bit line 68, the address line A0–2 and the driver 70. The Go relay is energized for the time set by the switches 138 in FIG. 4 so they must be read via the multiplexer 60B and the D7 data bit line 63.

Finally, the green LED in the LED block 97 in FIG. 2 is turned on for a preset time via the line 96 and the CPU displays a "Go" message in the display 40 as represented by the states 442 and 444. The CPU 66 then returns to the executive state 414 via the path 446.

Figure 10:
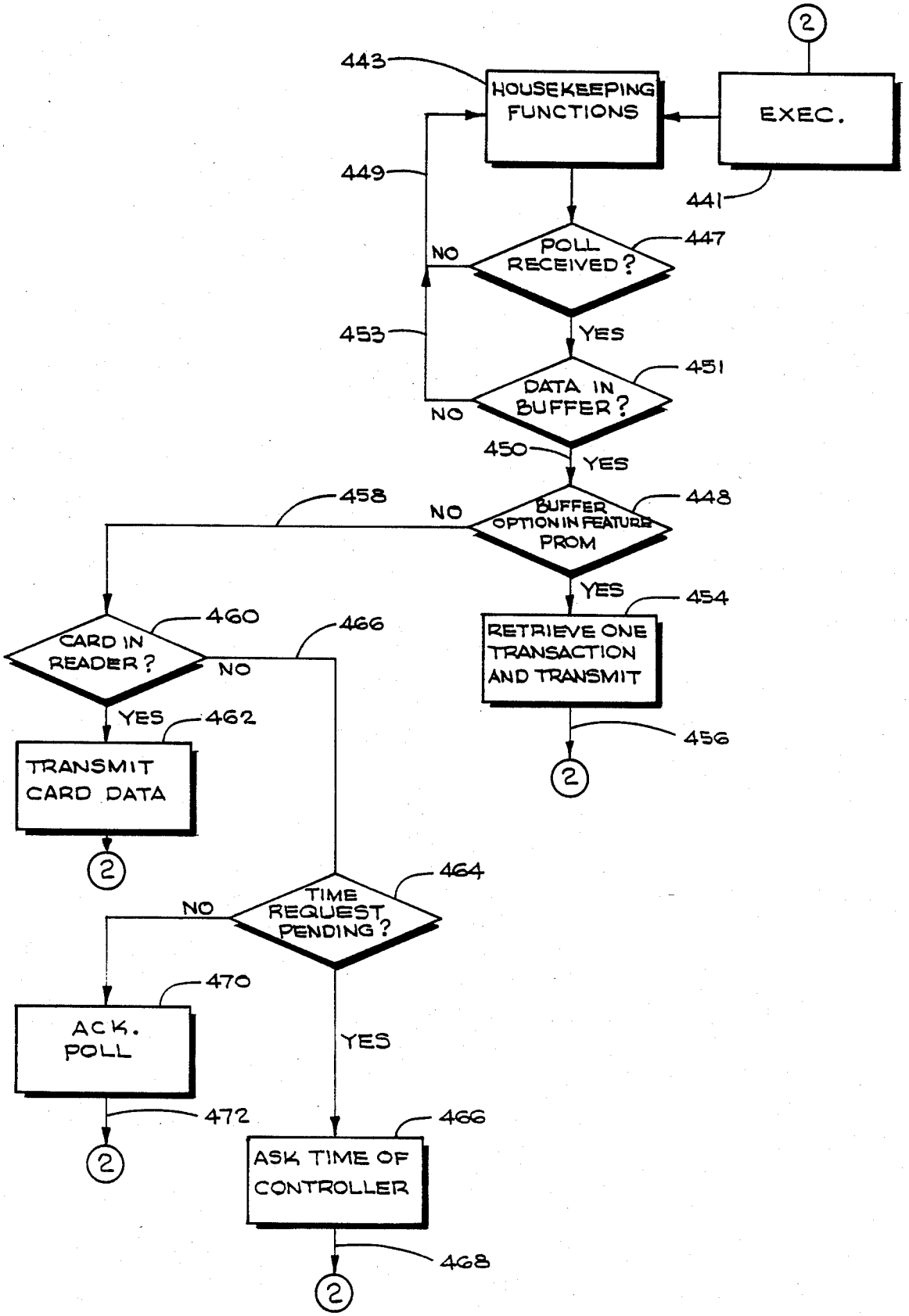
FIG. 10 is a flow diagram of the steps which are taken to unload the time and attendance data from the buffer and transmit it to the central controller 20.

Turning to FIG. 10 there is shown a flow diagram of the steps which are taken to transmit the data in the buffer 80 to the central controller 20. The steps of FIG. 10 are taken each time a poll signal comes in from the controller 20. The CPU normally operates in an executive mode symbolized by the state 441 in FIG. 10. The executive jumps to various subroutines which perform housekeeping and command scan functions as mentioned earlier. These subroutines are symbolized by the state 443. One of the functions is to periodically check for the presence of a poll signal from the controller 20 in FIG. 1. The poll signal is sent periodically to each card reader in the system via the enable pair 26 coupled that card reader. The check for the presence of a roll signal is symbolized by the state 447 in FIG. 10. If no poll has been received, the CPU returns to its other housekeeping functions in the state 443 via the path 449.

If a poll has been received, the CPU will check an internal counter which is incremented each time a transaction is stored in the buffer 80. This operation is symbolized by the block 451 in FIG. 10. If the count is non-zero, then, the CPU knows that there is data in the buffer 80 which needs to be transmitted to the central controller 20. Transfer is then made to a state 448 by a path 450. If the count is zero, the CPU returns to its other functions because there is no data to transmit. This transfer is symbolized by the path 453.

In the state 448, the CPU determines if the buffer option data is present in the feature memory 98 in FIG. 2. If the feature is present, the CPU will retrieve the data for one transaction from the buffer 80 and transmit it to the central controller 20. This operation is symbolized by the state 454 in FIG. 10 and is accomplished by addressing one of the transactions in the buffer 80 and reading the data there by the bus 64. The data is then converted to serial format in the CPU 66 and sent via the DØ data bit line 68 to the driver 70 in FIG. 2. The driver then places the data on the Tx data lines 58 and it is sent through the optical isolator board 54 onto the data line 28 to the central controller 20. The CPU then returns to the executive routine via the path 456.

If the buffer option is not present, the CPU 66 will transfer to a state 460 by a path 458 where it checks for the presence of a card in the card slot. If there is a card in the card reader, the card data will be read by the CPU 66, converted to serial format and transmitted to the central controller 20. This step is symbolized by the block 462. Control is then returned to the executive.

If there is no card in the reader, the CPU will transfer to the state 464 via the path 466 to determine if there is a time request pending. The card readers which have the time and attendance function keep the local time but periodically request the time from the central controller so as to synchronize the local time with the central controller time. If there is a time request pending, the card reader will ask the time of the central controller 20 as symbolized by the state 466 and return to the executive via the path 468.

If no time request is pending, the CPU will acknowledge the poll as symbolized by the state 470 and return to the executive routine by the path 472.

Figure 11:
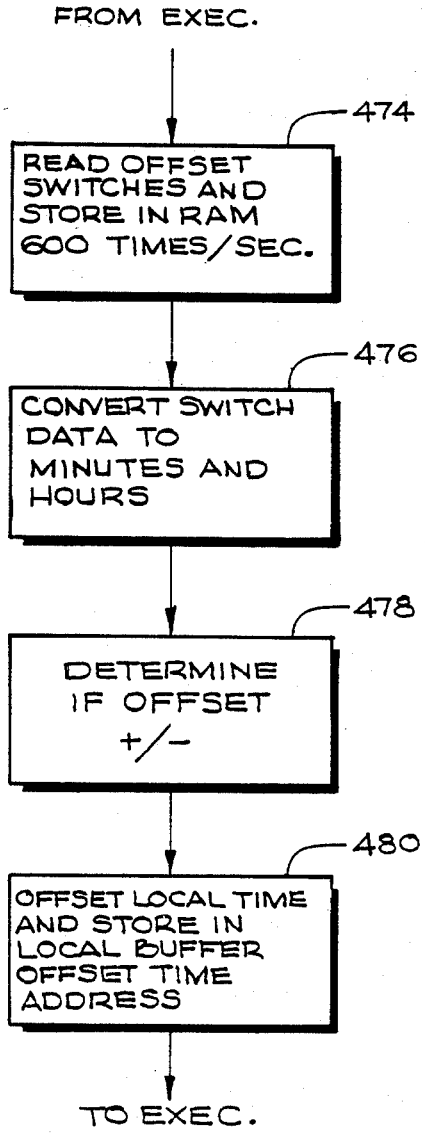
FIG. 11 is a flow diagram of the time offset routine performed by the card reader.

Turning to FIG. 11, there is shown a flow diagram of the time offset routine performed by the CPU 66 to keep track of the local time from the central controller time when the central controller is in a different time zone from that of the reader.

The first step in the process is to read the offset switches 136 in FIG. 4 through the MUX 60B. The value of those switches is stored in RAM at a specific address. This is done 600 times per second in the state 474.

Next, the CPU 66 converts the data in the RAM switch data address to minutes and hours of offset. The data from the 8th switch determined whether the offset is positive or negative while the first 7 switches provide a binary number representing up to 127 minutes of offset. Any number of switches could be used, however. This is symbolized by the states 476 and 478.

Finally, the local time is offset in a state 480 and stored in a local buffer offset time address. Control is then returned to the executive routine.

Figure 12:
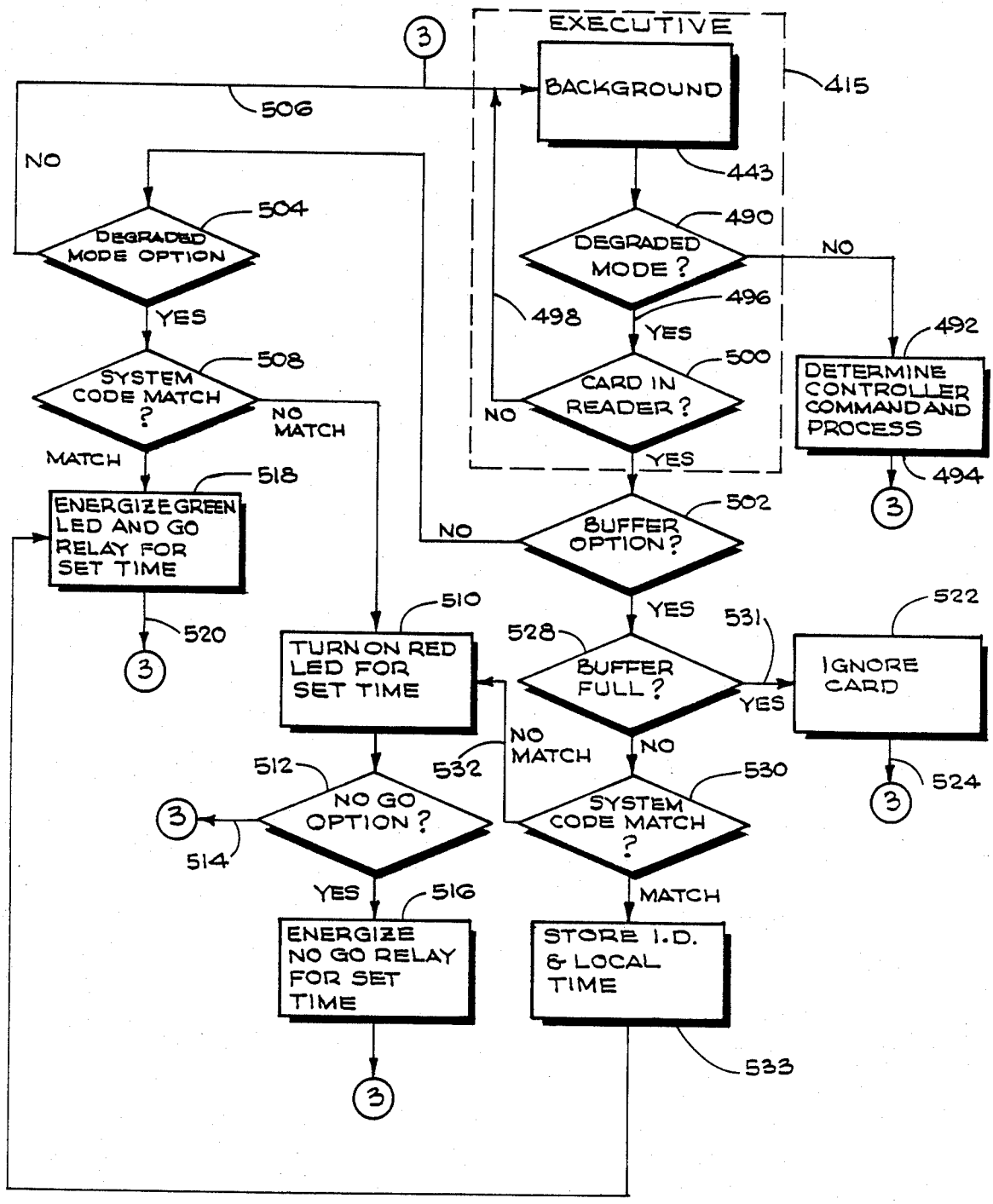
FIG. 12 is a flow diagram of the steps taken by the card reader in buffering transactions during a degraded mode when communication is lost with the central controller.

Referring to FIG. 12 there is shown a flow diagram for the steps taken by the CPU 66 in handling transactions during a degraded mode when communication with the central controller 22 is lost. The block 415 symbolizes the executive routine. The background block 443 symbolizes all the routine housekeeping checks and functions that the card reader does when it is not doing one of the foreground routines to handle certain conditions the CPU discovers during the executive routine. Part of the normal executive routine is to check for the periodic appearance of a poll signal from the central controller. This check is symbolized by the block 490. This function is implemented by the CPU 66 in determining whether a poll signal has arrived in the preceding 30 seconds. If a poll signal has arrived during the last 30 seconds, then there is no degraded mode and the CPU 66 determines what type of command has been received, if any, and processes the command as symbolized by the block 492. Control is then returned to the executive routine by the path 494.

If a poll signal has not arrived during the preceding 30 seconds, the card reader CPU 66 knows that something is wrong and enters the degraded mode. This is symbolized by the path 496. The first step is to determine if there is a card in the reader slot. This step is symbolized by the block 500. If there is not a card in the reader, control is returned to the executive background loop 443 as symbolized by the path 498.

If there is a card in the reader, the CPU 66 addresses the feature memory 98 in FIG. 2 to determine if the buffer option is present. This is symbolized by the block 502 in FIG. 12.

If the buffer option is not present, then no storage of transactions during the degraded mode will occur. However, it is still possible to authorize or deny access to a card holder based upon the system code that is on his card without storing the I.D. code and time of day in a buffer. To determine whether or not to do this, the CPU 66 must again address the feature memory 98 to determine whether the degraded mode option is present. This operation is symbolized by the block 504 in FIG. 12. If the degraded mode option is not in effect, the CPU returns to the background loops 443 by the path 506.

If the degraded mode option is present, the CPU reads the system code on the magnetic card in the reader slot via the card reader coils 74 and then reads the switches 140 in FIG. 4. The CPU 66 compares the system code on the card to the system code on the switches for a match. This comparison is symbolized by the block 508 in FIG. 12.

If there is no match, the CPU 66 turns on the red LED for a time set by the switches on the switch and relay board 62 in FIG. 2. This indicates no authorization as symbolized by the state 510. The CPU 66 then addresses the feature memory 98 to determine if the no go option is in effect, as symbolized by the state 512. If it is not in effect, the CPU 66 returns to the background loops 443 via the path 514. If the option is in effect, the CPU addresses the no go relay 166 in FIG. 4 through the driver 70 by placing the proper address on the lines 172 and writing a logic 1 on the buffered DØ data bit line 68. The no go relay 166 is thereby energized for a time set by the switches on the switch and relay board 62, and whatever external device that is coupled to the no go relay contacts through the lines 167 will be signalled that an unauthorized person has attempted an entry. This operation is symbolized by the block 516 in FIG. 12.

If the system code on the switches match that on the card, the CPU 66 energizes the green LED in the LED block 97 of FIG. 2 for a predetermined time. The CPU 66 also energizes the go relay 71 in FIG. 4 for a time set by the switches 138. This is done in a similar manner to that just described for the no go relay. This operation is symbolized by the block 518 in FIG. 12. Control is then returned to the background loops 442 via the path 520.

Returning to the state 502 in FIG. 12, if the buffer option is present, the CPU 66 checks its internal counter to determine if the buffer 88 in FIG. 2 is full of transaction data. This is symbolized by the block 528 in FIG. 12. If the buffer is full, the CPU 66 ignores the card and transfers back to the background loops 443 as symbolized by the path 531 through the state 522.

If the buffer is not full, the CPU 66 will read the system code switches in FIG. 4 and the system code data on the card and compare them as symbolized by the block 530. If there is no match, the red LED in the LED block 97 in FIG. 2 will be turned on for a time as symbolized by a transfer to the state 510 via the path 532 in FIG. 12. Processing from the state 510 will continue as previously described.

If the system code does match, the CPU will store the I.D. code from the card along with the local time in the delayed transmission buffer 88 of FIG. 2 as symbolized by the block 533. The green LED and Go relay are then energized for a preset time in state 518.

Figure 13:
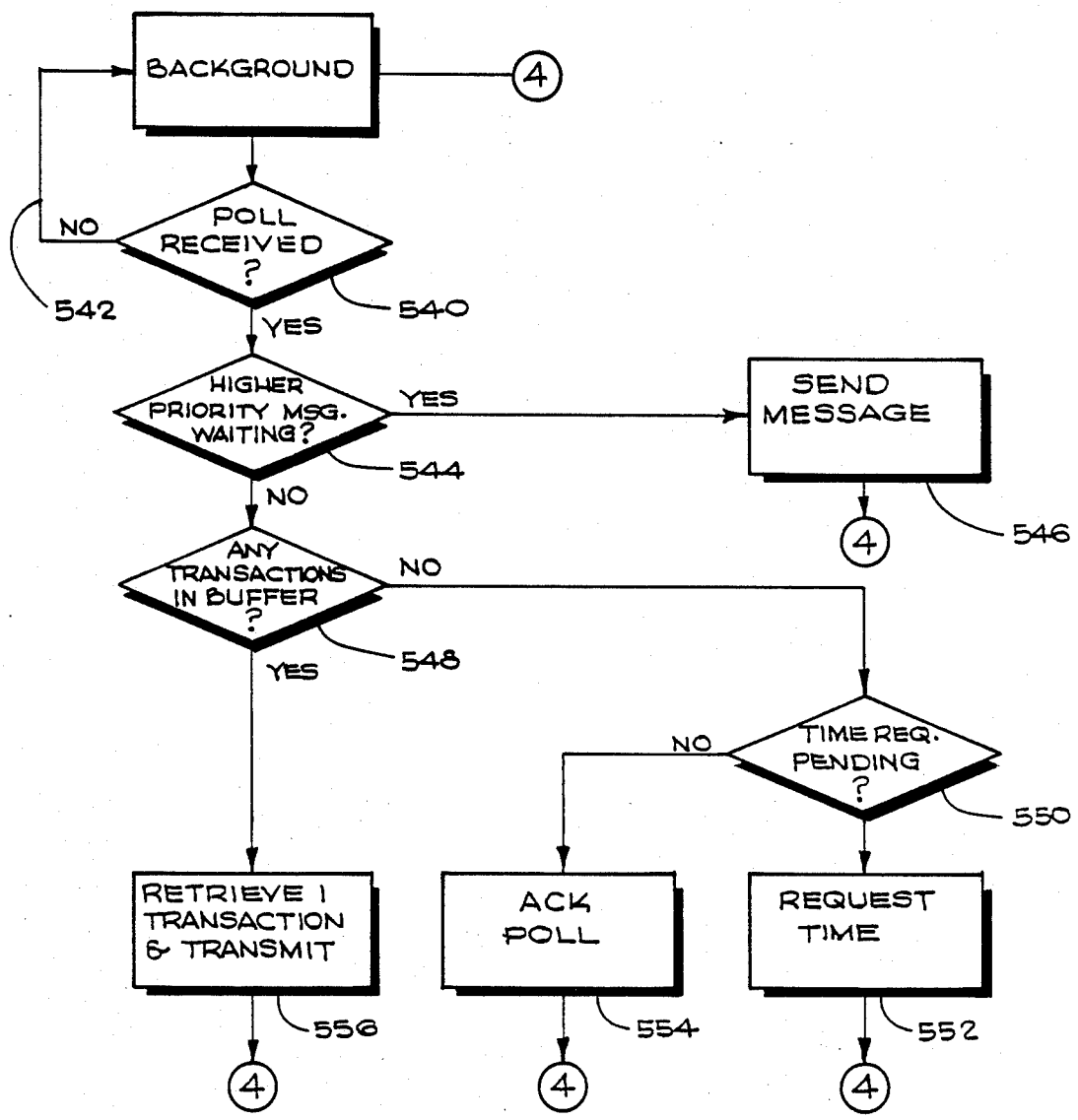
FIG. 13 is a flow diagram of the manner in which the card reader CPU unloads the delayed transmission buffer when communications are restored.

The buffer 88 is unloaded one transaction at a time when communications are restored. Referring to FIG. 13, there is shown a flow diagram of the manner in which the CPU unloads the buffer. During the executive background routine, the CPU 66 continually checks for the presence of a poll signal from the central controller. When a poll finally arrives, the reader knows that communications have been restored. This monitoring function is symbolized by the block 540 in FIG. 13. If no poll has arrived, the CPU returns to its other background functions as symbolized by the path 542.

If a poll has arrived, the CPU 66 will check to see if any higher priority messages are waiting to be sent as symbolized by the block 544. If there is such a message, it is sent, as symbolized by the block 546, and control is returned to the background routine of the executive.

If no higher priority message is waiting, the CPU 66 will determine if there are any transactions stored in the buffer waiting to be sent as symbolized by the block 548. This is done by consulting the internal counter in the CPU 66 to determine how full the buffer 88 is. If no data, is in the buffer 88, the CPU determines whether there is a time request pending as symbolized by the block 550. If there is, the CPU 66 moves to the state 552 to request the time from the central controller and then returns to the executive routine. If there is no time request pending, the CPU 66 will acknowledge the poll in a state 554 and return to the executive routine.

Returning to the state 548 in FIG. 13, if there are transactions in the buffer 88 to be sent, the CPU 66 will retrieve one transaction data group, format it for serial transmission and transmit it in the manner previously discussed, using the DØ data bit line 68, the driver 70, the address lines A0–2, the Tx data lines 58 and the isolation board 54. The format for the transmission in the preferred embodiment is a header identifying the type of reader with the data, followed by a condition code indicating the type of transaction that has been retrieved. Following the condition code, the I.D. data from the card is sent along with the time of day when the transaction occurred. These steps are symbolized by the block 556. Any format for transmission will do, however. Control is then returned to the executive routine.

Figure 14:
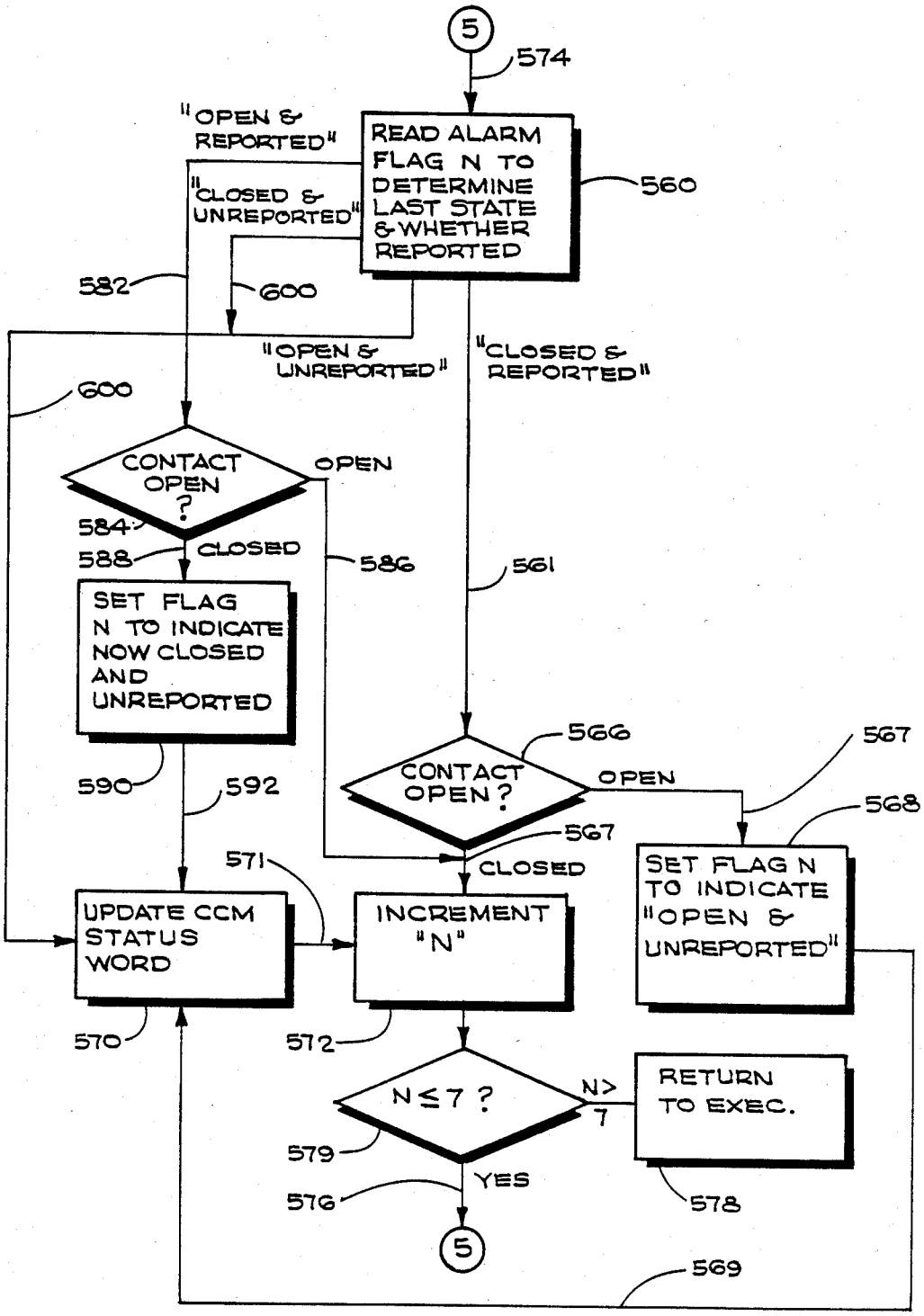
FIG. 14 is a flow diagram of the manner in which the card reader CPU senses alarm contacts.

Turning now to FIG. 14, there is shown a flow diagram of the steps the card reader CPU 66 takes in monitoring the alarm contacts connected to the lines 30 from the CCM/COM board 90. The routine illustrated in FIG. 14 is executed by the CPU 600 times per second and is intended to sense the condition of the flags which symbolize the state of the alarm contacts. The first step is to read a CCM flag N to determine the last state of the flag. This step is symbolized by the block 560 in FIG. 14. To do this the CPU 66 picks the address for the flag N in the RAM 334 of FIG. 7 and writes that address on the lines 242 after selecting the RAM with the All and VMA lines coupled to the decoder 338 to drive the line 336 low. The R/$\overline{W}$ input of the RAM 334 is driven to the read state by the microprocessor 66 in FIG. 6A.

There are four possible states for the flag symbolizing the state of its corresponding alarm contact. The flag can show "open and reported", "closed and unreported", "open and unreported" or "closed and reported". One 8 bit byte is used to symbolize these states.

If the flag shows "closed and reported", the CPU 66 must know whether the alarm contact N has changed status since its last state as indicated by the flag N. Therefore, the CPU 66 causes the alarm contact N to be read. This step is represented by the transfer on the path 561 to the block 566 and is physically accomplished by selecting the contact N address and writing that address to the multiplexer 330 on the lines 332 in FIG. 7. The CPU 66 also enables the multiplexer 330 in any known manner utilizing the $\overline{CS}\overline{CC}\overline{M}$ signal connected to pin 15 of the multiplexer 330. The $\overline{CS}\overline{CC}\overline{M}$ signal can be generated by decoders coupled to the address bus of the CPU 66 or in any other known manner. With the address on the lines 332 set, the multiplexer 330 will select the one of its outputs X0–X7 for connection to the D7 line coupled to the CPU 66 data bus 64. The CPU 66 can then read the desired contact through one of the optical isolators 321–328.

If the alarm contact N is open, the CPU 66 knows that the alarm contact has changed its status since the last time it was read and that this fact must be reported. Therefore the CPU changes the state of the flag N to an "open and unreported" status. This operation is symbolized by the transfer on the path 567 to the block 568 in FIG. 14. Because the status of the alarm contacts has changed, the CPU 66 must update one bit of the status word that is kept in RAM to indicate the status of the alarm contacts. The status word has one bit for each alarm contact, and the bit for contact N is changed to indicate the most current status. This operation is symbolized by the transfer to the block 570 on the path 569.

After the status word has been updated, the CPU 66 is ready to move on to read the next flag. To do this, N must be incremented. This step is represented by the path 571 to the block 572. After N is incremented, the CPU 66 must know whether it has completed reading all the flags and contacts. To do this, the CPU compares the value of N after it has been incremented to the total number of alarm contacts connected to the lines 30 in FIG. 2. In the preferred embodiment, this number is 7, but it can be any number depending upon how much hardware is available. This comparison operation is represented by the block 574 in FIG. 14. If N is less than or equal to 7, the CPU returns to the state 560 by the path 576. If, however, N is greater than 7, the flag reading task is finished and the CPU 66 returns to the executive routine as symbolized by the block 578.

If the flag N had been in the "open and reported" state, the CPU would again like to know if there has been any change of status of the alarm contact associated with the flag N. To determine this, the CPU 66 reads the contact N. This operation is symbolized by the path 582 to the state 584.

If the contact N is open, there has been no change from its last status and the CPU 66 is ready to read the next flag. N will be incremented and processing continues as previously described. This operation is symbolized by the path 586 to the state 572 previously discussed.

If the contact N is closed, the CPU 66 knows there has been a change in status since the last check. Accordingly, the CPU 66 must set the flag N to indicate the contact N is now closed and unreported. This operation is symbolized by the transfer on the path 588 to the state 590 in FIG. 14.

Because there has been a change in the status of one of the alarm contacts, the status word must be updated. This operation is symbolized by the transfer on the path 592 to the state 570. Processing then continues as previously described.

Returning to the state 566, if after reading flag N and finding its status to be "closed and reported", the CPU 66 then reads the contact N and finds that it is still closed, there has been no change in the alarm contact condition since the last reading. Thus there is no need to change the flag status and there is no need to change the status word. Accordingly, the CPU 66 merely increments N as symbolized by the transfer on the path 567 to the state 572. Processing then continues as previously described.

If in the state 560, the CPU 66 determines the flag N is either "closed and unreported" or ∓open and unreported", there is no need to read the alarm contact because the central controller has not yet bee notified of the change in status of the alarm contact which caused the flag to be set in either of these two states. Since notification is the first priority, the CPU 66 will merely update the status word to indicate the new status and continue reading the other flags. This operation is symbolized by the transfer on the path 600 to the previously described state 570.

Figure 15:
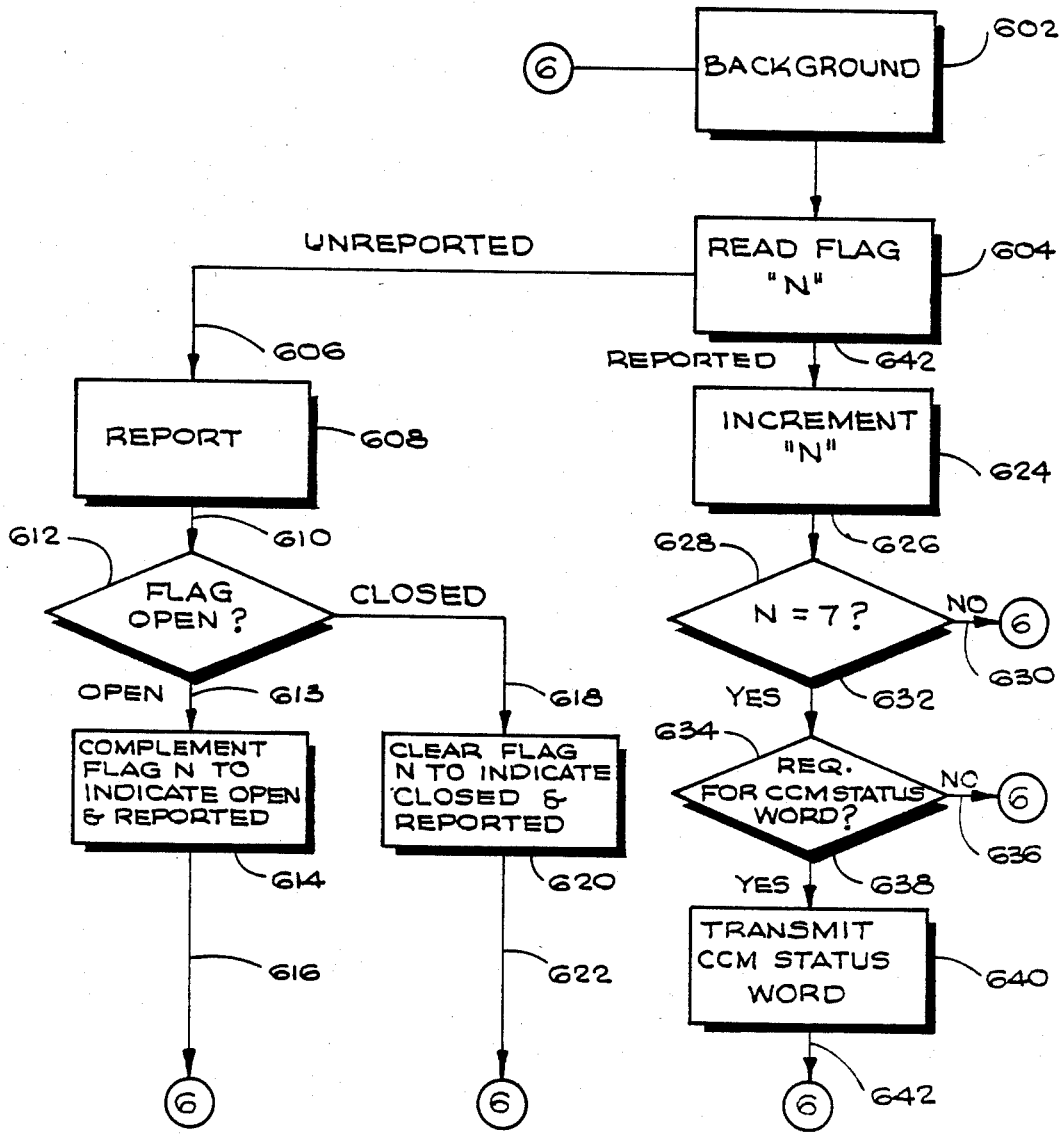
FIG. 15 is a flow diagram for reporting of the status of alarm contacts by the card reader CPU.

Referring to FIG. 15, there is shown a flow diagram of the steps taken by the CPU in reporting the changing conditions on the alarm contacts coupled to the lines 30 to the central controller 20 in FIG. 1. The routine shown in FIG. 15 is periodically executed when program control of the CPU 66 is transferred from the background tasks of the executive routine represented by the block 602 to the routine of FIG. 15.

The first step is for the CPU 66 to read the flag N to determine if it has been reported or is currently in an unreported status. If the alarm contact N change in status has not yet been reported as indicated by an unreported status of the flag N, then the CPU 66 sends a CCM message to the central controller 20 reporting the changed condition of the alarm contacts N. These operations are represented by the block 604 where the flag N is read and the transfer on the path 606 to the block 608 where the CCM message is transmitted to the central controller. Referring to FIG. 2, the CCM message is transmitted by formulation of the serial format message inside the CPU 66 and placing it on the DØ data bit line 68 to drive the driver 70. The address bit lines A0–A2 are held by the CPU 66 at the address which connects the DØ data bit line to the Tx data lines 58. The serial data CCM message then passes through the optical isolators on the isolation board 54 and over the data lines 28 to the central controller 20 in FIG. 1.

The next step after transmitting the CCM message is for the CPU 66 to determine if the flag is open or closed to determine whether to change the flag to a "closed and reported status" or an "open and reported status". This step is represented by the transfer to the state 612 by the path 610.

If the flag is open, the CPU 66 transfers to the state 614 by the path 613 to change the flag status to "open and reported". Control is then transferred to the state 602 by the path 616. If the flag is closed, the CPU 66 must change the flag to indicate that the condition has now been reported. The CPU 66 then changes the flag status to "closed and reported" status. This is represented by a transfer to the state 620 on the path 618. Control is then returned to the state 602 by a path 622. From the state 602 processing continues. The CPU 66 then transfers to the state 604 where flag N is again read. This time, the flag N will show that it has been reported so the CPU 66 will increment N. This is represented by the transfer to the state 624 by the path 642. The CPU 66 then compares the value of N to the maximum number of flags to be read as represented by a transfer on a path 626 to a state 628. If N is less than the maximum number of flags in the system, control is transferred back to the executive via a path 630. The next time the executive jumps to the routine of FIG. 15, the CPU 66 will read flag N+1.

If N is equal to the maximum number of flags in the system, the CPU 66 is finished reading all the flags and need only determine whether the central controller 20 has requested the CCM status word. This determination is represented by a transfer to the state 634 by the path 632. If the central controller 20 has not requested the CCM status word, control is transferred back to the executive via the path 636. If the central controller has requested the CCM status word, the status word is sent as represented by transfer to the state 640 on the path 638. Thereafter, control is returned to the executive via the path 642.

Figure 16:
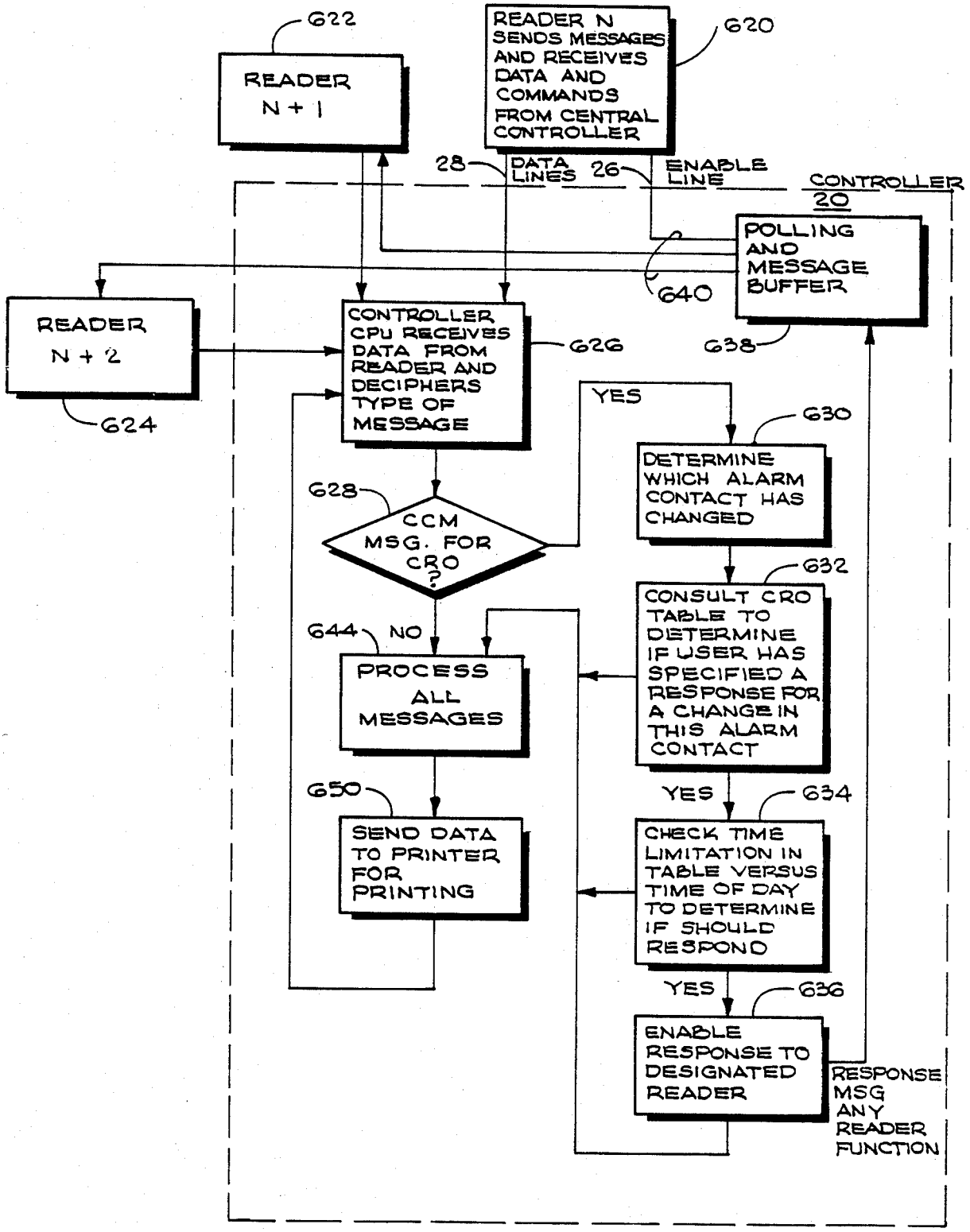
FIG. 16 is a flow diagram for the central controller process for an automatic response to a change in an alarm contact.

Referring to FIG. 16 there is shown a flow diagram of the steps taken by the central controller 20 in FIG. 1 to process messages from the card readers regarding changes in the status of the alarm contacts. The blocks 620, 622 and 624 represent individual readers in the system which are coupled to the central controller 20. Each reader has its own data lines, such as data line 28 for the reader N, upon which data is transmitted from the reader to the central controller 20. The controller 20 is also coupled to each reader by enable lines, such as the enable line 26 coupled to the reader N, upon which commands are sent from the controller 20 to the reader.

As represented by the blocks 620, 622 and 624, each reader formulates and sends a number of messages to the central controller.

The messages received by the central controller 20 are deciphered to determine what type of message it is and what is the data in the message. This operation is symbolized by the block 626.

One of the questions asked by the controller is whether or not the received message is a CCM message. This decision is represented by the block 628.

If the message is a CCM message, the controller must determine from the data in the message which alarm contact has changed. This determination is represented by the block 630. The reason for this determination is that the controller may not be programmed by the user to do anything in response to changes in certain alarm contacts. What the controller does in response to a change in status of a particular alarm contact is user programmable. The controller keeps a table of user programmable entries. The table can have an entry for each alarm contact in the system or it may only have entries for some of the alarm contacts. This table is called the CRO table, which stands for Conditioned Response Option. A typical table entry would include the alarm contact number, the contact condition, the reader location, the condition response location, a CRO override command and time limitation data.

The controller, after deciphering the CCM message, must consult the CRO table to determine if there is an entry for that alarm contact. If there is, the controller will examine the contact condition code, the alarm contact number, and the reader location data in the CCM message to determine if it matches the entry in the CRO table. This operation is symbolized by the block 632 in FIG. 16.

The time zone data in the CRO table can be user-programmed to only allow the specified conditioned response if the CCM message for the contact in question comes in within the time parameter. Alternatively, the time zone may be unlimited if the user programs the appropriate code, such that the conditioned response will occur any time a message matching the CRO entry comes into the controller. This operation is symbolized by the block 634.

If there is a CRO table entry and the CCM message comes in within the time parameters of the CRO table entry, the controller will send a CRO command to the location specified in the CRO table entry. This could be to the reader coupled to the CCM contact which changed to cause the CCM message in question, or it could be to some other reader location in the system. This operation is symbolized by the block 636. The CRO response message is sent to a buffer which holds messages to be sent to particular readers until their turn for transmission over the enable lines come up. The messages are sent on a first come, first serve basis. This message buffering and the periodic polling function of the central controller are represented by the block 638. The messages are sent on one of the enable pairs 640.

The central controller also searches the CRO table for other entries regarding the same alarm contact. That is, the central controller may send one or more CRO responses to one or more locations in the system in response to a change on an alarm contact. The CRO response can be any of the reader commands associated with the other reader functions such as "go off line" or "send CCM status word". In particular, it may be a command to energize a COM relay anywhere in the system. This "energize COM relay", command, when received by the CPU 66 in the reader, causes it to address the relay 352 in FIG. 7 through the address lines 346 after selecting the driver 344 using the line 342 and the decoder 338. The coil of the relay 352 is then connected to the DØ data bit line 348 from the CPU 66 in FIG. 2 such that the CPU 66 can energize the relay coil by writing a logic zero on the line 348. This changes the state of the relay contact 354 which notifies an external device coupled to the relay contacts 354 by the lines 38 that some action is needed. The external device can be a fire alarm, sprinkler system, telephone dialer or any other device.

After the CRO message is sent, the central controller continues on with processing all the incoming messages. This is symbolized by the transition on the path 642 to the state 644. The same would be true if there were either no CRO table entry corresponding to the CCM message or if the CCM message were outside the time zone set by the CRO table entry. These two transitions are represented by the paths 646 and 648, respectively, to the state 644. The central controller then sends data to be printed regarding any or all of the incoming messages to a printer as represented by the block 650. The central controller may send a message to the printer regarding the CCM message if desired.

This concludes the description of the system of the improved card reader. Below there is listed the machine language in hexadecimal notation, implementing the preferred embodiment of the flow diagrams of FIGS. 9–16. Appendix A is the machine language for the flow diagram of FIGS. 9–11. Appendix B is the machine language for the flow diagrams of FIGS. 12–13. Appendix C is the machine language for the flow diagrams of FIGS. 14–16.

Appendix A (c) Copyright 1982 Rusco Electronic Systems -- a division of Figge International, Inc. -- all rights reserved.

```
000 3E 00 7F B6 00 82 34 07 27 03 8E 66 3E 7F 00 80
010 86 FF B7 00 30 CE 00 00 4F A7 00 08 8C 00 67 26
020 F8 B6 00 82 34 07 27 54 FE 60 15 8C 04 D2 27 20
030 CE 60 00 6F 00 08 8C 66 06 26 F8 CE 60 2A FF 60
040 1A FF 60 1C FF 60 1E FF 60 20 CE 04 D2 FF 60 15
050 CE 60 00 6F 00 08 8C 60 15 26 F8 FE 60 1A BC 60
060 1C 27 03 FF 60 1C FE 60 1E BC 60 20 27 03 FF 60
070 20 FE 60 22 BC 60 24 27 03 FF 60 24 8D 6A 0E 7F
080 00 80 96 34 26 17 8D 72 75 24 F4 26 F2 86 FF B7
090 00 09 CE B9 80 FF 00 31 86 0C 37 00 5F 7F 00 80
0A0 BD 71 28 B6 00 82 84 03 27 25 81 01 22 0B 7F 60
0B0 05 7F 60 06 BD 77 A2 20 09 36 BD 77 91 32 85 01
0C0 27 13 95 E1 2B 0F BD 7C CD BD 72 75 24 CF BD 39
0D0 BD 7A 41 20 C8 96 34 26 02 20 EE BD 71 12 BD 72
0E0 75 24 BA 26 B8 7E 70 00 CE 00 15 6F 00 08 8C 00
0F0 67 26 F3 86 FF 57 00 37 CE 00 07 A7 86 09 3C FF
100 FF 26 F3 3D 04 36 7E 71 B5 7F 00 34 CE FD A8 DF
110 21 39 35 35 3A 11 CE FF F6 FF 00 25 86 FF B7 00
120 3B 7F 00 35 7F 60 12 39 96 35 27 52 2B 50 86 10
130 36 8D 53 32 49 DE 49 08 DF 49 24 F4 F6 00 E6 2A
140 3E D6 81 C4 10 27 01 43 34 0F DE 4B A7 00 08 DF
150 49 8C 00 45 26 28 96 5F 81 0C 27 23 D6 82 C4 01
160 27 0F 09 09 09 A6 00 81 09 22 14 09 8C 00 3D 26
170 F4 86 FF 97 35 D6 32 C4 04 27 03 B7 60 12 39 7F
180 00 35 CE FF F6 DF 25 86 FF 97 36 39 DE 49 A6 00
190 43 CE 03 E7 A7 00 44 09 8C 00 E3 26 F7 03 43 44
1A0 09 25 FC 0F 36 FF 97 37 6F CE 00 01 01 01 01 01 F6
1B0 20 C7 95 37 36 0E 36 0F CE 00 E0 A7 00 44 08 8C
1C0 00 E4 26 F7 32 4D 27 C4 53 39 7F 00 37 7A 00 17
1D0 2A 2E 86 07 97 17 96 0F 26 14 96 11 27 23 7F 00
1E0 11 96 13 97 15 36 09 97 0F 7F 00 31 20 12 7A 00
1F0 0F 27 09 96 15 97 21 76 00 15 20 04 86 FF 97 81
200 86 0E 27 61 96 10 27 32 2A 41 43 27 15 7A 00 15
210 26 82 86 05 97 18 96 C6 49 76 00 16 24 56 7C 00
220 10 3B 7A 00 18 26 4D 7F 00 10 96 C6 2A 2F 96 12
230 26 42 73 00 12 96 16 97 14 3B 96 C6 2B 36 86 03
240 97 18 36 01 37 10 36 20 97 16 3B 96 C6 2B 0E 7A
250 00 18 26 20 36 FE 37 10 86 03 97 18 3B 86 80 97
260 18 7F 00 0E 3B 96 C6 2A F4 7A 00 13 26 06 73 00
270 0E 7F 00 10 3B 0C 96 12 27 15 96 14 7F 00 12 0D
280 39 36 7F 00 80 96 11 26 FC 32 97 13 73 00 11 39
290 CE 00 53 EE 00 36 FF A7 00 B6 00 3B 26 3F B6 00
2A0 58 26 35 35 04 7F 00 57 4A 57 00 58 F6 00 57 58
2B0 7C 00 57 CE 73 06 BD 72 DE EE 00 AD 00 F6 00 61
2C0 CE 72 F2 3D 72 DE A5 00 CE 00 C1 A7 00 46 08 8C
2D0 00 C8 26 F7 CE 00 53 EE 00 C3 FE E7 00 39 4F FF
2E0 00 55 FB 00 56 F7 00 56 39 00 55 B7 00 55 FE 00
2F0 55 39 34 E7 31 C1 E2 C3 8A E5 30 E0 58 7F FB 3E
300 32 33 E7 98 C0 F0 73 0E 73 5E 73 32 73 F0 CE 00
310 B1 FF 00 53 BD 74 34 24 0A 86 60 12 26 36 56 60
320 0F 26 34 BD 74 59 24 05 B6 60 36 26 25 B6 00 34
330 26 1F BD 74 62 25 20 56 00 5D F6 00 82 C4 03 27
340 03 B6 60 03 F6 00 E0 2B 04 31 00 27 0A B7 00 61
350 39 7E 74 2D 7E 74 7A 86 0B 30 F2 7E 74 3E CE 00
360 52 FF 00 53 BD 74 34 24 15 86 60 12 26 39 B6 20
370 0F 26 05 2A 04 4F 7E 73 9F 36 10 7E 73 9F BD 74
380 59 24 05 56 60 26 28 27 36 00 34 26 19 BD 74 62
390 25 11 56 20 5E F6 00 32 C4 03 27 03 B6 60 0C 37
3A0 00 61 33 7E 74 50 7E 74 31 7E 74 7F 7E 74 48 7E
3B0 74 43 CE 00 B3 FF 09 53 5D 74 34 24 0E 86 60 12
3C0 26 EA 36 20 0F 27 04 36 0B 30 21 BD 74 59 24 05
3D0 86 80 23 26 73 B6 00 34 26 5C 5D 74 62 25 76 86
3E0 00 5F F6 00 82 C4 03 27 03 56 50 0D 57 00 61 39
3F0 CE 00 54 FF 00 53 5D 74 34 24 0F 36 30 12 26 05
400 B6 60 0F 27 05 36 0B 7E 74 29 8D 4D 24 05 B6 50
410 26 26 39 B6 00 34 26 22 8D 48 25 1E B6 00 60 F6
420 00 82 C4 03 27 03 56 60 0E B7 00 61 39 4F 7E 73
430 4D 36 0A 7E 73 3F 86 0A 20 B2 86 0B 20 EB 86 0A
440 7E 73 4D 86 0E 7E 73 9F 86 0D 20 A0 86 0D 20 D9
```

```
450 86 12 7E 73 9F 86 13 20 93 B6 00 82 84 01 27 16
460 0D 39 B6 00 3D 26 11 B6 00 36 27 0A FE 00 1B 26
470 07 B6 00 38 26 02 0C 39 0D 39 86 05 7E 73 4D 86
480 11 7E 73 9F B6 00 82 84 04 27 EB 0D 39 86 FF 97
490 80 97 B0 7F 00 B0 B6 00 0A 27 13 7A 00 06 26 0E
4A0 B6 00 0B 26 41 7F 00 0A 7F 00 08 7F 00 0B BD 72
4B0 90 7A 00 3A 26 17 86 1E 97 3A BD 76 0B BD 76 3B
4C0 BD 75 3C BD 75 74 8D 06 8D 2B BD 79 A8 3B 96 80
4D0 84 04 27 20 96 33 27 15 2A 1A 43 27 17 96 E7 2B
4E0 13 86 FF 97 33 39 86 FF B7 00 07 20 C1 96 E7 2A
4F0 03 7C 00 33 39 96 36 27 1C 2A 26 43 27 0F 96 E6
500 2B 26 86 FF 97 36 7F 60 12 7F 60 0F 39 96 E6 2B
510 26 7F 00 36 39 4F 97 35 96 E6 2A 0C 86 01 97 36
520 39 96 E6 2B 04 7F 00 36 39 86 01 97 35 CE 00 3E
530 DF 4B CE 00 84 DF 49 86 FE 97 36 39 CE 00 EC 8D
540 1F 97 66 96 E0 84 80 B1 00 65 27 06 B7 00 65 BD
550 7B FD CE 00 EB 8D 09 CE 00 F4 8D 05 B7 60 0A 39
560 4F E6 03 59 49 E6 02 59 49 E6 01 59 49 E6 00 59
570 49 88 0F 39 CE 00 00 6D 19 27 0A 6C 1A 26 06 6C
580 19 26 02 8D 08 08 08 8C 00 1A 26 EB 39 DF 45 D6
590 46 CE 75 A9 DF 55 DB 56 D7 56 C6 00 D9 55 D7 55
5A0 DE 55 EE 00 AD 00 DE 45 39 75 C3 75 FE 76 18 76
5B0 32 76 70 77 00 76 F3 77 67 77 77 76 67 76 88 75
5C0 DD 75 EA 96 3D 81 01 27 10 81 FE 27 0C 96 66 26
5D0 24 96 E6 2A 29 86 FF 97 32 BD 76 46 39 7F 00 07
5E0 7F 00 0A 7F 00 08 7F 00 0B 39 86 FF 97 03 CE B9
5F0 B0 FF 00 31 39 BD 76 46 CE 00 1B 7E 77 47 96 3D
600 31 01 27 36 81 FE 27 32 7E 77 15 96 38 27 78 96
610 E6 2B 74 7F 00 38 20 E6 96 66 26 0D 96 E6 2A 12
620 36 FF B7 00 39 7F 00 85 39 7F 00 85 CE 00 1F 7E
630 77 47 86 FF B7 00 85 7F 00 39 39 B6 00 39 27 FA
640 96 E6 2B F6 20 EC 7F 00 B7 CE FF E7 DF 2B CE FF
650 FB DF 27 CE FF EC DF 29 C6 FF F7 00 3C 7F 00 86
660 7F 00 87 7F 60 0F 39 86 FF B7 00 B7 7F 00 3C 39
670 7F 60 0F 7F 60 12 B6 00 82 84 01 26 0A 86 FF 97
680 34 BD 7B 86 7F 00 3D 39 CE FB 50 DF 2D 96 60 4C
690 81 0A 27 03 97 80 39 4F 97 60 96 5F 4C 81 06 27
6A0 03 97 5F 39 7F 00 5F 96 5E 4C D6 E0 2B 22 F6 00
6B0 82 C4 01 26 1B 81 03 27 0E 81 0A 27 03 97 5E 39
6C0 7C 00 5D 7F 00 5E 39 D6 5D C1 01 27 17 97 5E 39
6D0 81 04 27 07 81 0A 27 E8 97 5E 39 D6 5D C1 02 27
6E0 0B 97 5E 39 7F 00 5D C6 01 D7 5E 39 7F 00 5E 7F
6F0 00 5D 39 7F 00 3B 96 E6 2A 05 CE FF F6 DF 23 39
700 86 FF 97 3B CE FF F6 DF 25 39 CE FF FF DF 19 CE
710 00 00 DF 1B 39 CE 00 00 DF 19 DF 1B 86 FF 97 86
720 97 87 39 CE 00 00 DF 1F DF 1D CE FF F6 DF 25 86
730 FF 97 3B 97 09 7F 60 0F 7F 60 12 96 80 84 10 27
740 E1 CE FF FF DF 1D 39 6F 00 6F 01 4D 27 18 DF 4D
750 CE FF EC DF 4F DE 4D E6 01 DB 50 E7 01 E6 00 D9
760 4F E7 00 4A 26 F1 39 86 FF B7 00 B7 B6 00 3C 27
770 13 CE FF EC DF 27 39 B6 00 3C 27 08 CE FF EC DF
780 29 7F 00 B7 39 28 01 00 64 00 00 32 00 00 16 00
790 00 CE 00 F0 BD 75 60 CE 00 FC BD 75 61 B7 60 09
7A0 8D 0C 8D 43 96 5F 81 0C 27 03 BD 78 AA 39 4F B7
7B0 60 05 B7 60 06 F6 60 09 C4 0F 1B 19 B7 60 06 CE
7C0 77 82 F6 60 09 C4 70 08 08 08 58 24 03 BD 77 D4
7D0 5D 26 F4 39 B6 60 06 AB 00 19 B7 60 06 B6 60 05
7E0 A9 01 19 B7 60 05 39 F6 60 05 27 1D C1 01 22 0F
7F0 B6 60 06 81 19 22 09 C6 40 BD 78 20 B7 60 06 39
800 7C 60 05 84 0F B7 60 06 39 B6 60 06 81 59 22 01
810 39 7C 60 05 B6 60 06 C6 40 BD 78 20 B7 60 06 39
820 CE 60 01 B7 60 00 F7 60 02 C6 01 0C 09 A6 00 A9
830 02 19 A7 04 5A 26 F5 F7 60 03 24 03 7C 60 03 CE
840 60 03 F7 60 00 F7 60 01 F7 60 02 74 60 03 39 CE
850 60 02 B7 60 00 F7 60 02 C6 01 09 86 99 A0 01 A7
860 01 5A 26 F6 C6 01 0D 09 A6 00 A9 02 19 A7 04 5A
870 26 F5 25 23 CE 60 05 C6 01 09 86 99 A0 00 A7 00
880 5A 26 F6 C6 01 0D 09 86 00 A9 01 19 A7 01 5A 26
890 F5 86 80 A7 00 20 07 CE 60 03 C6 00 E7 00 C6 00
8A0 F7 60 00 F7 60 01 F7 60 02 39 D6 60 36 5F BD 78
8B0 F6 B7 60 08 F6 60 09 C4 80 27 21 F6 60 05 F7 60
8C0 07 F6 60 06 11 2B 6E BD 78 4F BD 78 FC 8D 10 F6
8D0 60 05 11 2B 15 BD 78 4F BD 79 06 39 7E 79 4F 96
8E0 5D D6 5E BD 78 F6 B7 60 08 39 C6 24 BD 78 20 F6
8F0 60 05 BD 78 D5 39 48 48 48 48 1B 39 BD 79 78 B7
900 60 0D F7 60 0E 39 D6 E0 2A 10 BD 79 78 B7 60 0B
910 F7 60 0C F6 60 07 F7 60 05 39 81 00 27 08 81 12
920 22 0A BD 79 0A 39 86 12 BD 79 0A 39 C6 88 BD 78
```

| | | | | | | | | | | | | | | | | |
|---|---|---|---|---|---|---|---|---|---|---|---|---|---|---|---|---|
| 930 | 20 | BD | 79 | 0A | 39 | 86 | 60 | BD | 78 | 4F | F6 | 60 | 08 | BD | 78 | 20 |
| 940 | BD | 78 | FC | B6 | 60 | 05 | 8B | 01 | 19 | B7 | 60 | 05 | 7E | 78 | CD | F6 |
| 950 | 60 | 06 | BD | 78 | 20 | 25 | 29 | 81 | 59 | 22 | 25 | BD | 78 | FC | BD | 78 |
| 960 | DF | F6 | 60 | 05 | BD | 78 | 20 | 81 | 23 | 22 | 04 | BD | 79 | 06 | 39 | C6 |
| 970 | 24 | BD | 78 | 4F | BD | 79 | 06 | 39 | 16 | 44 | 44 | 44 | 44 | C4 | 0F | 39 |
| 980 | C6 | 40 | BD | 78 | 20 | BD | 78 | FC | 7C | 60 | 05 | BD | 78 | DF | F6 | 60 |
| 990 | 05 | F7 | 60 | 07 | BD | 78 | 20 | 81 | 23 | 22 | 04 | BD | 79 | 06 | 39 | C6 |
| 9A0 | 24 | BD | 78 | 4F | BD | 79 | 06 | 39 | B6 | 00 | 82 | 84 | 04 | 27 | 15 | 96 |
| 9B0 | 35 | 2A | 11 | B6 | 60 | 14 | 27 | 15 | 2A | 1E | 43 | 27 | 08 | 8D | 3C | 25 |
| 9C0 | 03 | 7C | 60 | 14 | 39 | 8D | 34 | 25 | 15 | 7F | 60 | 14 | 39 | 8D | 15 | 24 |
| 9D0 | F3 | B7 | 60 | 13 | 7C | 60 | 14 | 39 | 8D | 21 | 24 | ED | 8D | 3E | 86 | FE |
| 9E0 | B7 | 60 | 14 | 39 | 4F | CE | 00 | C4 | E6 | 00 | 2A | 0A | 4C | CE | 00 | C5 |
| 9F0 | E6 | 00 | 2A | 02 | 0C | 39 | 37 | 80 | 13 | 0D | 39 | CE | 00 | C4 | FF | 60 |
| A00 | 10 | B6 | 60 | 13 | BB | 60 | 11 | B7 | 60 | 11 | 86 | 00 | B9 | 60 | 10 | B7 |
| A10 | 60 | 10 | FE | 60 | 10 | A6 | 00 | 0C | 2B | 01 | 0D | 39 | CE | 7A | 3F | FF |
| A20 | 60 | 10 | B6 | 60 | 13 | BB | 60 | 11 | B7 | 60 | 11 | 86 | 00 | B9 | 60 | 10 |
| A30 | B7 | 60 | 10 | FE | 60 | 10 | A6 | 00 | B7 | 60 | 0F | 7F | 60 | 12 | 39 | 55 |
| A40 | AA | F6 | 00 | 07 | 26 | 3E | D6 | 0A | 26 | 3B | 44 | 44 | 44 | 44 | 43 | CE |
| A50 | 7A | 64 | DF | 47 | 9B | 48 | 97 | 48 | 86 | 00 | 99 | 47 | 97 | 47 | DE | 47 |
| A60 | EE | 00 | 6E | 00 | 7B | B9 | 7A | 84 | 7A | 84 | 7B | E8 | 7A | 84 | 77 | 23 |
| A70 | 77 | 0A | 7A | 84 | 7B | FB | 7B | A1 | 7B | AD | 7B | 7D | 7B | 8D | 7A | 84 |
| A80 | 7A | 84 | 7A | 84 | 39 | 7F | 00 | 80 | C6 | 0F | F7 | 00 | 06 | D6 | 0B | 26 |
| A90 | 24 | 81 | 10 | 27 | 55 | 81 | 13 | 27 | 06 | 7F | 00 | 0A | 7E | 7B | FD | C6 |
| AA0 | FF | D7 | 0B | C6 | 06 | D7 | 0C | CE | 00 | 05 | DF | 51 | 39 | C6 | FF | F7 |
| AB0 | 00 | 07 | 7E | 7B | FD | D6 | 08 | 26 | 14 | 81 | 23 | 22 | F0 | F6 | 00 | 82 |
| AC0 | C4 | 01 | 26 | 05 | F6 | 00 | E0 | 2A | 23 | C6 | FF | D7 | 06 | C6 | 02 | D7 |
| AD0 | 0D | DE | 51 | 16 | 44 | 44 | 44 | 44 | A7 | 00 | 7A | 00 | 0C | 27 | 35 | 09 |
| AE0 | 7A | 00 | 0D | 27 | 2C | C4 | 0F | 17 | 20 | EE | 20 | 64 | D6 | 08 | 26 | DD |
| AF0 | 81 | 00 | 27 | 19 | 81 | 12 | 2F | D1 | 81 | 20 | 27 | 09 | 81 | 21 | 27 | 05 |
| B00 | C6 | 12 | 18 | 20 | C4 | 86 | 08 | 20 | C0 | 86 | 09 | 20 | BC | 86 | 12 | 20 |
| B10 | B8 | DF | 51 | 39 | 7F | 00 | 08 | 7F | 00 | 0A | 7F | 00 | 0B | 7F | 00 | 07 |
| B20 | 96 | 00 | 81 | 09 | 22 | 8C | 96 | 01 | 81 | 05 | 22 | 86 | 96 | 02 | 81 | 09 |
| B30 | 22 | 80 | 96 | 03 | 81 | 05 | 22 | 42 | CE | 00 | 00 | DF | 2D | 96 | 02 | 97 |
| B40 | 60 | 96 | 03 | 97 | 5F | 96 | 04 | 97 | 5E | 96 | 05 | 97 | 5D | 7E | 7C | 8B |
| B50 | CE | 00 | 00 | DF | 2D | FF | 00 | 2F | 86 | 0C | 97 | 60 | 97 | 5F | 97 | 5E |
| B60 | 97 | 5D | B7 | 60 | 0B | B7 | 60 | 0C | B7 | 60 | 0D | B7 | 60 | 0E | 7F | 00 |
| B70 | 07 | 7F | 00 | 0A | 7F | 60 | 12 | 7E | 7B | FD | 7E | 7A | B2 | 8D | 1E | B6 |
| B80 | 00 | 80 | 84 | 08 | 27 | 74 | 86 | FF | 97 | 3D | 7E | 77 | 15 | 8D | 0E | B6 |
| B90 | 00 | 80 | 84 | 08 | 27 | 64 | 86 | 01 | 97 | 3D | 7E | 77 | 0A | 86 | 10 | 20 |
| BA0 | 71 | 8D | FA | B6 | 00 | 80 | 34 | 08 | 27 | 50 | 7E | 77 | 23 | 8D | EE | B6 |
| BB0 | 00 | 80 | 84 | 08 | 27 | 44 | 7E | 77 | 0A | 01 | 96 | 33 | 27 | 13 | 2B | 07 |
| BC0 | 73 | 00 | 33 | 86 | 80 | 20 | 3B | 43 | 26 | 07 | 7F | 00 | 33 | 86 | 80 | 20 |
| BD0 | 31 | 96 | 3D | 27 | 40 | 2B | 07 | 73 | 00 | 3D | 86 | 40 | 20 | 24 | 43 | 26 |
| BE0 | 34 | 7F | 00 | 3D | 86 | 30 | 20 | 1A | C6 | 0F | F7 | 00 | 06 | CE | FF | FD |
| BF0 | FF | 00 | 2F | 86 | FF | 97 | 0A | 7F | 00 | 30 | 39 | 3D | A0 | 36 | FF | 97 |
| C00 | 09 | 39 | 36 | 3D | 07 | 32 | 20 | 0A | 86 | FF | 20 | 06 | 96 | 31 | 43 | 43 |
| C10 | 48 | 48 | 7E | 72 | 81 | B6 | 00 | 82 | 84 | 01 | 27 | 04 | 96 | E1 | 2A | 3B |
| C20 | 96 | 35 | 2A | 35 | B6 | 00 | 82 | 84 | 04 | 27 | 13 | B6 | 60 | 0F | 27 | 29 |
| C30 | 81 | AA | 27 | 0A | 81 | 55 | 26 | D0 | 8D | D2 | 86 | E0 | 20 | 03 | 8D | CC |
| C40 | 4F | CE | 00 | 00 | AA | 3E | 8D | CA | 03 | A6 | 3E | 43 | 48 | 48 | 43 | 08 |
| C50 | 8C | 00 | 03 | 26 | EF | 7F | 00 | 35 | 39 | 20 | 5E | 96 | 09 | 2B | 5E | BD |
| C60 | 7D | 6A | 24 | 55 | 66 | 03 | B7 | 60 | 17 | 86 | 70 | 8D | A5 | 17 | 8D | A2 |
| C70 | BD | 7D | 6A | 17 | 8D | 9C | 7A | 60 | 17 | 2A | F5 | 7F | 60 | 26 | FE | 60 |
| C80 | 1C | FF | 60 | 1A | FE | 60 | 24 | FF | 60 | 22 | 39 | D6 | 01 | D7 | 64 | 4F |
| C90 | 97 | 62 | 97 | 63 | 86 | 0A | 20 | 06 | 73 | 00 | 64 | 79 | 00 | 63 | 44 | 24 |
| CA0 | 07 | D6 | 62 | DB | 64 | D7 | 62 | 4D | 26 | EE | 96 | 62 | D6 | 00 | 1B | 16 |
| CB0 | 86 | 3C | 10 | CE | 00 | 2D | 7E | 77 | 47 | 96 | 09 | 27 | 0D | 7F | 60 | 09 |
| CC0 | 86 | 30 | BD | 7C | 12 | 86 | 01 | 7E | 7C | 12 | 7E | 7C | 08 | B6 | 00 | 35 |
| CD0 | 3A | 3E | B6 | 00 | 5F | 31 | 0C | 27 | 34 | B6 | 60 | 0A | 84 | 0F | 81 | 00 |
| CE0 | 44 | 26 | 24 | B6 | 60 | 0A | 44 | 44 | 44 | 44 | B1 | 00 | 43 | 26 | 18 | B6 |
| CF0 | 00 | 82 | 84 | 04 | 27 | 1B | B6 | 60 | 0F | 27 | 15 | 81 | AA | 27 | 12 | 81 |
| D00 | 55 | 26 | 66 | 86 | E0 | 20 | 0B | 7F | 00 | 35 | 7E | 77 | 23 | 7F | 00 | 35 |
| D10 | 39 | 4F | CE | 00 | 00 | AA | 3E | FF | 60 | 18 | 16 | BD | 7D | 8A | 24 | ED |
| D20 | FE | 60 | 18 | 08 | A6 | 3E | 48 | 48 | 48 | 48 | 08 | 8C | 00 | 06 | 26 | E5 |
| D30 | 7F | 00 | 35 | F6 | 60 | 0C | B6 | 60 | 0B | BD | 78 | F6 | 16 | BD | 7D | 8A |
| D40 | F6 | 60 | 0E | B6 | 60 | 0D | BD | 78 | F6 | 16 | BD | 7D | 8A | FE | 60 | 20 |
| D50 | FF | 60 | 1E | FE | 60 | 24 | FF | 60 | 22 | B6 | 00 | 82 | 84 | 04 | 26 | 03 |
| D60 | 7E | 77 | 0A | CE | FF | FB | BD | 77 | 0D | 39 | FE | 60 | 24 | 27 | 19 | 09 |
| D70 | FF | 60 | 24 | FE | 60 | 1C | E6 | 00 | 8C | 66 | 05 | 26 | 05 | CE | 60 | 2A |
| D80 | 20 | 01 | 08 | FF | 60 | 1C | 0D | 39 | 0C | 39 | 7D | 60 | 26 | 26 | 29 | FE |
| D90 | 60 | 24 | 03 | FF | 60 | 24 | FE | 60 | 20 | E7 | 00 | 86 | FF | B7 | 60 | 28 |
| DA0 | 8C | 66 | 05 | 26 | 05 | CE | 60 | 2A | 20 | 01 | 08 | FF | 60 | 20 | BC | 60 |
| DB0 | 1C | 26 | 07 | 86 | FF | B7 | 60 | 26 | 0C | 39 | 0D | 39 | 00 | 00 | 00 | 00 |
| DC0 | 00 | 00 | 00 | 00 | 00 | 00 | 00 | 00 | 00 | 00 | 00 | 00 | 00 | 00 | 00 | 00 |
| DD0 | 00 | 00 | 00 | 00 | 00 | 00 | 00 | 00 | 00 | 00 | 00 | 00 | 00 | 00 | 00 | 00 |
| DE0 | 00 | 00 | 00 | 00 | 00 | 00 | 00 | 00 | 00 | 00 | 00 | 00 | 00 | 00 | 00 | 00 |
| DF0 | 00 | 00 | 00 | 00 | 00 | 00 | 00 | 00 | 00 | 00 | 00 | 00 | 00 | 00 | 00 | 00 |
| E00 | 00 | 00 | 00 | 00 | 00 | 00 | 00 | 00 | 00 | 00 | 00 | 00 | 00 | 00 | 00 | 00 |

| | | | | | | | | | | | | | | | | |
|---|---|---|---|---|---|---|---|---|---|---|---|---|---|---|---|---|
| E10 | 00 | 00 | 00 | 00 | 00 | 00 | 00 | 00 | 00 | 00 | 00 | 00 | 00 | 00 | 00 | 00 |
| E20 | 00 | 00 | 00 | 00 | 00 | 00 | 00 | 00 | 00 | 00 | 00 | 00 | 00 | 00 | 00 | 00 |
| E30 | 00 | 00 | 00 | 00 | 00 | 00 | 00 | 00 | 00 | 00 | 00 | 00 | 00 | 00 | 00 | 00 |
| E40 | 00 | 00 | 00 | 00 | 00 | 00 | 00 | 00 | 00 | 00 | 00 | 00 | 00 | 00 | 00 | 00 |
| E50 | 00 | 00 | 00 | 00 | 00 | 00 | 00 | 00 | 00 | 00 | 00 | 00 | 00 | 00 | 00 | 00 |
| E60 | 00 | 00 | 00 | 00 | 00 | 00 | 00 | 00 | 00 | 00 | 00 | 00 | 00 | 00 | 00 | 00 |
| E70 | 00 | 00 | 00 | 00 | 00 | 00 | 00 | 00 | 00 | 00 | 00 | 00 | 00 | 00 | 00 | 00 |
| E80 | 00 | 00 | 00 | 00 | 00 | 00 | 00 | 00 | 00 | 00 | 00 | 00 | 00 | 00 | 00 | 00 |
| E90 | 00 | 00 | 00 | 00 | 00 | 00 | 00 | 00 | 00 | 00 | 00 | 00 | 00 | 00 | 00 | 00 |
| EA0 | 00 | 00 | 00 | 00 | 00 | 00 | 00 | 00 | 00 | 00 | 00 | 00 | 00 | 00 | 00 | 00 |
| EB0 | 00 | 00 | 00 | 00 | 00 | 00 | 00 | 00 | 00 | 00 | 00 | 00 | 00 | 00 | 00 | 00 |
| EC0 | 00 | 00 | 00 | 00 | 00 | 00 | 00 | 00 | 00 | 00 | 00 | 00 | 00 | 00 | 00 | 00 |
| ED0 | 00 | 00 | 00 | 00 | 00 | 00 | 00 | 00 | 00 | 00 | 00 | 00 | 00 | 00 | 00 | 00 |
| EE0 | 00 | 00 | 00 | 00 | 00 | 00 | 00 | 00 | 00 | 00 | 00 | 00 | 00 | 00 | 00 | 00 |
| EF0 | 00 | 00 | 00 | 00 | 00 | 00 | 00 | 00 | 00 | 00 | 00 | 00 | 00 | 00 | 00 | 00 |
| F00 | 00 | 00 | 00 | 00 | 00 | 00 | 00 | 00 | 00 | 00 | 00 | 00 | 00 | 00 | 00 | 00 |
| F10 | 00 | 00 | 00 | 00 | 00 | 00 | 00 | 00 | 00 | 00 | 00 | 00 | 00 | 00 | 00 | 00 |
| F20 | 00 | 00 | 00 | 00 | 00 | 00 | 00 | 00 | 00 | 00 | 00 | 00 | 00 | 00 | 00 | 00 |
| F30 | 00 | 00 | 00 | 00 | 00 | 00 | 00 | 00 | 00 | 00 | 00 | 00 | 00 | 00 | 00 | 00 |
| F40 | 00 | 00 | 00 | 00 | 00 | 00 | 00 | 00 | 00 | 00 | 00 | 00 | 00 | 00 | 00 | 00 |
| F50 | 00 | 00 | 00 | 00 | 00 | 00 | 00 | 00 | 00 | 00 | 00 | 00 | 00 | 00 | 00 | 00 |
| F60 | 00 | 00 | 00 | 00 | 00 | 00 | 00 | 00 | 00 | 00 | 00 | 00 | 00 | 00 | 00 | 00 |
| F70 | 00 | 00 | 00 | 00 | 00 | 00 | 00 | 00 | 00 | 00 | 00 | 00 | 00 | 00 | 00 | 00 |
| F80 | 00 | 00 | 00 | 00 | 00 | 00 | 00 | 00 | 00 | 00 | 00 | 00 | 00 | 00 | 00 | 00 |
| F90 | 00 | 00 | 00 | 00 | 00 | 00 | 00 | 00 | 00 | 00 | 00 | 00 | 00 | 00 | 00 | 00 |
| FA0 | 00 | 00 | 00 | 00 | 00 | 00 | 00 | 00 | 00 | 00 | 00 | 00 | 00 | 00 | 00 | 00 |
| FB0 | 00 | 00 | 00 | 00 | 00 | 00 | 00 | 00 | 00 | 00 | 00 | 00 | 00 | 00 | 00 | 00 |
| FC0 | 00 | 00 | 00 | 00 | 00 | 00 | 00 | 00 | 00 | 00 | 00 | 00 | 00 | 00 | 00 | 00 |
| FD0 | 00 | 00 | 00 | 00 | 00 | 00 | 00 | 00 | 00 | 00 | 00 | 00 | 00 | 00 | 00 | 00 |
| FE0 | 00 | 00 | 00 | 00 | 00 | 00 | 00 | 00 | 00 | 00 | 00 | 00 | 00 | 00 | 00 | 00 |
| FF0 | 00 | 00 | 00 | 00 | 00 | 00 | 00 | 00 | 74 | 8D | 70 | 00 | 71 | CA | 70 | 00 |

Appendix B (c) Copyright 1982 Rusco Electronic Systems -- a division of Figge International, Inc. -- all rights reserved.

| | | | | | | | | | | | | | | | | |
|---|---|---|---|---|---|---|---|---|---|---|---|---|---|---|---|---|
| 00 | 8E | 00 | 7F | 7F | 00 | 80 | 86 | FF | B7 | 00 | 80 | FE | 40 | 2B | 8C | 12 |
| 10 | 34 | 27 | 2C | CE | 00 | 00 | 4F | A7 | 00 | 08 | 8C | 00 | 64 | 26 | F8 | CE |
| 20 | 40 | 00 | 6F | 00 | 08 | 8C | 70 | 00 | 26 | F8 | CE | 41 | 20 | FF | 40 | 30 |
| 30 | FF | 40 | 32 | FF | 40 | 34 | FF | 40 | 36 | CE | 12 | 34 | FF | 40 | 2B | CE |
| 40 | 40 | 00 | 6F | 00 | 08 | 8C | 40 | 2B | 26 | F8 | FE | 40 | 30 | BC | 40 | 32 |
| 50 | 27 | 03 | FF | 40 | 32 | FE | 40 | 34 | BC | 40 | 36 | 27 | 03 | FF | 40 | 36 |
| 60 | FE | 40 | 38 | BC | 40 | 3A | 27 | 03 | FF | 40 | 3A | BD | 70 | AC | 8D | 5B |
| 70 | BD | 78 | 87 | 86 | FF | B7 | 40 | 21 | 0E | 7F | 00 | 80 | 96 | 27 | 26 | 07 |

| | | | | | | | | | | | | | | | | |
|---|---|---|---|---|---|---|---|---|---|---|---|---|---|---|---|---|
| 00 | BD | 73 | 36 | 24 | F4 | 26 | F2 | 7F | 00 | 80 | BD | 71 | F6 | 96 | 27 | 26 |
| 10 | 0E | BD | 73 | 36 | 24 | F1 | 8D | 51 | BD | 77 | A2 | 8D | 0F | 20 | E8 | BD |
| 20 | 70 | F2 | BD | 73 | 36 | 24 | E0 | 26 | DE | 7E | 70 | 00 | CE | 40 | 01 | 86 |
| 30 | 68 | A7 | 00 | 08 | 08 | 08 | 8C | 40 | 16 | 26 | F6 | 09 | 09 | 86 | 06 | A7 |
| 40 | 00 | 4A | 09 | 09 | 09 | 8C | 3F | FF | 26 | F5 | 39 | CE | 00 | 0C | 6F | 00 |
| 50 | 08 | 8C | 00 | 64 | 26 | F8 | 86 | FF | CE | 00 | 07 | A7 | 86 | 09 | 8C | FF |
| 60 | FF | 26 | F8 | 8D | 04 | 36 | 7E | 72 | 57 | 7F | 00 | 27 | CE | FD | A8 | DF |
| 70 | 16 | 39 | 96 | 28 | 2A | 4B | 96 | 80 | 84 | 40 | 27 | 46 | 96 | 80 | 84 | 02 |

| | | | | | | | | | | | | | | | | |
|---|---|---|---|---|---|---|---|---|---|---|---|---|---|---|---|---|
| 00 | 26 | 3F | 96 | 80 | 84 | 01 | 26 | 3D | 7F | 00 | 28 | 96 | 5E | 84 | 04 | 27 |
| 10 | 0B | 96 | 5E | 84 | 03 | D6 | 3A | C4 | 03 | 11 | 26 | 1D | 96 | 5F | 84 | 0F |
| 20 | 91 | 39 | 26 | 15 | 96 | 5F | 44 | 44 | 44 | 44 | 91 | 38 | 26 | 0B | BD | 71 |
| 30 | 65 | 24 | 0B | CE | FF | EC | 7E | 76 | E7 | 86 | F0 | BD | 71 | 66 | 7E | 77 |
| 40 | 15 | 39 | 7E | 70 | FC | 96 | 23 | 26 | BF | 98 | 30 | 81 | 04 | 26 | F2 | BD |
| 50 | 7A | FD | BD | 7B | 44 | 25 | 09 | 7F | 00 | 28 | BD | 77 | 15 | 7E | 7B | 12 |
| 60 | BD | 7B | 31 | 20 | A3 | 4F | CE | 00 | 00 | AA | 33 | FF | 40 | 2E | 16 | BD |
| 70 | 71 | C4 | 24 | 2C | FE | 40 | 2E | 08 | A6 | 33 | 48 | 48 | 48 | 48 | 08 | 8C |

| | | | | | | | | | | | | | | | | |
|---|---|---|---|---|---|---|---|---|---|---|---|---|---|---|---|---|
| 00 | 00 | 06 | 26 | E5 | 0F | F6 | 40 | 27 | BD | 71 | C4 | F6 | 40 | 28 | 0E | BD |
| 10 | 71 | C4 | FE | 40 | 36 | FF | 40 | 34 | FE | 40 | 3A | FF | 40 | 38 | 0D | 39 |

| | | | | | | | | | | | | | | | |
|---|---|---|---|---|---|---|---|---|---|---|---|---|---|---|---|
| 20 | 7F | 00 | 28 | 39 | FE | 40 | 3A | 27 | 19 | 09 | FF | 40 | 3A | FE | 40 | 32 |
| 30 | E6 | 00 | 8C | 6F | FF | 26 | 05 | CE | 41 | 20 | 20 | 01 | 08 | FF | 40 | 32 |
| 40 | 0D | 39 | 0C | 39 | 7D | 40 | 3C | 26 | 29 | FE | 40 | 3A | 08 | FF | 40 | 3A |
| 50 | FE | 40 | 36 | E7 | 00 | 86 | FF | B7 | 40 | 3E | 8C | 6F | FF | 26 | 05 | CE |
| 60 | 41 | 20 | 20 | 01 | 08 | FF | 40 | 36 | BC | 40 | 32 | 26 | 07 | 86 | FF | B7 |
| 70 | 40 | 3C | 0C | 39 | 0D | 39 | 96 | 28 | 27 | 2E | 2B | 2C | 86 | 10 | 36 | 8D |
| 00 | 2C | 32 | 49 | DE | 52 | 08 | DF | 52 | 24 | F4 | F6 | 00 | E6 | 2A | 1A | D6 |
| 10 | 81 | C4 | 10 | 27 | 01 | 43 | 84 | 0F | DE | 54 | A7 | 00 | 08 | DF | 54 | 3C |
| 20 | 00 | 38 | 26 | 04 | 86 | FF | 97 | 28 | 39 | 7F | 00 | 08 | 39 | DE | 5C | A3 |
| 30 | 00 | 43 | CE | 00 | E7 | A7 | 00 | 44 | 09 | 8C | 00 | B3 | 26 | F7 | 00 | 43 |
| 40 | 44 | 09 | 25 | FC | 0F | 86 | FF | 97 | 2A | 0F | 00 | 01 | 01 | 01 | 01 | 01 |
| 50 | F6 | 00 | C7 | 96 | 2A | 36 | 0E | 86 | 0F | CE | 00 | E0 | A7 | 00 | 44 | 03 |
| 60 | 8C | 00 | E4 | 26 | F7 | 32 | 4D | 27 | C4 | 59 | 39 | B1 | 76 | B0 | E4 | E3 |
| 70 | 74 | D8 | E2 | 77 | E5 | 75 | D9 | E7 | 78 | 82 | E6 | 78 | 71 | B3 | D5 | 73 |
| 00 | 72 | B4 | D7 | D6 | E8 | E1 | E0 | D1 | D0 | D4 | 70 | 7F | 00 | 2A | 7A | 00 |
| 10 | 0A | 2A | 2E | 86 | 07 | 97 | 0A | 96 | 02 | 26 | 14 | 96 | 04 | 27 | 22 | 7F |
| 20 | 00 | 04 | 96 | 06 | 97 | 08 | 86 | 09 | 97 | 02 | 7F | 00 | 81 | 20 | 12 | 7A |
| 30 | 00 | 02 | 27 | 09 | 96 | 08 | 97 | 81 | 76 | 00 | 08 | 20 | 04 | 86 | FF | 97 |
| 40 | 81 | 96 | 01 | 27 | 61 | 96 | 03 | 27 | 32 | 2A | 41 | 43 | 27 | 15 | 7A | 00 |
| 50 | 0B | 26 | 62 | 86 | 08 | 97 | 0B | 96 | C6 | 49 | 76 | 00 | 09 | 24 | 56 | 7C |
| 60 | 00 | 03 | 3B | 7A | 00 | 0B | 26 | 4D | 7F | 00 | 03 | 96 | C6 | 2A | 2F | 96 |
| 70 | 05 | 26 | 42 | 73 | 00 | 05 | 96 | 09 | 97 | 07 | 3B | 96 | C6 | 2B | 36 | 86 |
| 00 | 03 | 97 | 0B | 86 | 01 | 97 | 03 | 86 | 80 | 97 | 09 | 3B | 96 | C6 | 2B | 0E |
| 10 | 7A | 00 | 0B | 26 | 20 | 86 | FE | 97 | 03 | 86 | 08 | 97 | 0B | 3B | 86 | 80 |
| 20 | 97 | 0B | 7F | 00 | 01 | 3B | 96 | C6 | 2A | F4 | 7A | 00 | 0B | 26 | 06 | 73 |
| 30 | 00 | 01 | 7F | 00 | 03 | 3B | 0C | 96 | 05 | 27 | 15 | 96 | 07 | 7F | 00 | 05 |
| 40 | 0D | 39 | 36 | 7F | 00 | 80 | 96 | 04 | 26 | FC | 32 | 97 | 06 | 73 | 00 | 04 |
| 50 | 39 | 96 | 25 | 27 | 15 | 2A | 1D | 43 | 27 | 08 | 8D | 37 | 25 | 20 | 7C | 00 |
| 60 | 25 | 39 | 8D | 2F | 25 | 14 | 7F | 00 | 25 | 39 | 8D | 13 | 24 | 10 | 97 | 31 |
| 70 | 7C | 00 | 25 | 39 | 8D | 1D | 24 | EE | 8D | 33 | 86 | FE | 97 | 25 | 39 | 4F |
| 00 | CE | 04 | E0 | E6 | 00 | 2A | 08 | 4C | 08 | 81 | 14 | 26 | F6 | 0C | 39 | 97 |
| 10 | 31 | 0D | 39 | CE | 04 | E0 | DF | 56 | 96 | 31 | 9B | 57 | 97 | 57 | 86 | 00 |
| 20 | 99 | 56 | 97 | 56 | DE | 56 | A6 | 00 | 0C | 2B | D3 | 0D | 39 | CE | 73 | F5 |
| 30 | DF | 56 | 96 | 31 | 9B | 57 | 97 | 57 | 86 | 00 | 99 | 56 | 97 | 56 | DE | 56 |
| 40 | A6 | 00 | 84 | 0F | 81 | 0A | 27 | 16 | 81 | 0B | 27 | 17 | D6 | 44 | D7 | 45 |
| 50 | D6 | 43 | D7 | 44 | D6 | 42 | D7 | 43 | 97 | 42 | 7C | 00 | 30 | 39 | 86 | FF |
| 60 | 97 | 2E | 39 | CE | 00 | 03 | 6F | 42 | 09 | 8C | FF | FF | 26 | F8 | 7F | 00 |
| 70 | 30 | 7F | 00 | 2E | 39 | 0A | 07 | 04 | 01 | 0F | 0F | 0F | 0F | 0B | 09 | 06 |
| 00 | 03 | 00 | 08 | 05 | 02 | 86 | FF | 97 | 80 | 97 | B0 | 7F | 00 | B0 | BD | 73 |
| 10 | 51 | 7A | 00 | 4F | 26 | 29 | BD | 75 | 60 | BD | 76 | 7F | BD | 76 | AD | BD |
| 20 | 75 | B6 | BD | 75 | FF | BD | 78 | 87 | 8D | 16 | BD | 74 | D8 | 8D | 31 | BD |
| 30 | 74 | A4 | BD | 75 | 20 | BD | 75 | 92 | BD | 77 | 56 | 86 | 1E | 97 | 4F | 3B |
| 40 | 96 | 80 | 84 | 04 | 27 | 19 | 96 | 20 | 27 | 0E | 2A | 13 | 43 | 27 | 10 | 96 |
| 50 | E7 | 2B | 0C | 86 | FF | 97 | 20 | 39 | 96 | E7 | 2A | 03 | 7C | 00 | 20 | 39 |
| 60 | 96 | 29 | 27 | 16 | 2A | 20 | 43 | 27 | 09 | 96 | E6 | 2B | 20 | 86 | FF | 97 |
| 70 | 29 | 39 | 96 | E6 | 2B | 29 | 7F | 00 | 29 | 39 | 4F | 97 | 28 | 96 | E6 | 2A |
| 00 | 0C | 86 | 01 | 97 | 29 | 39 | 96 | E6 | 2B | 04 | 7F | 00 | 29 | 39 | 86 | 01 |
| 10 | 97 | 28 | CE | 00 | 33 | DF | 54 | CE | 72 | 6B | DF | 52 | BD | 73 | E3 | 86 |
| 20 | FE | 97 | 29 | 39 | D6 | 82 | C4 | 01 | 27 | 12 | 96 | 00 | 27 | 0F | 2A | 1A |
| 30 | 43 | 27 | 17 | B6 | 68 | 07 | 2A | 1A | C6 | FF | D7 | 00 | 39 | 5F | D7 | 28 |
| 40 | B6 | 68 | 07 | 2B | 0D | C6 | 01 | D7 | 00 | 39 | B6 | 68 | 07 | 2A | 04 | 5F |
| 50 | D7 | 00 | 39 | C6 | FE | D7 | 00 | 39 | CE | 40 | 00 | C6 | 07 | F7 | 40 | 1A |

| | | | | | | | | | | | | | | | | |
|---|---|---|---|---|---|---|---|---|---|---|---|---|---|---|---|---|
| 60 | FF | 40 | 18 | 7A | 40 | 1A | 2B | 33 | A6 | 00 | 27 | 16 | 2A | 1F | 43 | 27 |
| 70 | 0D | EE | 01 | A6 | 00 | 2B | 16 | FE | 40 | 18 | 86 | FF | A7 | 00 | 0D | 56 |
| 00 | 20 | 10 | EE | 01 | A6 | 00 | 2A | F6 | FE | 40 | 18 | 6C | 00 | 0C | 56 | 20 |
| 10 | 01 | 54 | FE | 40 | 18 | 08 | 08 | 08 | 7E | 74 | E0 | 54 | F7 | 40 | 15 | 39 |
| 20 | 96 | 80 | 84 | 80 | 27 | 39 | 96 | 21 | 27 | 11 | 2A | 33 | 43 | 27 | 30 | 96 |
| 30 | C2 | 2B | 2C | 86 | FF | 97 | 21 | 7F | 00 | 24 | 39 | 96 | C2 | 2A | 1B | 96 |
| 40 | 82 | 84 | 10 | 27 | 07 | 96 | 24 | 26 | 03 | 8D | 0F | 39 | DE | 18 | 26 | 0F |
| 50 | CE | 00 | 18 | 96 | 60 | 4C | 48 | 7E | 77 | 36 | CE | 00 | 00 | DF | 18 | 39 |
| 60 | 96 | 80 | 84 | 20 | 27 | 20 | 96 | 26 | 27 | 15 | 2A | 1B | 43 | 27 | 08 | 96 |
| 70 | C1 | 2A | 13 | 7C | 00 | 26 | 39 | 96 | C1 | 2A | 10 | 7F | 00 | 26 | 39 | 96 |
| 00 | C1 | 2B | 03 | 7C | 00 | 26 | 39 | 96 | C1 | 2B | F0 | 86 | FE | 97 | 26 | 7E |
| 10 | 76 | E4 | 96 | 82 | 84 | 10 | 27 | 11 | 96 | 2D | 27 | 0E | 2A | 0B | 43 | 27 |
| 20 | 08 | D6 | C2 | 2B | 04 | 86 | FF | 97 | 2D | 39 | 96 | C2 | 2A | FB | 96 | 24 |
| 30 | 26 | F7 | 7C | 00 | 2D | 39 | CE | 00 | EC | 8D | 30 | 97 | 61 | CE | 00 | E0 |
| 40 | 8D | 29 | 97 | 60 | CE | 08 | E4 | 8D | 22 | 97 | 5E | CE | 00 | E8 | 8D | 1B |
| 50 | CE | 00 | F4 | 8D | 17 | 97 | 5F | CE | 00 | F0 | 8D | 0F | CE | 00 | FC | 8D |
| 60 | 0B | 97 | 63 | CE | 00 | F8 | 8D | 03 | 97 | 62 | 39 | 4F | E6 | 03 | 59 | 49 |
| 70 | E6 | 02 | 59 | 49 | E6 | 01 | 59 | 49 | E6 | 00 | 59 | 49 | 88 | 0F | 39 | CE |
| 00 | 00 | 00 | 6D | 0C | 27 | 23 | 6C | 0D | 26 | 1F | 6C | 0C | 26 | 1B | DF | 56 |
| 10 | D6 | 57 | CE | 76 | 31 | DF | 4E | DB | 4F | D7 | 4F | C6 | 00 | D9 | 4E | D7 |
| 20 | 4E | DE | 4E | EE | 00 | AD | 00 | DE | 56 | 08 | 08 | 8C | 00 | 14 | 26 | D2 |
| 30 | 39 | 76 | 45 | 76 | 72 | 76 | B7 | 76 | 8C | 76 | A5 | 76 | C3 | 76 | BC | 76 |
| 40 | D9 | 76 | D4 | 76 | DE | 86 | FF | 97 | 24 | 96 | 22 | 81 | 01 | 27 | 10 | 81 |
| 50 | FE | 27 | 0C | 96 | 61 | 26 | 0F | 96 | E6 | 2A | 17 | 86 | FF | 97 | 2B | 7F |
| 60 | 00 | 86 | 7F | 00 | 87 | 39 | 7F | 00 | 86 | 7F | 00 | 87 | CE | 00 | 0E | 7E |
| 70 | 77 | 36 | 96 | 22 | 81 | 01 | 27 | 5B | 81 | FE | 27 | 57 | 7E | 76 | FA | 96 |
| 00 | 2B | 27 | 50 | 96 | E6 | 2B | 4C | 7F | 00 | 2B | 20 | E6 | 96 | 61 | 26 | 0C |
| 10 | 96 | E6 | 2A | 11 | 86 | FF | 97 | 2C | 7F | 00 | 85 | 39 | 7F | 00 | 85 | CE |
| 20 | 00 | 14 | 7E | 77 | 36 | 86 | FF | 97 | 85 | 7F | 00 | 2C | 39 | 96 | 2C | 27 |
| 30 | 22 | 96 | E6 | 2B | 1E | 20 | EE | 86 | FF | 97 | 84 | 39 | 7C | 00 | 21 | 7C |
| 40 | 00 | 2D | 39 | 96 | 80 | 84 | 40 | 27 | 0A | 86 | FF | 97 | 27 | BD | 78 | 71 |
| 50 | 7F | 00 | 22 | 39 | 86 | FF | 97 | 83 | 39 | 86 | FF | 97 | 82 | 39 | 86 | FF |
| 60 | B7 | 68 | 08 | 39 | CE | FF | FE | DF | 0C | CE | 00 | 00 | DF | 0E | DF | 10 |
| 70 | 96 | 80 | 84 | 20 | 27 | 03 | 7F | 00 | 84 | 39 | CE | 00 | 00 | DF | 0C | DF |
| 00 | 0E | DF | 10 | 86 | FF | 97 | 86 | 97 | 87 | 4F | 97 | 24 | 96 | 60 | 4C | 48 |
| 10 | CE | 00 | 10 | 20 | 21 | 86 | FF | B7 | 40 | 21 | 96 | 80 | 84 | 10 | 27 | 15 |
| 20 | CE | 00 | 00 | DF | 12 | DF | 14 | CE | FF | FE | DF | 12 | 96 | 27 | 27 | 25 |
| 30 | CE | FF | EC | DF | 12 | 39 | 6F | 00 | 6F | 01 | 4D | 27 | 18 | DF | 5A | CE |
| 40 | FF | EC | DF | 5C | DE | 5A | E6 | 01 | DB | 5D | E7 | 01 | E6 | 00 | D9 | 5C |
| 50 | E7 | 00 | 4A | 26 | F1 | 39 | 7A | 40 | 2A | 26 | 46 | 86 | 14 | B7 | 40 | 2A |
| 60 | B6 | 40 | 26 | 26 | 3C | B6 | 40 | 29 | 8B | 01 | 19 | B7 | 40 | 29 | 81 | 60 |
| 70 | 26 | 2F | 86 | 02 | B7 | 40 | 29 | B6 | 40 | 28 | 8B | 01 | 19 | B7 | 40 | 28 |
| 00 | 16 | C4 | 0F | C1 | 05 | 26 | 03 | F7 | 40 | 21 | 81 | 60 | 26 | 13 | 7F | 40 |
| 10 | 28 | B6 | 40 | 27 | 8B | 01 | 19 | B7 | 40 | 27 | 81 | 24 | 26 | 03 | 7F | 40 |
| 20 | 27 | 39 | F6 | 40 | 25 | 26 | 3A | 44 | 44 | 44 | 44 | 48 | CE | 77 | C1 | DF |
| 30 | 50 | 9B | 51 | 97 | 51 | 86 | 00 | 99 | 50 | 97 | 50 | DE | 50 | EE | 00 | 6E |
| 40 | 00 | 78 | EA | 78 | 96 | 78 | 96 | 78 | D9 | 78 | 96 | 77 | 15 | 76 | E4 | 78 |
| 50 | 96 | 78 | 2E | 78 | 42 | 78 | 5D | 78 | 69 | 78 | 78 | 78 | 9C | 78 | B5 | 78 |
| 60 | C6 | F6 | 40 | 22 | 26 | 1B | 84 | 0F | 26 | 13 | 86 | FF | B7 | 40 | 27 | B7 |
| 70 | 40 | 28 | B7 | 40 | 26 | B7 | 40 | 21 | 43 | B7 | 40 | 25 | 39 | B7 | 40 | 22 |
| 00 | 39 | C6 | FF | F7 | 40 | 26 | FE | 40 | 23 | A7 | 00 | 08 | FF | 40 | 23 | 7A |
| 10 | 40 | 22 | 26 | 19 | CE | 40 | 1E | A6 | 00 | B7 | 40 | 27 | A6 | 01 | B7 | 40 |

| | | | | | | | | | | | | | | | |
|---|---|---|---|---|---|---|---|---|---|---|---|---|---|---|---|
| 20 | 28 | A6 | 02 | B7 | 40 | 29 | 4F | B7 | 40 | 25 | B7 | 40 | 26 | 39 | BD | 78 |
| 30 | E5 | 96 | 82 | 84 | 0C | 27 | 19 | C6 | 01 | F7 | 40 | 16 | 86 | FF | B7 | 40 |
| 40 | 17 | 39 | BD | 78 | E5 | 96 | 82 | 84 | 0C | 27 | 05 | 86 | FE | B7 | 40 | 16 |
| 50 | 39 | BD | 78 | E5 | 96 | 80 | 84 | 08 | 27 | 3C | 7E | 77 | 15 | BD | 78 | E5 |
| 60 | 96 | 80 | 84 | 08 | 27 | 30 | 7E | 76 | E4 | 8D | 7A | 96 | 80 | 84 | 08 | 27 |
| 70 | 25 | 86 | FF | 97 | 22 | 7E | 76 | FA | 8D | 6B | 96 | 80 | 84 | 08 | 27 | 16 |
| 00 | 86 | 01 | 97 | 22 | 7E | 76 | E4 | 96 | 80 | 84 | 01 | 27 | 09 | 96 | 62 | 84 |
| 10 | 01 | 27 | 04 | 7F | 00 | 23 | 39 | 86 | FE | 97 | 23 | 39 | 8D | 47 | 96 | 82 |
| 20 | 84 | 02 | 27 | 21 | 86 | 01 | B7 | 40 | 1D | 4F | B7 | 68 | 08 | 96 | 61 | CE |
| 30 | 00 | 1E | 7E | 77 | 36 | 8D | 2E | 96 | 82 | 84 | 02 | 27 | 08 | 4F | B7 | 68 |
| 40 | 08 | 4C | B7 | 40 | 1D | 39 | 8D | 1D | 96 | 82 | 84 | 02 | 27 | F7 | 86 | 55 |
| 50 | B7 | 40 | 1D | 86 | FF | B7 | 68 | 08 | 39 | 86 | FF | B7 | 40 | 25 | CE | 40 |
| 60 | 1E | FF | 40 | 23 | 39 | 86 | 10 | 7E | 7A | 2F | 01 | 96 | 20 | 27 | 3B | 2B |
| 70 | 08 | 73 | 00 | 20 | 86 | 80 | 7E | 7A | 0D | 43 | 26 | 2E | 7F | 00 | 20 | 86 |
| 00 | 80 | 7E | 7A | 0D | DE | 18 | 26 | 41 | 96 | 2D | 27 | 3D | 2B | 0C | 73 | 00 |
| 10 | 2D | 86 | 80 | BD | 73 | 42 | 4F | 7E | 73 | 42 | 43 | 26 | 2C | 7F | 00 | 2D |
| 20 | 86 | 80 | BD | 73 | 42 | 86 | 40 | 7E | 73 | 42 | 96 | 21 | 27 | D6 | 2B | 0B |
| 30 | 73 | 00 | 21 | 73 | 00 | 2D | 86 | 20 | 7E | 7A | 0D | 43 | 26 | C6 | 7F | 00 |
| 40 | 2D | 7F | 00 | 21 | 86 | 10 | 7E | 7A | 0D | B6 | 40 | 16 | 81 | 01 | 26 | 0D |
| 50 | 7F | 40 | 16 | 86 | 80 | BD | 73 | 42 | 86 | 81 | 7E | 73 | 42 | 81 | FE | 26 |
| 60 | 0D | 7C | 40 | 16 | 86 | 80 | BD | 73 | 42 | 86 | 82 | 7E | 73 | 42 | 96 | 82 |
| 70 | 84 | 0C | 27 | 69 | B6 | 40 | 16 | 26 | 64 | CE | 40 | 00 | C6 | 04 | 96 | 82 |
| 00 | 84 | 08 | 27 | 02 | C6 | 07 | F7 | 40 | 1B | 5F | 7A | 40 | 1B | 2B | 2C | 5C |
| 10 | A6 | 00 | 27 | 22 | 2B | 0E | 63 | 00 | 4F | 1B | 36 | 86 | 80 | BD | 73 | 42 |
| 20 | 32 | 7E | 73 | 42 | 43 | 26 | 0F | 6F | 00 | 86 | 40 | 1B | 36 | 86 | 80 | BD |
| 30 | 73 | 42 | 32 | 7E | 73 | 42 | 08 | 08 | 08 | 20 | CF | B6 | 40 | 17 | 27 | 1D |
| 40 | 7F | 40 | 17 | 86 | 80 | BD | 73 | 42 | 86 | 20 | BD | 73 | 42 | B6 | 40 | 15 |
| 50 | 84 | 7F | D6 | 82 | C4 | 08 | 26 | 57 | 84 | 0F | 7E | 73 | 42 | 96 | 22 | 27 |
| 60 | 13 | 2B | 07 | 73 | 00 | 22 | 86 | 40 | 20 | 23 | 43 | 26 | 07 | 7F | 00 | 22 |
| 70 | 86 | 30 | 20 | 19 | B6 | 40 | 1D | 81 | 01 | 26 | 07 | 86 | FE | B7 | 40 | 1D |
| 00 | 20 | 11 | 81 | 55 | 26 | 2C | 86 | FE | B7 | 40 | 1D | 20 | 0F | 36 | 8D | 19 |
| 10 | 32 | 20 | 1C | 86 | 80 | BD | 73 | 42 | 86 | 40 | 20 | 13 | 86 | 80 | BD | 73 |
| 20 | 42 | 86 | 44 | 20 | 0A | 86 | FF | 20 | 06 | 96 | 81 | 48 | 48 | 48 | 48 | 7E |
| 30 | 73 | 42 | 96 | 28 | 2A | 51 | 96 | 5E | 84 | 04 | 27 | 21 | 96 | 5E | 84 | 03 |
| 40 | D6 | 3A | C4 | 03 | 11 | 26 | 11 | 96 | 5F | 16 | 84 | 0F | 91 | 39 | 26 | 08 |
| 50 | 54 | 54 | 54 | 54 | D1 | 38 | 27 | 05 | CE | 00 | 00 | DF | 38 | 96 | 80 | 84 |
| 60 | 02 | 26 | 66 | 96 | 80 | 84 | 01 | 26 | 71 | 8D | BE | 4F | CE | 00 | 00 | AA |
| 70 | 33 | 8D | BC | 08 | A6 | 33 | 48 | 48 | 48 | 48 | 08 | 8C | 00 | 08 | 26 | EF |
| 00 | 7F | 00 | 28 | 39 | 7E | 7A | 25 | BD | 71 | A4 | 24 | 2A | 86 | 03 | B7 | 40 |
| 10 | 2D | 86 | 70 | BD | 73 | 42 | 17 | BD | 73 | 42 | BD | 71 | A4 | 17 | BD | 73 |
| 20 | 42 | 7A | 40 | 2D | 2A | F4 | 7F | 40 | 3C | FE | 40 | 32 | FF | 40 | 30 | FE |
| 30 | 40 | 3A | FF | 40 | 38 | 39 | B6 | 40 | 21 | 27 | C9 | 86 | 30 | BD | 73 | 42 |
| 40 | 86 | 01 | BD | 73 | 42 | 7F | 40 | 21 | 39 | 96 | 2E | 27 | B7 | 8D | 9A | 96 |
| 50 | 43 | 48 | 48 | 48 | 48 | 9A | 42 | 7E | 73 | 42 | 96 | 23 | 26 | 8B | 96 | 30 |
| 60 | 81 | 04 | 26 | A0 | 86 | 50 | BD | 73 | 42 | 8D | 12 | BD | 7B | 44 | 25 | 07 |
| 70 | 8D | 20 | 86 | F0 | 7E | 7A | 6C | 8D | 38 | 4F | 7E | 7A | 6C | CE | 00 | 06 |
| 00 | A6 | 33 | A1 | 3B | 27 | 03 | 7F | 00 | 2F | A7 | 3B | 09 | 8C | 00 | 01 | 26 |
| 10 | EF | 39 | 96 | 81 | 84 | 40 | 27 | 18 | 7C | 00 | 2F | 96 | 62 | 44 | 84 | 07 |
| 20 | 4C | 91 | 2F | 26 | 0B | 7F | 00 | 82 | 7F | 00 | 2F | CE | FF | C4 | DF | 1A |
| 30 | 39 | 96 | 81 | 84 | 20 | 27 | 0C | 96 | 2E | 27 | 08 | 7F | 00 | 83 | CE | FF |
| 40 | C4 | DF | 1C | 39 | 8D | 20 | 7F | 00 | 58 | CE | 00 | 00 | A6 | 46 | DF | 50 |

| | | | | | | | | | | | | | | | | |
|---|---|---|---|---|---|---|---|---|---|---|---|---|---|---|---|---|
| 50 | 97 | 59 | DE | 58 | A6 | 33 | DE | 50 | A1 | 42 | 26 | 08 | 08 | 8C | 00 | 04 |
| 60 | 26 | EA | 0D | 39 | 0C | 39 | 96 | 63 | 44 | 44 | 44 | 44 | 44 | 97 | 32 | 4F |
| 70 | C6 | 04 | CE | 00 | 4A | 91 | 32 | 26 | 01 | 4C | A7 | 00 | 08 | 4C | 5A | 26 |
| 00 | F4 | 7F | 00 | 58 | 96 | 63 | 44 | 44 | 44 | 84 | 03 | 97 | 59 | DE | 58 | A6 |
| 10 | 4A | 97 | 49 | 43 | A7 | 4A | 96 | 63 | 44 | 84 | 03 | 97 | 59 | DE | 58 | A6 |
| 20 | 4A | 2A | 01 | 43 | 97 | 48 | 43 | A7 | 4A | CE | 00 | 49 | 08 | A6 | 00 | 2B |
| 30 | FB | 97 | 47 | 08 | A6 | 00 | 2B | FB | 97 | 46 | 96 | 63 | 84 | 01 | 27 | 08 |
| 40 | 96 | 47 | D6 | 46 | 97 | 46 | D7 | 47 | 39 | 00 | 00 | 00 | 00 | 00 | 00 | 00 |
| 50 | 00 | 00 | 00 | 00 | 00 | 00 | 00 | 00 | 00 | 00 | 00 | 00 | 00 | 00 | 00 | 00 |
| 60 | 00 | 00 | 00 | 00 | 00 | 00 | 00 | 00 | 00 | 00 | 00 | 00 | 00 | 00 | 00 | 00 |
| 70 | 00 | 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 | 00 | 00 |
| 10 | 00 | 00 | 00 | 00 | 00 | 00 | 00 | 00 | 00 | 00 | 00 | 00 | 00 | 00 | 00 | 00 |
| 20 | 00 | 00 | 00 | 00 | 00 | 00 | 00 | 00 | 00 | 00 | 00 | 00 | 00 | 00 | 00 | 00 |
| 30 | 00 | 00 | 00 | 00 | 00 | 00 | 00 | 00 | 00 | 00 | 00 | 00 | 00 | 00 | 00 | 00 |
| 40 | 00 | 00 | 00 | 00 | 00 | 00 | 00 | 00 | 00 | 00 | 00 | 00 | 00 | 00 | 00 | 00 |
| 50 | 00 | 00 | 00 | 00 | 00 | 00 | 00 | 00 | 00 | 00 | 00 | 00 | 00 | 00 | 00 | 00 |
| 60 | 00 | 00 | 00 | 00 | 00 | 00 | 00 | 00 | 00 | 00 | 00 | 00 | 00 | 00 | 00 | 00 |
| 70 | 00 | 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 | 00 | 00 |
| 10 | 00 | 00 | 00 | 00 | 00 | 00 | 00 | 00 | 00 | 00 | 00 | 00 | 00 | 00 | 00 | 00 |
| 20 | 00 | 00 | 00 | 00 | 00 | 00 | 00 | 00 | 00 | 00 | 00 | 00 | 00 | 00 | 00 | 00 |
| 30 | 00 | 00 | 00 | 00 | 00 | 00 | 00 | 00 | 00 | 00 | 00 | 00 | 00 | 00 | 00 | 00 |
| 40 | 00 | 00 | 00 | 00 | 00 | 00 | 00 | 00 | 00 | 00 | 00 | 00 | 00 | 00 | 00 | 00 |
| 50 | 00 | 00 | 00 | 00 | 00 | 00 | 00 | 00 | 00 | 00 | 00 | 00 | 00 | 00 | 00 | 00 |
| 60 | 00 | 00 | 00 | 00 | 00 | 00 | 00 | 00 | 00 | 00 | 00 | 00 | 00 | 00 | 00 | 00 |
| 70 | 00 | 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 | 00 | 00 |
| 10 | 00 | 00 | 00 | 00 | 00 | 00 | 00 | 00 | 00 | 00 | 00 | 00 | 00 | 00 | 00 | 00 |
| 20 | 00 | 00 | 00 | 00 | 00 | 00 | 00 | 00 | 00 | 00 | 00 | 00 | 00 | 00 | 00 | 00 |
| 30 | 00 | 00 | 00 | 00 | 00 | 00 | 00 | 00 | 00 | 00 | 00 | 00 | 00 | 00 | 00 | 00 |
| 40 | 00 | 00 | 00 | 00 | 00 | 00 | 00 | 00 | 00 | 00 | 00 | 00 | 00 | 00 | 00 | 00 |
| 50 | 00 | 00 | 00 | 00 | 00 | 00 | 00 | 00 | 00 | 00 | 00 | 00 | 00 | 00 | 00 | 00 |
| 60 | 00 | 00 | 00 | 00 | 00 | 00 | 00 | 00 | 00 | 00 | 00 | 00 | 00 | 00 | 00 | 00 |
| 70 | 00 | 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 | 00 | 00 |
| 10 | 00 | 00 | 00 | 00 | 00 | 00 | 00 | 00 | 00 | 00 | 00 | 00 | 00 | 00 | 00 | 00 |
| 20 | 00 | 00 | 00 | 00 | 00 | 00 | 00 | 00 | 00 | 00 | 00 | 00 | 00 | 00 | 00 | 00 |
| 30 | 00 | 00 | 00 | 00 | 00 | 00 | 00 | 00 | 00 | 00 | 00 | 00 | 00 | 00 | 00 | 00 |
| 40 | 00 | 00 | 00 | 00 | 00 | 00 | 00 | 00 | 00 | 00 | 00 | 00 | 00 | 00 | 00 | 00 |
| 50 | 00 | 00 | 00 | 00 | 00 | 00 | 00 | 00 | 00 | 00 | 00 | 00 | 00 | 00 | 00 | 00 |
| 60 | 00 | 00 | 00 | 00 | 00 | 00 | 00 | 00 | 00 | 00 | 00 | 00 | 00 | 00 | 00 | 00 |
| 70 | 00 | 00 | 00 | 00 | 00 | 00 | 00 | 00 | 00 | 00 | 00 | 00 | 00 | 00 | 00 | 00 |
| 00 | 00 | 00 | 00 | 00 | 00 | 00 | 00 | 00 | 00 | 00 | 00 | 00 | 00 | 00 | 00 | 00 |
| 10 | 00 | 00 | 00 | 00 | 00 | 00 | 00 | 00 | 00 | 00 | 00 | 00 | 00 | 00 | 00 | 00 |
| 20 | 00 | 00 | 00 | 00 | 00 | 00 | 00 | 00 | 00 | 00 | 00 | 00 | 00 | 00 | 00 | 00 |
| 30 | 00 | 00 | 00 | 00 | 00 | 00 | 00 | 00 | 00 | 00 | 00 | 00 | 00 | 00 | 00 | 00 |
| 40 | 00 | 00 | 00 | 00 | 00 | 00 | 00 | 00 | 00 | 00 | 00 | 00 | 00 | 00 | 00 | 00 |
| 50 | 00 | 00 | 00 | 00 | 00 | 00 | 00 | 00 | 00 | 00 | 00 | 00 | 00 | 00 | 00 | 00 |
| 60 | 00 | 00 | 00 | 00 | 00 | 00 | 00 | 00 | 00 | 00 | 00 | 00 | 00 | 00 | 00 | 00 |
| 70 | 00 | 00 | 00 | 00 | 00 | 00 | 00 | 00 | 00 | 00 | 00 | 00 | 00 | 00 | 00 | 00 |

| | | | | | | | | | | | | | | | | |
|---|---|---|---|---|---|---|---|---|---|---|---|---|---|---|---|---|
| 00 | 00 | 00 | 00 | 00 | 00 | 00 | 00 | 00 | 00 | 00 | 00 | 00 | 00 | 00 | 00 | 00 |
| 10 | 00 | 00 | 00 | 00 | 00 | 00 | 00 | 00 | 00 | 00 | 00 | 00 | 00 | 00 | 00 | 00 |
| 20 | 00 | 00 | 00 | 00 | 00 | 00 | 00 | 00 | 00 | 00 | 00 | 00 | 00 | 00 | 00 | 00 |
| 30 | 00 | 00 | 00 | 00 | 00 | 00 | 00 | 00 | 00 | 00 | 00 | 00 | 00 | 00 | 00 | 00 |
| 40 | 00 | 00 | 00 | 00 | 00 | 00 | 00 | 00 | 00 | 00 | 00 | 00 | 00 | 00 | 00 | 00 |
| 50 | 00 | 00 | 00 | 00 | 00 | 00 | 00 | 00 | 00 | 00 | 00 | 00 | 00 | 00 | 00 | 00 |
| 60 | 00 | 00 | 00 | 00 | 00 | 00 | 00 | 00 | 00 | 00 | 00 | 00 | 00 | 00 | 00 | 00 |
| 70 | 00 | 00 | 00 | 00 | 00 | 00 | 00 | 00 | 00 | 00 | 00 | 00 | 00 | 00 | 00 | 00 |

| | | | | | | | | | | | | | | | | |
|---|---|---|---|---|---|---|---|---|---|---|---|---|---|---|---|---|
| 00 | 00 | 00 | 00 | 00 | 00 | 00 | 00 | 00 | 00 | 00 | 00 | 00 | 00 | 00 | 00 | 00 |
| 10 | 00 | 00 | 00 | 00 | 00 | 00 | 00 | 00 | 00 | 00 | 00 | 00 | 00 | 00 | 00 | 00 |
| 20 | 00 | 00 | 00 | 00 | 00 | 00 | 00 | 00 | 00 | 00 | 00 | 00 | 00 | 00 | 00 | 00 |
| 30 | 00 | 00 | 00 | 00 | 00 | 00 | 00 | 00 | 00 | 00 | 00 | 00 | 00 | 00 | 00 | 00 |
| 40 | 00 | 00 | 00 | 00 | 00 | 00 | 00 | 00 | 00 | 00 | 00 | 00 | 00 | 00 | 00 | 00 |
| 50 | 00 | 00 | 00 | 00 | 00 | 00 | 00 | 00 | 00 | 00 | 00 | 00 | 00 | 00 | 00 | 00 |
| 60 | 00 | 00 | 00 | 00 | 00 | 00 | 00 | 00 | 00 | 00 | 00 | 00 | 00 | 00 | 00 | 00 |
| 70 | 00 | 00 | 00 | 00 | 00 | 00 | 00 | 00 | 00 | 00 | 00 | 00 | 00 | 00 | 00 | 00 |

| | | | | | | | | | | | | | | | | |
|---|---|---|---|---|---|---|---|---|---|---|---|---|---|---|---|---|
| 00 | 00 | 00 | 00 | 00 | 00 | 00 | 00 | 00 | 00 | 00 | 00 | 00 | 00 | 00 | 00 | 00 |
| 10 | 00 | 00 | 00 | 00 | 00 | 00 | 00 | 00 | 00 | 00 | 00 | 00 | 00 | 00 | 00 | 00 |
| 20 | 00 | 00 | 00 | 00 | 00 | 00 | 00 | 00 | 00 | 00 | 00 | 00 | 00 | 00 | 00 | 00 |
| 30 | 00 | 00 | 00 | 00 | 00 | 00 | 00 | 00 | 00 | 00 | 00 | 00 | 00 | 00 | 00 | 00 |
| 40 | 00 | 00 | 00 | 00 | 00 | 00 | 00 | 00 | 00 | 00 | 00 | 00 | 00 | 00 | 00 | 00 |
| 50 | 00 | 00 | 00 | 00 | 00 | 00 | 00 | 00 | 00 | 00 | 00 | 00 | 00 | 00 | 00 | 00 |
| 60 | 00 | 00 | 00 | 00 | 00 | 00 | 00 | 00 | 00 | 00 | 00 | 00 | 00 | 00 | 00 | 00 |
| 70 | 00 | 00 | 00 | 00 | 00 | 00 | 00 | 00 | 74 | 05 | 70 | 00 | 72 | 8B | 70 | 00 |

Appendix C (c) Copyright 1982 Rusco Electronic Systems -- a division of Figge International, Inc.--all rights reserved.

| | | | | | | | | | | | | | | | | |
|---|---|---|---|---|---|---|---|---|---|---|---|---|---|---|---|---|
| 000 | 8E | 00 | 7F | 7F | 00 | 80 | 86 | FF | B7 | 00 | 80 | CE | 00 | 00 | 4F | A7 |
| 010 | 00 | 08 | 8C | 00 | 64 | 26 | F8 | CE | 60 | 00 | 4F | A7 | 00 | 08 | 8C | 60 |
| 020 | 1E | 26 | F8 | BD | 70 | 5E | 8D | 55 | BD | 76 | F4 | 0E | 7F | 00 | 80 | 96 |
| 030 | 27 | 26 | 07 | BD | 72 | 4A | 24 | F4 | 26 | F2 | 7F | 00 | 80 | BD | 71 | 0A |
| 040 | 96 | 27 | 26 | 0E | BD | 72 | 4A | 24 | F1 | 8D | 50 | BD | 76 | 62 | 8D | 0E |
| 050 | 20 | E8 | BD | 70 | A4 | BD | 72 | 4A | 24 | E0 | 26 | DE | 20 | A2 | CE | 60 |
| 060 | 01 | 86 | 68 | A7 | 00 | 08 | 08 | 08 | 8C | 60 | 16 | 26 | F6 | 09 | 09 | 86 |
| 070 | 06 | A7 | 00 | 4A | 09 | 09 | 09 | 8C | 5F | FF | 26 | F5 | 39 | CE | 00 | 0C |
| 080 | 6F | 00 | 08 | 8C | 00 | 64 | 26 | F8 | 86 | FF | CE | 00 | 07 | A7 | 86 | 09 |
| 090 | 8C | FF | FF | 26 | F8 | 8D | 04 | 36 | 7E | 71 | 6B | 7F | 00 | 27 | CE | FD |
| 0A0 | A8 | DF | 16 | 39 | 96 | 28 | 2A | 41 | 96 | 80 | 84 | 40 | 27 | 3B | 96 | 80 |
| 0B0 | 84 | 02 | 26 | 35 | 96 | 80 | 84 | 01 | 26 | 30 | 7F | 00 | 28 | 96 | 5E | 84 |
| 0C0 | 04 | 27 | 0B | 96 | 5E | 84 | 03 | D6 | 3A | C4 | 03 | 11 | 26 | 18 | 96 | 5F |
| 0D0 | 84 | 0F | 91 | 39 | 26 | 10 | 96 | 5F | 44 | 44 | 44 | 44 | 91 | 38 | 26 | 06 |
| 0E0 | CE | FF | EC | 7E | 75 | F8 | 7E | 76 | 26 | 39 | 96 | 23 | 26 | CC | 96 | 30 |
| 0F0 | 81 | 04 | 26 | F5 | BD | 79 | 15 | BD | 79 | 5C | 25 | 09 | 7F | 00 | 28 | BD |
| 100 | 76 | 26 | 7E | 79 | 2A | BD | 79 | 49 | 20 | B0 | 96 | 28 | 27 | 2E | 2B | 2C |
| 110 | 86 | 10 | 36 | 8D | 2C | 32 | 49 | DE | 52 | 08 | DF | 52 | 24 | F4 | F6 | 00 |
| 120 | E6 | 2A | 1A | D6 | 81 | C4 | 10 | 27 | 01 | 43 | 84 | 0F | DE | 54 | A7 | 00 |
| 130 | 08 | DF | 54 | 8C | 00 | 3B | 26 | 04 | 86 | FF | 97 | 28 | 39 | 7F | 00 | 28 |
| 140 | 39 | DE | 52 | A6 | 00 | 43 | CE | 00 | E7 | A7 | 00 | 44 | 09 | 8C | 00 | E3 |
| 150 | 26 | F7 | 08 | 43 | 44 | 09 | 25 | FC | 0F | 86 | FF | 97 | 2A | 6F | 00 | 01 |
| 160 | 01 | 01 | 01 | 01 | F6 | 00 | C7 | 96 | 2A | 36 | 0E | 86 | 0F | CE | 00 | E0 |
| 170 | A7 | 00 | 44 | 08 | 8C | 00 | E4 | 26 | F7 | 32 | 4D | 27 | C4 | 59 | 39 | B1 |
| 180 | 76 | B0 | E4 | E3 | 74 | D8 | E2 | 77 | E5 | 75 | D9 | E7 | 78 | B2 | E6 | 79 |
| 190 | 71 | B3 | D5 | 73 | 72 | B4 | D7 | D6 | E8 | E1 | E0 | D1 | D0 | D4 | 70 | 7F |

| | | | | | | | | | | | | | | | | |
|---|---|---|---|---|---|---|---|---|---|---|---|---|---|---|---|---|
| 1A0 | 00 | 2A | 7A | 00 | 0A | 2A | 2E | 86 | 07 | 97 | 0A | 96 | 02 | 26 | 14 | 96 |
| 1B0 | 04 | 27 | 22 | 7F | 00 | 04 | 96 | 06 | 97 | 08 | 86 | 09 | 97 | 02 | 7F | 00 |
| 1C0 | 81 | 20 | 12 | 7A | 00 | 02 | 27 | 09 | 96 | 08 | 97 | 81 | 76 | 00 | 08 | 20 |
| 1D0 | 04 | 86 | FF | 97 | 81 | 96 | 01 | 27 | 61 | 96 | 03 | 27 | 32 | 2A | 41 | 43 |
| 1E0 | 27 | 15 | 7A | 00 | 0B | 26 | 62 | 86 | 08 | 97 | 0B | 96 | C6 | 49 | 76 | 00 |
| 1F0 | 09 | 24 | 56 | 7C | 00 | 03 | 3B | 7A | 00 | 0B | 26 | 4D | 7F | 00 | 03 | 96 |
| 200 | C6 | 2A | 2F | 96 | 05 | 26 | 42 | 73 | 00 | 05 | 96 | 09 | 97 | 07 | 3B | 96 |
| 210 | C6 | 2B | 36 | 86 | 03 | 97 | 0B | 86 | 01 | 97 | 03 | 86 | 80 | 97 | 09 | 3B |
| 220 | 96 | C6 | 2B | 0E | 7A | 00 | 0B | 26 | 20 | 86 | FE | 97 | 03 | 86 | 08 | 97 |
| 230 | 0B | 3B | 86 | 80 | 97 | 0B | 7F | 00 | 01 | 3B | 96 | C6 | 2A | F4 | 7A | 00 |
| 240 | 0B | 26 | 06 | 73 | 00 | 01 | 7F | 00 | 03 | 3B | 0C | 96 | 05 | 27 | 15 | 96 |
| 250 | 07 | 7F | 00 | 05 | 0D | 39 | 36 | 7F | 00 | 80 | 96 | 04 | 26 | FC | 32 | 97 |
| 260 | 06 | 73 | 00 | 04 | 39 | 96 | 25 | 27 | 15 | 2A | 1D | 43 | 27 | 08 | 8D | 37 |
| 270 | 25 | 20 | 7C | 00 | 25 | 39 | 8D | 2F | 25 | 14 | 7F | 00 | 25 | 39 | 8D | 13 |
| 280 | 24 | 10 | 97 | 31 | 7C | 00 | 25 | 39 | 8D | 1D | 24 | EE | 8D | 33 | 86 | FE |
| 290 | 97 | 25 | 39 | 4F | CE | 04 | E0 | E6 | 00 | 2A | 08 | 4C | 08 | 81 | 14 | 26 |
| 2A0 | F6 | 0C | 39 | 97 | 31 | 0D | 39 | CE | 04 | E0 | DF | 56 | 86 | 31 | 9B | 57 |
| 2B0 | 97 | 57 | 86 | 00 | 99 | 56 | 97 | 56 | DE | 56 | A6 | 00 | 0C | 2B | D3 | 0D |
| 2C0 | 39 | CE | 73 | 09 | DF | 56 | 96 | 31 | 9B | 57 | 97 | 57 | 86 | 00 | 99 | 56 |
| 2D0 | 97 | 56 | DE | 56 | A6 | 00 | 84 | 0F | 81 | 0A | 27 | 16 | 81 | 0B | 27 | 17 |
| 2E0 | D6 | 44 | D7 | 45 | D6 | 43 | D7 | 44 | D6 | 42 | D7 | 43 | 97 | 42 | 7C | 00 |
| 2F0 | 30 | 39 | 86 | FF | 97 | 2E | 39 | CE | 00 | 03 | 6F | 42 | 09 | 8C | FF | FF |
| 300 | 26 | F8 | 7F | 00 | 30 | 7F | 00 | 2E | 39 | 0A | 07 | 04 | 01 | 0F | 0F | 0F |
| 310 | 0F | 0B | 09 | 06 | 03 | 00 | 08 | 05 | 02 | 86 | FF | 97 | 80 | 97 | B0 | 7F |
| 320 | 00 | B0 | BD | 72 | 65 | 7A | 00 | 4F | 26 | 26 | BD | 74 | 71 | BD | 75 | 90 |
| 330 | BD | 75 | BE | BD | 74 | C7 | BD | 75 | 10 | BD | 76 | F4 | 8D | 13 | BD | 73 |
| 340 | E9 | 8D | 2E | BD | 73 | B5 | BD | 74 | 31 | BD | 74 | A3 | 86 | 1E | 97 | 4F |
| 350 | 3B | 96 | 80 | 84 | 04 | 27 | 19 | 96 | 20 | 27 | 0E | 2A | 13 | 43 | 27 | 10 |
| 360 | 96 | E7 | 2B | 0C | 86 | FF | 97 | 20 | 39 | 96 | E7 | 2A | 03 | 7C | 00 | 20 |
| 370 | 39 | 96 | 29 | 27 | 16 | 2A | 20 | 43 | 27 | 09 | 96 | E6 | 2B | 20 | 86 | FF |
| 380 | 97 | 29 | 39 | 96 | E6 | 2B | 29 | 7F | 00 | 29 | 39 | 4F | 97 | 28 | 96 | E6 |
| 390 | 2A | 0C | 86 | 01 | 97 | 29 | 39 | 96 | E6 | 2B | 04 | 7F | 00 | 29 | 39 | 86 |
| 3A0 | 01 | 97 | 28 | CE | 00 | 33 | DF | 54 | CE | 71 | 7F | DF | 52 | BD | 72 | F7 |
| 400 | 27 | 0D | EE | 01 | A6 | 00 | 2B | 16 | FE | 60 | 18 | 86 | FF | A7 | 00 | 0D |
| 410 | 56 | 20 | 10 | EE | 01 | A6 | 00 | 2A | F6 | FE | 60 | 18 | 6C | 00 | 0C | 56 |
| 420 | 20 | 01 | 54 | FE | 60 | 18 | 08 | 08 | 08 | 7E | 73 | F1 | 54 | F7 | 60 | 15 |
| 430 | 39 | 96 | 80 | 84 | 80 | 27 | 39 | 96 | 21 | 27 | 11 | 2A | 33 | 43 | 27 | 30 |
| 440 | 96 | C2 | 2B | 2C | 86 | FF | 97 | 21 | 7F | 00 | 24 | 39 | 96 | C2 | 2A | 1B |
| 450 | 96 | 82 | 84 | 10 | 27 | 07 | 96 | 24 | 26 | 03 | 8D | 0F | 39 | DE | 18 | 26 |
| 460 | 0F | CE | 00 | 18 | 96 | 60 | 4C | 48 | 7E | 76 | 42 | CE | 00 | 00 | DF | 18 |
| 470 | 39 | 96 | 80 | 84 | 20 | 27 | 20 | 96 | 26 | 27 | 15 | 2A | 1B | 43 | 27 | 08 |
| 480 | 96 | C1 | 2A | 13 | 7C | 00 | 26 | 39 | 96 | C1 | 2A | 10 | 7F | 00 | 26 | 39 |
| 490 | 96 | C1 | 2B | 03 | 7C | 00 | 26 | 39 | 96 | C1 | 2B | F0 | 86 | FE | 97 | 26 |
| 4A0 | 7E | 75 | F5 | 96 | 82 | 84 | 10 | 27 | 11 | 96 | 2D | 27 | 0E | 2A | 0B | 43 |
| 4B0 | 27 | 08 | D6 | C2 | 2B | 04 | 86 | FF | 97 | 2D | 39 | 96 | C2 | 2A | FB | 96 |
| 4C0 | 24 | 26 | F7 | 7C | 00 | 2D | 39 | CE | 00 | EC | 8D | 30 | 97 | 61 | CE | 00 |
| 4D0 | E0 | 8D | 29 | 97 | 60 | CE | 08 | E4 | 8D | 22 | 97 | 5E | CE | 00 | E8 | 8D |
| 4E0 | 1B | CE | 00 | F4 | 8D | 17 | 97 | 5F | CE | 00 | F0 | 8D | 0F | CE | 00 | FC |
| 4F0 | 8D | 0B | 97 | 63 | CE | 00 | F8 | 8D | 03 | 97 | 62 | 39 | 4F | E6 | 03 | 59 |
| 500 | 49 | E6 | 02 | 59 | 49 | E6 | 01 | 59 | 49 | E6 | 00 | 59 | 49 | 88 | 0F | 39 |
| 510 | CE | 00 | 00 | 6D | 0C | 27 | 23 | 6C | 0D | 26 | 1F | 6C | 0C | 26 | 1B | DF |
| 520 | 56 | D6 | 57 | CE | 75 | 42 | DF | 4E | DB | 4F | D7 | 4F | C6 | 00 | D9 | 4E |
| 530 | D7 | 4E | DE | 4E | EE | 00 | AD | 00 | DE | 56 | 08 | 08 | 8C | 00 | 14 | 26 |
| 540 | D2 | 39 | 75 | 56 | 75 | 83 | 75 | C8 | 75 | 9D | 75 | B6 | 75 | D4 | 75 | CD |
| 550 | 75 | EA | 75 | E5 | 75 | EF | 86 | FF | 97 | 24 | 96 | 22 | 81 | 01 | 27 | 10 |
| 560 | 81 | FE | 27 | 0C | 96 | 61 | 26 | 0F | 96 | E6 | 2A | 17 | 86 | FF | 97 | 2B |

| | | | | | | | | | | | | | | | | |
|---|---|---|---|---|---|---|---|---|---|---|---|---|---|---|---|---|
| 570 | 7F | 00 | 86 | 7F | 00 | 87 | 39 | 7F | 00 | 86 | 7F | 00 | 87 | CE | 00 | 0E |
| 580 | 7E | 76 | 42 | 96 | 22 | 81 | 01 | 27 | 5B | 81 | FE | 27 | 57 | 7E | 76 | 0B |
| 590 | 96 | 2B | 27 | 50 | 96 | E6 | 2B | 4C | 7F | 00 | 2B | 20 | E6 | 96 | 61 | 26 |
| 5A0 | 0C | 96 | E6 | 2A | 11 | 86 | FF | 97 | 2C | 7F | 00 | 85 | 39 | 7F | 00 | 85 |
| 5B0 | CE | 00 | 14 | 7E | 76 | 42 | 86 | FF | 97 | 85 | 7F | 00 | 2C | 39 | 96 | 2C |
| 5C0 | 27 | 22 | 96 | E6 | 2B | 1E | 20 | EE | 86 | FF | 97 | 84 | 39 | 7C | 00 | 21 |
| 5D0 | 7C | 00 | 2D | 39 | 96 | 80 | 84 | 40 | 27 | 0A | 86 | FF | 97 | 27 | BD | 76 |
| 5E0 | DE | 7F | 00 | 22 | 39 | 86 | FF | 97 | 83 | 39 | 86 | FF | 97 | 82 | 39 | 86 |
| 5F0 | FF | B7 | 68 | 08 | 39 | CE | FF | FE | DF | 0C | CE | 00 | 00 | DF | 0E | DF |
| 600 | 10 | 96 | 80 | 84 | 20 | 27 | 03 | 7F | 00 | 84 | 39 | CE | 00 | 00 | DF | 0C |
| 610 | DF | 0E | DF | 10 | 86 | FF | 97 | 86 | 97 | 87 | 4F | 97 | 24 | 96 | 60 | 4C |
| 620 | 48 | CE | 00 | 10 | 20 | 1C | 96 | 80 | 84 | 10 | 27 | 15 | CE | 00 | 00 | DF |
| 630 | 12 | DF | 14 | CE | FF | FE | DF | 12 | 96 | 27 | 27 | 25 | CE | FF | EC | DF |
| 640 | 12 | 39 | 6F | 00 | 6F | 01 | 4D | 27 | 18 | DF | 5A | CE | FF | EC | DF | 5C |
| 650 | DE | 5A | E6 | 01 | DB | 5D | E7 | 01 | E6 | 00 | D9 | 5C | E7 | 00 | 4A | 26 |
| 660 | F1 | 39 | 44 | 44 | 44 | 44 | 48 | CE | 76 | 7C | DF | 50 | 9B | 51 | 97 | 51 |
| 670 | 86 | 00 | 99 | 50 | 97 | 50 | DE | 50 | EE | 00 | 6E | 00 | 77 | 4B | 77 | 03 |
| 680 | 77 | 03 | 77 | 03 | 77 | 03 | 76 | 26 | 75 | F5 | 77 | 03 | 76 | 9C | 76 | B0 |
| 690 | 76 | CB | 76 | D6 | 76 | E5 | 77 | 09 | 77 | 22 | 77 | 33 | BD | 77 | 46 | 96 |
| 6A0 | 82 | 84 | 0C | 27 | 19 | C6 | 01 | F7 | 60 | 16 | 86 | FF | B7 | 60 | 17 | 39 |
| 6B0 | BD | 77 | 46 | 96 | 82 | 84 | 0C | 27 | 05 | 86 | FE | B7 | 60 | 16 | 39 | BD |
| 6C0 | 77 | 46 | 96 | 80 | 84 | 08 | 27 | 3B | 7E | 76 | 26 | 8D | 79 | 96 | 80 | 84 |
| 6D0 | 08 | 27 | 30 | 7E | 75 | F5 | 8D | 6E | 96 | 80 | 84 | 08 | 27 | 25 | 86 | FF |
| 6E0 | 97 | 22 | 7E | 76 | 0B | 8D | 5F | 96 | 80 | 84 | 08 | 27 | 16 | 86 | 01 | 97 |
| 6F0 | 22 | 7E | 75 | F5 | 96 | 80 | 84 | 01 | 27 | 09 | 96 | 62 | 84 | 01 | 27 | 04 |
| 700 | 7F | 00 | 23 | 39 | 86 | FE | 97 | 23 | 39 | 8D | 3B | 96 | 82 | 84 | 02 | 27 |
| 710 | 21 | 86 | 01 | B7 | 60 | 1D | 4F | B7 | 68 | 08 | 96 | 61 | CE | 00 | 1E | 7E |
| 720 | 76 | 42 | 8D | 22 | 96 | 82 | 84 | 02 | 27 | 08 | 4F | B7 | 68 | 08 | 4C | B7 |
| 730 | 60 | 1D | 39 | 8D | 11 | 96 | 82 | 84 | 02 | 27 | F7 | 86 | 55 | B7 | 60 | 1D |
| 740 | 86 | FF | B7 | 68 | 08 | 39 | 86 | 10 | 7E | 78 | 90 | 01 | 96 | 20 | 27 | 3B |
| 750 | 2B | 08 | 73 | 00 | 20 | 86 | 80 | 7E | 78 | 6E | 43 | 26 | 2E | 7F | 00 | 20 |
| 760 | 86 | 80 | 7E | 78 | 6E | DE | 18 | 26 | 41 | 96 | 2D | 27 | 3D | 2B | 0C | 73 |
| 770 | 00 | 2D | 86 | 80 | BD | 72 | 56 | 4F | 7E | 72 | 56 | 43 | 26 | 2C | 7F | 00 |
| 780 | 2D | 86 | 80 | BD | 72 | 56 | 86 | 40 | 7E | 72 | 56 | 96 | 21 | 27 | D6 | 2B |
| 790 | 0B | 73 | 00 | 21 | 73 | 00 | 2D | 86 | 20 | 7E | 78 | 6E | 43 | 26 | C6 | 7F |
| 7A0 | 00 | 2D | 7F | 00 | 21 | 86 | 10 | 7E | 78 | 6E | B6 | 60 | 16 | 81 | 01 | 26 |
| 7B0 | 0D | 7F | 60 | 16 | 86 | 80 | BD | 72 | 56 | 86 | 81 | 7E | 72 | 56 | 81 | FE |
| 7C0 | 26 | 0D | 7C | 60 | 16 | 86 | 80 | BD | 72 | 56 | 86 | 82 | 7E | 72 | 56 | 96 |
| 7D0 | 82 | 84 | 0C | 27 | 69 | B6 | 60 | 16 | 26 | 64 | CE | 60 | 00 | C6 | 04 | 96 |
| 7E0 | 82 | 84 | 08 | 27 | 02 | C6 | 07 | F7 | 60 | 1B | 5F | 7A | 60 | 1B | 2B | 2C |
| 7F0 | 5C | A6 | 00 | 27 | 22 | 2B | 0E | 63 | 00 | 4F | 1B | 36 | 86 | 80 | BD | 72 |
| 800 | 56 | 32 | 7E | 72 | 56 | 43 | 26 | 0F | 6F | 00 | 86 | 40 | 1B | 36 | 86 | 80 |
| 810 | BD | 72 | 56 | 32 | 7E | 72 | 56 | 08 | 08 | 08 | 20 | CF | B6 | 60 | 17 | 27 |
| 820 | 1D | 7F | 60 | 17 | 86 | 80 | BD | 72 | 56 | 86 | 20 | BD | 72 | 56 | B6 | 60 |
| 830 | 15 | 84 | 7F | D6 | 82 | C4 | 08 | 26 | 57 | 84 | 0F | 7E | 72 | 56 | 96 | 22 |
| 840 | 27 | 13 | 2B | 07 | 73 | 00 | 22 | 86 | 40 | 20 | 23 | 43 | 26 | 07 | 7F | 00 |
| 850 | 22 | 86 | 30 | 20 | 19 | B6 | 60 | 1D | 81 | 01 | 26 | 07 | 86 | FE | B7 | 60 |
| 860 | 1D | 20 | 11 | 81 | 55 | 26 | 2C | 86 | FE | B7 | 60 | 1D | 20 | 0F | 36 | 8D |
| 870 | 19 | 32 | 20 | 1C | 86 | 80 | BD | 72 | 56 | 86 | 40 | 20 | 13 | 86 | 80 | BD |
| 880 | 72 | 56 | 86 | 44 | 20 | 0A | 86 | FF | 20 | 06 | 96 | 81 | 48 | 48 | 48 | 48 |
| 890 | 7E | 72 | 56 | 96 | 28 | 2A | EF | 96 | 5E | 84 | 04 | 27 | 21 | 96 | 5E | 84 |
| 8A0 | 03 | D6 | 3A | C4 | 03 | 11 | 26 | 11 | 96 | 5F | 16 | 84 | 0F | 91 | 39 | 26 |
| 8B0 | 08 | 54 | 54 | 54 | 54 | D1 | 38 | 27 | 05 | CE | 00 | 00 | DF | 38 | 96 | 80 |
| 8C0 | 84 | 02 | 26 | 21 | 96 | 80 | 84 | 01 | 26 | 2B | 8D | BE | 4F | CE | 00 | 00 |
| 8D0 | AA | 33 | 8D | BC | 08 | A6 | 33 | 48 | 48 | 48 | 48 | 08 | 8C | 00 | 08 | 26 |
| 8E0 | EF | 7F | 00 | 28 | 39 | 96 | 2E | 27 | 9D | 8D | DF | 96 | 43 | 48 | 48 | 48 |

| | | | | | | | | | | | | | | | | |
|---|---|---|---|---|---|---|---|---|---|---|---|---|---|---|---|---|
| 8F0 | 48 | 9A | 42 | 20 | 9B | 96 | 23 | 26 | D1 | 96 | 30 | 81 | 04 | 26 | 87 | 86 |
| 900 | 50 | 8D | 8D | 8D | 10 | BD | 79 | 5C | 25 | 06 | 8D | 1E | 86 | F0 | 20 | BD |
| 910 | 8D | 37 | 4F | 20 | B8 | CE | 00 | 06 | A6 | 33 | A1 | 3B | 27 | 03 | 7F | 00 |
| 920 | 2F | A7 | 3B | 09 | 8C | 00 | 01 | 26 | EF | 39 | 96 | 81 | 84 | 40 | 27 | 18 |
| 930 | 7C | 00 | 2F | 96 | 62 | 44 | 84 | 07 | 4C | 91 | 2F | 26 | 0B | 7F | 00 | 82 |
| 940 | 7F | 00 | 2F | CE | FF | C4 | DF | 1A | 39 | 96 | 81 | 84 | 20 | 27 | 0C | 96 |
| 950 | 2E | 27 | 08 | 7F | 00 | 83 | CE | FF | C4 | DF | 1C | 39 | 8D | 20 | 7F | 00 |
| 960 | 58 | CE | 00 | 00 | A6 | 46 | DF | 50 | 97 | 59 | DE | 58 | A6 | 33 | DE | 50 |
| 970 | A1 | 42 | 26 | 08 | 08 | 8C | 00 | 04 | 26 | EA | 0D | 39 | 0C | 39 | 96 | 63 |
| 980 | 44 | 44 | 44 | 44 | 44 | 97 | 32 | 4F | C6 | 04 | CE | 00 | 4A | 91 | 32 | 26 |
| 990 | 01 | 4C | A7 | 00 | 08 | 4C | 5A | 26 | F4 | 7F | 00 | 58 | 96 | 63 | 44 | 44 |
| 9A0 | 44 | 84 | 03 | 97 | 59 | DE | 58 | A6 | 4A | 97 | 49 | 43 | A7 | 4A | 96 | 63 |
| 9B0 | 44 | 84 | 03 | 97 | 59 | DE | 58 | A6 | 4A | 2A | 01 | 43 | 97 | 48 | 43 | A7 |
| 9C0 | 4A | CE | 00 | 49 | 08 | A6 | 00 | 2B | FB | 97 | 47 | 08 | A6 | 00 | 2B | FB |
| 9D0 | 97 | 46 | 96 | 63 | 84 | 01 | 27 | 08 | 96 | 47 | D6 | 46 | 97 | 46 | D7 | 47 |
| 9E0 | 39 | 00 | 00 | 00 | 00 | 00 | 00 | 00 | 00 | 00 | 00 | 00 | 00 | 00 | 00 | 00 |
| 9F0 | 00 | 00 | 00 | 00 | 00 | 00 | 00 | 00 | 00 | 00 | 00 | 00 | 00 | 00 | 00 | 00 |
| A00 | 00 | 00 | 00 | 00 | 00 | 00 | 00 | 00 | 00 | 00 | 00 | 00 | 00 | 00 | 00 | 00 |
| A10 | 00 | 00 | 00 | 00 | 00 | 00 | 00 | 00 | 00 | 00 | 00 | 00 | 00 | 00 | 00 | 00 |
| A20 | 00 | 00 | 00 | 00 | 00 | 00 | 00 | 00 | 00 | 00 | 00 | 00 | 00 | 00 | 00 | 00 |
| A30 | 00 | 00 | 00 | 00 | 00 | 00 | 00 | 00 | 00 | 00 | 00 | 00 | 00 | 00 | 00 | 00 |
| A40 | 00 | 00 | 00 | 00 | 00 | 00 | 00 | 00 | 00 | 00 | 00 | 00 | 00 | 00 | 00 | 00 |
| A50 | 00 | 00 | 00 | 00 | 00 | 00 | 00 | 00 | 00 | 00 | 00 | 00 | 00 | 00 | 00 | 00 |
| A60 | 00 | 00 | 00 | 00 | 00 | 00 | 00 | 00 | 00 | 00 | 00 | 00 | 00 | 00 | 00 | 00 |
| A70 | 00 | 00 | 00 | 00 | 00 | 00 | 00 | 00 | 00 | 00 | 00 | 00 | 00 | 00 | 00 | 00 |
| A80 | 00 | 00 | 00 | 00 | 00 | 00 | 00 | 00 | 00 | 00 | 00 | 00 | 00 | 00 | 00 | 00 |
| A90 | 00 | 00 | 00 | 00 | 00 | 00 | 00 | 00 | 00 | 00 | 00 | 00 | 00 | 00 | 00 | 00 |
| AA0 | 00 | 00 | 00 | 00 | 00 | 00 | 00 | 00 | 00 | 00 | 00 | 00 | 00 | 00 | 00 | 00 |
| AB0 | 00 | 00 | 00 | 00 | 00 | 00 | 00 | 00 | 00 | 00 | 00 | 00 | 00 | 00 | 00 | 00 |
| AC0 | 00 | 00 | 00 | 00 | 00 | 00 | 00 | 00 | 00 | 00 | 00 | 00 | 00 | 00 | 00 | 00 |
| AD0 | 00 | 00 | 00 | 00 | 00 | 00 | 00 | 00 | 00 | 00 | 00 | 00 | 00 | 00 | 00 | 00 |
| AE0 | 00 | 00 | 00 | 00 | 00 | 00 | 00 | 00 | 00 | 00 | 00 | 00 | 00 | 00 | 00 | 00 |
| AF0 | 00 | 00 | 00 | 00 | 00 | 00 | 00 | 00 | 00 | 00 | 00 | 00 | 00 | 00 | 00 | 00 |
| B00 | 00 | 00 | 00 | 00 | 00 | 00 | 00 | 00 | 00 | 00 | 00 | 00 | 00 | 00 | 00 | 00 |
| B10 | 00 | 00 | 00 | 00 | 00 | 00 | 00 | 00 | 00 | 00 | 00 | 00 | 00 | 00 | 00 | 00 |
| B20 | 00 | 00 | 00 | 00 | 00 | 00 | 00 | 00 | 00 | 00 | 00 | 00 | 00 | 00 | 00 | 00 |
| B30 | 00 | 00 | 00 | 00 | 00 | 00 | 00 | 00 | 00 | 00 | 00 | 00 | 00 | 00 | 00 | 00 |
| B40 | 00 | 00 | 00 | 00 | 00 | 00 | 00 | 00 | 00 | 00 | 00 | 00 | 00 | 00 | 00 | 00 |
| B50 | 00 | 00 | 00 | 00 | 00 | 00 | 00 | 00 | 00 | 00 | 00 | 00 | 00 | 00 | 00 | 00 |
| B60 | 00 | 00 | 00 | 00 | 00 | 00 | 00 | 00 | 00 | 00 | 00 | 00 | 00 | 00 | 00 | 00 |
| B70 | 00 | 00 | 00 | 00 | 00 | 00 | 00 | 00 | 00 | 00 | 00 | 00 | 00 | 00 | 00 | 00 |
| B80 | 00 | 00 | 00 | 00 | 00 | 00 | 00 | 00 | 00 | 00 | 00 | 00 | 00 | 00 | 00 | 00 |
| B90 | 00 | 00 | 00 | 00 | 00 | 00 | 00 | 00 | 00 | 00 | 00 | 00 | 00 | 00 | 00 | 00 |
| BA0 | 00 | 00 | 00 | 00 | 00 | 00 | 00 | 00 | 00 | 00 | 00 | 00 | 00 | 00 | 00 | 00 |
| BB0 | 00 | 00 | 00 | 00 | 00 | 00 | 00 | 00 | 00 | 00 | 00 | 00 | 00 | 00 | 00 | 00 |
| BC0 | 00 | 00 | 00 | 00 | 00 | 00 | 00 | 00 | 00 | 00 | 00 | 00 | 00 | 00 | 00 | 00 |
| BD0 | 00 | 00 | 00 | 00 | 00 | 00 | 00 | 00 | 00 | 00 | 00 | 00 | 00 | 00 | 00 | 00 |
| BE0 | 00 | 00 | 00 | 00 | 00 | 00 | 00 | 00 | 00 | 00 | 00 | 00 | 00 | 00 | 00 | 00 |
| BF0 | 00 | 00 | 00 | 00 | 00 | 00 | 00 | 00 | 00 | 00 | 00 | 00 | 00 | 00 | 00 | 00 |
| C00 | 00 | 00 | 00 | 00 | 00 | 00 | 00 | 00 | 00 | 00 | 00 | 00 | 00 | 00 | 00 | 00 |
| C10 | 00 | 00 | 00 | 00 | 00 | 00 | 00 | 00 | 00 | 00 | 00 | 00 | 00 | 00 | 00 | 00 |
| C20 | 00 | 00 | 00 | 00 | 00 | 00 | 00 | 00 | 00 | 00 | 00 | 00 | 00 | 00 | 00 | 00 |
| C30 | 00 | 00 | 00 | 00 | 00 | 00 | 00 | 00 | 00 | 00 | 00 | 00 | 00 | 00 | 00 | 00 |
| C40 | 00 | 00 | 00 | 00 | 00 | 00 | 00 | 00 | 00 | 00 | 00 | 00 | 00 | 00 | 00 | 00 |
| C50 | 00 | 00 | 00 | 00 | 00 | 00 | 00 | 00 | 00 | 00 | 00 | 00 | 00 | 00 | 00 | 00 |
| C60 | 00 | 00 | 00 | 00 | 00 | 00 | 00 | 00 | 00 | 00 | 00 | 00 | 00 | 00 | 00 | 00 |
| C70 | 00 | 00 | 00 | 00 | 00 | 00 | 00 | 00 | 00 | 00 | 00 | 00 | 00 | 00 | 00 | 00 |

| | | | | | | | | | | | | | | | | |
|---|---|---|---|---|---|---|---|---|---|---|---|---|---|---|---|---|
| C80 | 00 | 00 | 00 | 00 | 00 | 00 | 00 | 00 | 00 | 00 | 00 | 00 | 00 | 00 | 00 | 00 |
| C90 | 00 | 00 | 00 | 00 | 00 | 00 | 00 | 00 | 00 | 00 | 00 | 00 | 00 | 00 | 00 | 00 |
| CA0 | 00 | 00 | 00 | 00 | 00 | 00 | 00 | 00 | 00 | 00 | 00 | 00 | 00 | 00 | 00 | 00 |
| CB0 | 00 | 00 | 00 | 00 | 00 | 00 | 00 | 00 | 00 | 00 | 00 | 00 | 00 | 00 | 00 | 00 |
| CC0 | 00 | 00 | 00 | 00 | 00 | 00 | 00 | 00 | 00 | 00 | 00 | 00 | 00 | 00 | 00 | 00 |
| CD0 | 00 | 00 | 00 | 00 | 00 | 00 | 00 | 00 | 00 | 00 | 00 | 00 | 00 | 00 | 00 | 00 |
| CE0 | 00 | 00 | 00 | 00 | 00 | 00 | 00 | 00 | 00 | 00 | 00 | 00 | 00 | 00 | 00 | 00 |
| CF0 | 00 | 00 | 00 | 00 | 00 | 00 | 00 | 00 | 00 | 00 | 00 | 00 | 00 | 00 | 00 | 00 |
| D00 | 00 | 00 | 00 | 00 | 00 | 00 | 00 | 00 | 00 | 00 | 00 | 00 | 00 | 00 | 00 | 00 |
| D10 | 00 | 00 | 00 | 00 | 00 | 00 | 00 | 00 | 00 | 00 | 00 | 00 | 00 | 00 | 00 | 00 |
| D20 | 00 | 00 | 00 | 00 | 00 | 00 | 00 | 00 | 00 | 00 | 00 | 00 | 00 | 00 | 00 | 00 |
| D30 | 00 | 00 | 00 | 00 | 00 | 00 | 00 | 00 | 00 | 00 | 00 | 00 | 00 | 00 | 00 | 00 |
| D40 | 00 | 00 | 00 | 00 | 00 | 00 | 00 | 00 | 00 | 00 | 00 | 00 | 00 | 00 | 00 | 00 |
| D50 | 00 | 00 | 00 | 00 | 00 | 00 | 00 | 00 | 00 | 00 | 00 | 00 | 00 | 00 | 00 | 00 |
| D60 | 00 | 00 | 00 | 00 | 00 | 00 | 00 | 00 | 00 | 00 | 00 | 00 | 00 | 00 | 00 | 00 |
| D70 | 00 | 00 | 00 | 00 | 00 | 00 | 00 | 00 | 00 | 00 | 00 | 00 | 00 | 00 | 00 | 00 |
| D80 | 00 | 00 | 00 | 00 | 00 | 00 | 00 | 00 | 00 | 00 | 00 | 00 | 00 | 00 | 00 | 00 |
| D90 | 00 | 00 | 00 | 00 | 00 | 00 | 00 | 00 | 00 | 00 | 00 | 00 | 00 | 00 | 00 | 00 |
| DA0 | 00 | 00 | 00 | 00 | 00 | 00 | 00 | 00 | 00 | 00 | 00 | 00 | 00 | 00 | 00 | 00 |
| DB0 | 00 | 00 | 00 | 00 | 00 | 00 | 00 | 00 | 00 | 00 | 00 | 00 | 00 | 00 | 00 | 00 |
| DC0 | 00 | 00 | 00 | 00 | 00 | 00 | 00 | 00 | 00 | 00 | 00 | 00 | 00 | 00 | 00 | 00 |
| DD0 | 00 | 00 | 00 | 00 | 00 | 00 | 00 | 00 | 00 | 00 | 00 | 00 | 00 | 00 | 00 | 00 |
| DE0 | 00 | 00 | 00 | 00 | 00 | 00 | 00 | 00 | 00 | 00 | 00 | 00 | 00 | 00 | 00 | 00 |
| DF0 | 00 | 00 | 00 | 00 | 00 | 00 | 00 | 00 | 00 | 00 | 00 | 00 | 00 | 00 | 00 | 00 |
| E00 | 00 | 00 | 00 | 00 | 00 | 00 | 00 | 00 | 00 | 00 | 00 | 00 | 00 | 00 | 00 | 00 |
| E10 | 00 | 00 | 00 | 00 | 00 | 00 | 00 | 00 | 00 | 00 | 00 | 00 | 00 | 00 | 00 | 00 |
| E20 | 00 | 00 | 00 | 00 | 00 | 00 | 00 | 00 | 00 | 00 | 00 | 00 | 00 | 00 | 00 | 00 |
| E30 | 00 | 00 | 00 | 00 | 00 | 00 | 00 | 00 | 00 | 00 | 00 | 00 | 00 | 00 | 00 | 00 |
| E40 | 00 | 00 | 00 | 00 | 00 | 00 | 00 | 00 | 00 | 00 | 00 | 00 | 00 | 00 | 00 | 00 |
| E50 | 00 | 00 | 00 | 00 | 00 | 00 | 00 | 00 | 00 | 00 | 00 | 00 | 00 | 00 | 00 | 00 |
| E60 | 00 | 00 | 00 | 00 | 00 | 00 | 00 | 00 | 00 | 00 | 00 | 00 | 00 | 00 | 00 | 00 |
| E70 | 00 | 00 | 00 | 00 | 00 | 00 | 00 | 00 | 00 | 00 | 00 | 00 | 00 | 00 | 00 | 00 |
| E80 | 00 | 00 | 00 | 00 | 00 | 00 | 00 | 00 | 00 | 00 | 00 | 00 | 00 | 00 | 00 | 00 |
| E90 | 00 | 00 | 00 | 00 | 00 | 00 | 00 | 00 | 00 | 00 | 00 | 00 | 00 | 00 | 00 | 00 |
| EA0 | 00 | 00 | 00 | 00 | 00 | 00 | 00 | 00 | 00 | 00 | 00 | 00 | 00 | 00 | 00 | 00 |
| EB0 | 00 | 00 | 00 | 00 | 00 | 00 | 00 | 00 | 00 | 00 | 00 | 00 | 00 | 00 | 00 | 00 |
| EC0 | 00 | 00 | 00 | 00 | 00 | 00 | 00 | 00 | 00 | 00 | 00 | 00 | 00 | 00 | 00 | 00 |
| ED0 | 00 | 00 | 00 | 00 | 00 | 00 | 00 | 00 | 00 | 00 | 00 | 00 | 00 | 00 | 00 | 00 |
| EE0 | 00 | 00 | 00 | 00 | 00 | 00 | 00 | 00 | 00 | 00 | 00 | 00 | 00 | 00 | 00 | 00 |
| EF0 | 00 | 00 | 00 | 00 | 00 | 00 | 00 | 00 | 00 | 00 | 00 | 00 | 00 | 00 | 00 | 00 |
| F00 | 00 | 00 | 00 | 00 | 00 | 00 | 00 | 00 | 00 | 00 | 00 | 00 | 00 | 00 | 00 | 00 |
| F10 | 00 | 00 | 00 | 00 | 00 | 00 | 00 | 00 | 00 | 00 | 00 | 00 | 00 | 00 | 00 | 00 |
| F20 | 00 | 00 | 00 | 00 | 00 | 00 | 00 | 00 | 00 | 00 | 00 | 00 | 00 | 00 | 00 | 00 |
| F30 | 00 | 00 | 00 | 00 | 00 | 00 | 00 | 00 | 00 | 00 | 00 | 00 | 00 | 00 | 00 | 00 |
| F40 | 00 | 00 | 00 | 00 | 00 | 00 | 00 | 00 | 00 | 00 | 00 | 00 | 00 | 00 | 00 | 00 |
| F50 | 00 | 00 | 00 | 00 | 00 | 00 | 00 | 00 | 00 | 00 | 00 | 00 | 00 | 00 | 00 | 00 |
| F60 | 00 | 00 | 00 | 00 | 00 | 00 | 00 | 00 | 00 | 00 | 00 | 00 | 00 | 00 | 00 | 00 |
| F70 | 00 | 00 | 00 | 00 | 00 | 00 | 00 | 00 | 00 | 00 | 00 | 00 | 00 | 00 | 00 | 00 |
| F80 | 00 | 00 | 00 | 00 | 00 | 00 | 00 | 00 | 00 | 00 | 00 | 00 | 00 | 00 | 00 | 00 |
| F90 | 00 | 00 | 00 | 00 | 00 | 00 | 00 | 00 | 00 | 00 | 00 | 00 | 00 | 00 | 00 | 00 |
| FA0 | 00 | 00 | 00 | 00 | 00 | 00 | 00 | 00 | 00 | 00 | 00 | 00 | 00 | 00 | 00 | 00 |
| FB0 | 00 | 00 | 00 | 00 | 00 | 00 | 00 | 00 | 00 | 00 | 00 | 00 | 00 | 00 | 00 | 00 |
| FC0 | 00 | 00 | 00 | 00 | 00 | 00 | 00 | 00 | 00 | 00 | 00 | 00 | 00 | 00 | 00 | 00 |
| FD0 | 00 | 00 | 00 | 00 | 00 | 00 | 00 | 00 | 00 | 00 | 00 | 00 | 00 | 00 | 00 | 00 |
| FE0 | 00 | 00 | 00 | 00 | 00 | 00 | 00 | 00 | 00 | 00 | 00 | 00 | 00 | 00 | 00 | 00 |
| FF0 | 00 | 00 | 00 | 00 | 00 | 00 | 00 | 00 | 73 | 19 | 70 | 00 | 71 | 9F | 70 | 00 |

What is claimed is:

1. A card reader for use in a security system having a central controller which communicates with said card reader, said card reader comprising:

a memory;

means for reading data stored permanently on cards;

means for evaluating data from the cards independent of the central controller, and for selectively permitting access to a controlled location in response to the evaluation of the data from the cards, with the card data remaining unchanged on the cards;

means for receiving signals from said central controller;

means coupled to said receiving means for sensing when communication with said central controller is lost; and means responsive to said sensing means for storing said data from said reading means in said memory during times when communication with said central controller is lost.

2. An apparatus as defined in claim 1 wherein said central controller periodically polls said card reader and wherein said sensing means senses when communications with said central controller is lost by absence of polls for a predetermined time.

3. An apparatus as defined in claim 1 further comprising means for keeping the local time at said card reader and for synchronizing it with time kept by said central controller.

4. An apparatus as defined in claim 1 wherein the means for permitting physical access comprises authorization means coupled to said reading means for granting or denying access to a controlled location based upon data read from said card.

5. An apparatus as defined in claim 4 wherein said storing means includes means to inhibit storage of data from card reading transactions when authorization is denied.

6. An apparatus as defined in claim 1, additionally comprising:

means for determining whether said memory is full, and means for inhibiting said storing means when said memory is full.

7. An apparatus as defined in claim 6 further comprising means for authorizing access to a controlled location in response to data read from said card, wherein said authorization means includes means for ignoring data from said reading means when said storing means is full.

8. An apparatus as defined in claim 7 further including means for determining the time of day, wherein said storing means stores the time of day with said data from said reading means when said card is read.

9. An apparatus as defined in claim 8 wherein said authorization means includes means for generating a first signal when authorization is granted and a second signal when authorization is denied.

10. An apparatus as defined in claim 1 further comprising means for transmitting the data stored by said means for storing to said central controller when communication is restored.

11. An apparatus as defined in claim 10 wherein said central controller polls said card reader, and wherein said means for transmitting transmits data for one card reading transaction from said means for storing at the time of each said poll from said central controller.

12. An apparatus as defined in claim 4 wherein said card contains a first portion of data and a second portion of data and said authorization means includes means for granting or denying authorization based upon one of said first and second portions of data only.

13. An apparatus as defined in claim 12 wherein said means for storing, stores the other of said first and second portions of data only.

14. An apparatus as defined in claim 13 wherein said means for storing includes means for storing the local time at the time said second portion of data is read.

15. A method of operating a security system which controls access to a location and which includes a local card reader and a central controller which communicate to limit access based on card data, comprising:

reading data stored on a card;

evaluating the data from the card independently from the central controller;

permitting access to a controlled location in response to the evaluation of the data from the card, with the card data remaining unchanged on the card;

sensing at said local card reader for inablity to communicate with said central controller;

storing card data at said local card reader during periods of inability to communicate;

transmitting stored card data from said local card reader to said central controller when communication is possible; and receiving control signals from the central controller.

16. A method, as defined in claim 15, additionally comprising:

storing the time of day with said card data at said local card reader.

17. A card reader as defined in claim 1, further comprising:

means for controlling whether data from the reading means is to be stored in the memory during times when communication with the central controller is lost; and means for controlling whether access to the controlled location is to be permitted when communication with the central controller is lost.

18. A card reader as defined in claim 1, further comprising:

means for monitoring the condition of devices external to the card reader; and means for generating data indicating the condition of the external devices for transmission to the central controller.

19. A card reader as defined in claim 18, further comprising switch means for electrically connecting the card reader to additional external devices in response to signals received from the central controller, wherein the additional external devices may comprise such things as alarms or emergency signaling devices.

20. A method of operating a security system as defined in claim 15, further comprising the steps of:

maintaining local time data at the card reader; and synchronizing said time data with the time kept by the central controller.

21. A method of operating a security system as defined in claim 20 wherein the step of synchronizing the local time comprises keeping the local time offset from the time at the central controller by a predetermined amount.

22. A method of operating a security system as defined in claim 15, wherein the step of storing card data comprises the steps of:

sensing a control condition indicating whether data from the card is to be stored at the local card reader when communication with the central controller is lost; and storing said card data when the control condition indicates that said card data should be stored.

23. A method of operating a security system as defined in claim 15 wherein the step of permitting physical access to a controlled location comprises the steps of:

sensing a control condition indicating whether access to the controlled location is to be permitted when communication with the central controller is lost; and providing a signal which permits physical access to the controlled location when the control condition indicates that such access should be permitted.

24. A method of operating a security system as defined in claim 15, further comprising the steps of:

monitoring the condition of devices external to the card reader; and generating data indicating the condition of the external devices for transmission to the central controller.

25. A method of operating a security system as defined in claim 24, further comprising the step of electrically connecting the card reader to additional external devices in response to signals received from the central controller, wherein the additional external devices may comprise such things as alarms or emergency signaling devices.

26. A card reader as defined in claim 1, wherein the security system includes a plurality of said card readers, and wherein the central controller and each card reader are electrically connected so as to each define an electrical communication system, each said card reader further comprising means for sending the data read from the card to the central controller at a time controlled by the electrical communication system associated with the card reader.

27. A method of operating a security system as defined in claim 15, wherein the reading step comprises reading data stored on cards inserted in the card reader with read cycles initiated at a rate determined by frequency of card insertions at said reader, and wherein the transmitting step is performed at a rate determined by the card reader and the central controller.

28. A method of operating a security system as defined in claim 15, wherein the step of evaluating data from the card comprises comparing data from the card with authorization data provided in the card reader, and wherein the step of permitting access to a controlled area comprises generating an authorization signal when the compared data corresponds to said authorization data.

29. A card reader for use in a security system having a central controller and a plurality of said card readers, wherein the central controller and each card reader are electrically connected so as to each define an electrical communication system, each said card reader comprising:

a memory;

means for reading data stored permanently on a card, wherein said data is organized on said card so as to define first and second data segments;

means for storing data read from said cards in said memory;

means for sending data from said memory to said central controller at a time controlled by said electrical communication system;

means for receiving signals from said central controller;

means for selectively permitting access to a controlled area in response to said signals from the central controller;

means for storing at least one authorization code;

a local buffer;

means coupled to said receiving means for sensing that ability to communicate with said central controller is lost;

means for comparing a selected one of said first and second data segments with said authorization code;

means for granting or denying access to said controlled area independent of signals from the central controller in response to said comparison of one of said first and second data segment with said authorization code, while said ability to communicate with the central controller is lost;

means for storing the other of said first and second data segments in said local buffer during periods when said ability to communicate with the central controller is lost;

means coupled to said receiving means for sensing that said ability to communicate with the central controller is restored; and means for transmitting the data stored in said local buffer to said central controller at a time controlled by said electrical communication system, when said ability to communicate with the central controller has been restored.

30. A card reader for use in a security system as defined in claim 29 wherein one of said first and second data segments comprises authorization data for comparison with said authorization code, and wherein the other of said first and second data segments comprises identification data for storage in said local buffer.

31. A card reader for use in a security system as defined in claim 30, further comprising:

means for providing data indicating local time at said card reader; and means for storing said local time data in said local buffer when said other data segment is stored in said local buffer, thereby storing in said local buffer identification data relating to the card and a representation of the time at which a transaction involving said card occurred at the card reader.

32. A card reader for use in a security system as defined in claim 29, further comprising means for sensing when said local buffer is full, and preventing further access to said controlled area while said buffer is full.

33. A card reader for use in a security system as defined in claim 29, further comprising means responsive to a user selected operating option and also responsive to said means for sensing that said ability to communicate is lost, for prohibiting access to said controlled area while said ability to communicate with the central controller is lost.

34. A method of operating a card reader in a security system having a central controller and plural remote card readers wherein the central controller and each of the remote card readers cooperate to each define separate electrical communication systems, and wherein each card reader has a memory and a local buffer, the method comprising:

reading data stored permanently on a card inserted in a selected card reader, wherein said data is organized on said card so as to define first and second data segments, with read cycles initiated at a rate determined by frequency of card insertions at said reader;

storing data read from said cards in said memory;

sending data from said memory to said central controller at a time controlled by said electrical communication system;

receiving signals from said central controller;

selectively permitting access to a controlled area in response to said signals from the central controller;

storing at least one authorization code;

sensing that ability to communicate with said central controller is lost;

comparing a selected one of said first and second data segments with said authorization code;

granting or denying access to said controlled area independent of signals from the central controller in response to said comparison of said data segment with said authorization code, while said ability to communicate with the central controller is lost;

storing the other of said first and second data segments in said local buffer during periods when said ability to communicate with the central controller is lost;

sensing that said ability to communicate with the central controller is restored; and transmitting the data stored in said local buffer to said central controller at a time controlled by said electrical communication system, when said ability to communicate with the central controller has been restored.

35. A method of operating a card reader in a security system as defined in claim 34, wherein one of said first and second data segments comprises authorization data, and wherein the other of said first and second data segments comprises identification data, said step of comparing a selected one of said data segments with said authorization code comprising the step of comparing said authorization data with said authorization code, and said step of storing the other of said data segments in said local buffer comprising the step of storing said identification data in said local buffer.

36. A method of operating a card reader in a security system as defined in claim 35, further comprising the steps of:

providing data indicating local time at said card reader; and storing said local time data in said local buffer when said identification data is stored in said local buffer thereby storing in said local buffer identification data relating to the card, and a representation of the time at which a transaction involving said card occurred at the card reader.

37. A method of operating a card reader in a security system as defined in claim 34, further comprising the steps of:

sensing when said local buffer is full; and preventing further access to said controlled area while said buffer is full.

38. A method of operating a card reader in a security system as defined in claim 34 wherein, in response to a user selected operating option, the method includes the step of prohibiting access to said controlled area while said ability to communicate with the central controller is lost.

* * * * *